US005548379A

United States Patent [19]

Fukuchi et al.

[11] Patent Number: 5,548,379

[45] Date of Patent: Aug. 20, 1996

[54] IMAGE FORMING APPARATUS

[75] Inventors: Masakazu Fukuchi; Shizuo Morita; Satoshi Haneda; Hiseo Satoh; Tadayoshi Ikeda, all of Hachioji-shi, Japan

[73] Assignee: Konica Corporation, Japan

[21] Appl. No.: 251,622

[22] Filed: May 31, 1994

Related U.S. Application Data

[63] Continuation of Ser. No. 962,036, Oct. 15, 1992, abandoned, which is a continuation of Ser. No. 734,529, Jul. 23, 1991, abandoned.

[30] Foreign Application Priority Data

| | | | |
|---|---|---|---|
| Jul. 26, 1990 | [JP] | Japan | 2-200789 |
| Jul. 26, 1990 | [JP] | Japan | 2-200799 |
| Oct. 2, 1990 | [JP] | Japan | 2-264530 |

[51] Int. Cl.[6] ..... G03G 21/16

[52] U.S. Cl. ..... 355/210; 355/200

[58] Field of Search ..... 355/200, 210, 355/211, 212

[56] References Cited

U.S. PATENT DOCUMENTS

| | | | |
|---|---|---|---|
| 4,470,690 | 9/1984 | Hoffman | 355/212 |
| 4,791,454 | 12/1988 | Takahashi et al. | 355/260 X |
| 4,908,668 | 3/1990 | Takamatso et al. | 355/274 |
| 4,941,002 | 7/1990 | Maruyama et al. | 346/160 |
| 4,975,744 | 12/1990 | Ebata et al. | 355/211 |
| 5,030,988 | 7/1991 | Haneda et al. | 355/200 |
| 5,041,872 | 8/1991 | Nukaya et al. | 355/200 |
| 5,047,803 | 9/1991 | Kanoto | 355/211 |
| 5,065,195 | 11/1991 | Haneda et al. | 355/210 X |
| 5,107,304 | 4/1992 | Haneda et al. . | |
| 5,126,789 | 6/1992 | Fukuchi et al. | 355/200 |
| 5,182,595 | 1/1993 | Fukuchi et al. | 355/200 |
| 5,210,573 | 5/1993 | Fukuchi et al. | 355/211 |
| 5,220,379 | 6/1993 | Fukuchi et al. | 355/200 |
| 5,253,015 | 10/1993 | Morita et al. | 355/310 |
| 5,262,824 | 11/1993 | Morita et al. | 355/200 X |

FOREIGN PATENT DOCUMENTS

| | | |
|---|---|---|
| 331324 | 9/1989 | European Pat. Off. . |
| 370455 | 5/1990 | European Pat. Off. . |
| 468750 | 1/1992 | European Pat. Off. . |
| 468751 | 1/1992 | European Pat. Off. . |
| 468749 | 1/1992 | European Pat. Off. . |
| 407188 | 1/1992 | European Pat. Off. . |
| 1-131577 | 5/1989 | Japan . |
| 1-155365 | 6/1989 | Japan . |
| 2-230165 | 9/1990 | Japan . |

OTHER PUBLICATIONS

Patents Abstracts of Japan, Publication No. JP11/2849, publication date Jul. 7, 1989. Abstact vol. 13448; JPA-87-331148.

Patent Abstacts of Japn, Publication No. JP 1167765, publication date Jul. 3, 1989, Abstract vol. 13438; JPA-87-326427.

Patent Abstracts of Japan, vol. 10, No. 65 (P-436) [2121]; Mar. 14, 1986 JPA-60-205563; Oct. 17, 1985.

*Primary Examiner*—Nestor R. Ramirez

*Attorney, Agent, or Firm*—Jordan B. Bierman; Bierman and Muserlian

[57] ABSTRACT

An image forming apparatus in which there are integrally provided a process cartridge, composed of an image carrying member in which a latent image is formed, and a developing device and/or a cleaning device. The process cartridge is detachably mountable on the apparatus. A moving device moves the process cartridge from a first position, allowing image forming, to a second position in which the process cartridge can be detached. The moving device outputs a signal indicating that the process cartridge is being moved. There is provided a device to output an instruction signal to a controller which, on receipt of the instruction signal, outputs a drive signal to the moving device to move the process cartridge provided that no signal is input from the moving device.

22 Claims, 37 Drawing Sheets

15
PG1
RG1
G37
G36
37
MS2
MS1
G27a
G27b
G27c
G27d
G26a
G26b
G26c
G26d
G14
G13
24
36

16
PG2
RG2
MS4
162
322
32
321
MS3
161
163
27

FIG. 15(a)
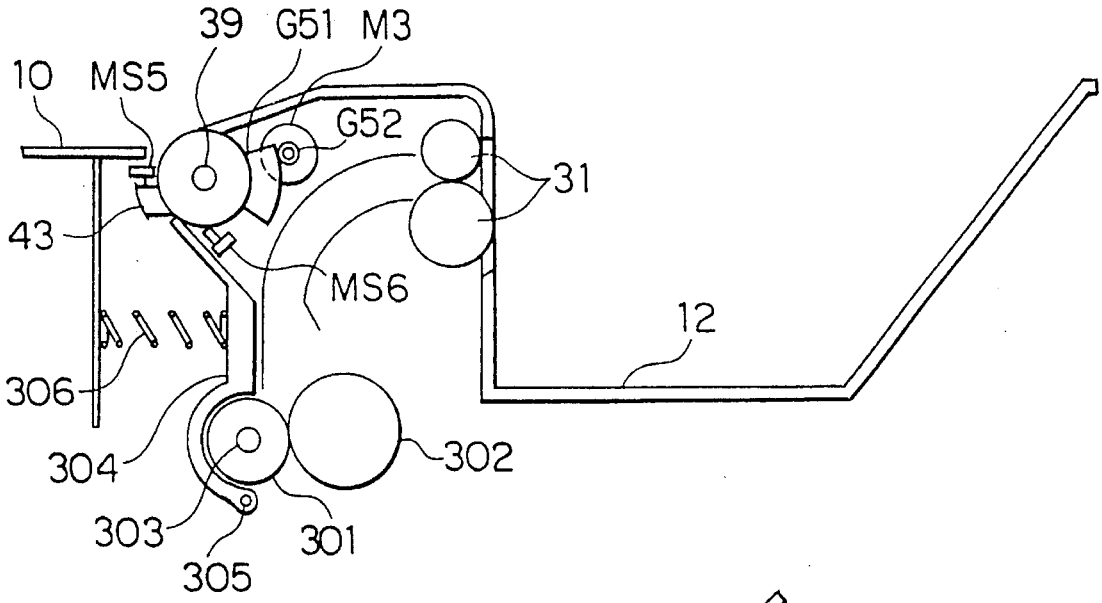
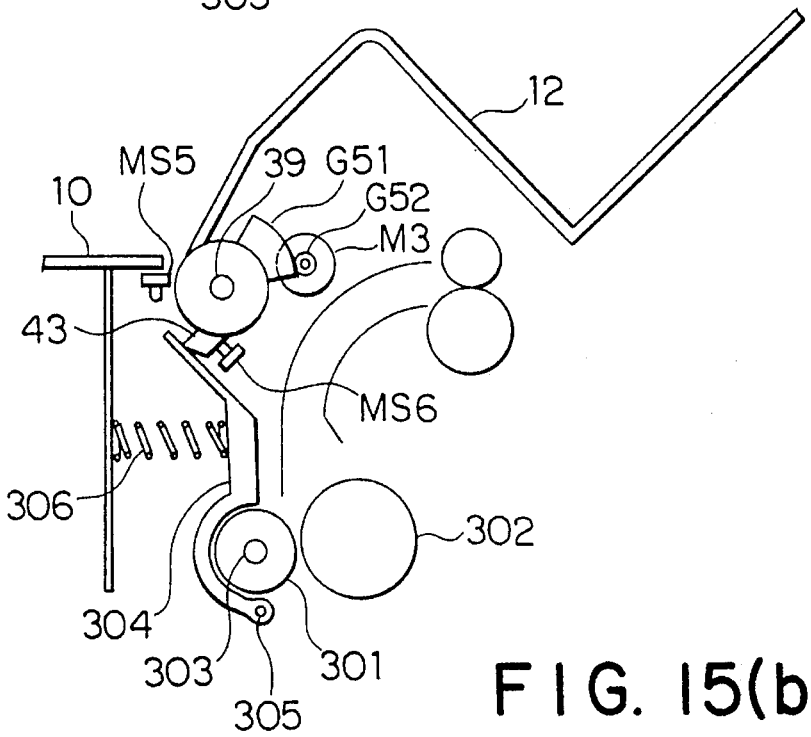
FIG. 15(b)

IMAGE FORMING APPARATUS

This application is a continuation of application Ser. No. 07/962,036, filed Oct. 15, 1992, now abandoned.

BACKGROUND OF THE INVENTION

The present invention relates to an image forming apparatus which forms a toner image on the image carrying member by electrophotography and transfers it onto a transfer material to obtain an image, and more particularly, to an image forming apparatus such as a printer, a copier or a facsimile provided with a process cartridge integrated with an image carrying member and at least one of a developing means and a cleaning means.

With the current reduction of size and weight and heightened performance of image forming apparatus such as printers and copiers, image forming apparatus have been loaded with a greater density and have become more complicated. On the other hand, for the ordinary user, that is, operator it has become easier to perform maintenance and management with an image forming apparatus having a process cartridge integrating the image carrying member with at least one of a developing means and cleaning means.

This image forming apparatus having the process cartridge, such as the printer and copier, allows an operator having no specialized knowledge to perform maintenance and management of the image forming apparatus by replacing the process cartridge when the image carrying member in the process cartridge deteriorates. For the purpose, a guide member is provided for the process cartridge in the main body, and an operator can load the process cartridge so as to obtain optimum images by inserting the process cartridge along this guide member. In conventional apparatus, the insertion direction of a process cartridge is perpendicular to the loading direction of a transfer material in this case, so that the process cartridge handling direction differs from the transfer material handling direction.

Therefore, this makes these works troublesome, space for the installation of an image forming apparatus is restricted and a large working space is required for maintenance.

To solve these disadvantages, Japanese Patent laid open No. 61-279870 was proposed. The proposed image forming apparatus is able to facilitate the handling and operation of consumable and reduce the restriction on working space by making the loading direction of the transfer material the same as the loading direction of the process cartridge mounted on the upper case.

However, in the image forming apparatus disclosed in this Japanese Patent laid open No. 61-279870, upon the replacement of the process cartridge, an operator must open the upper case, and pull and take off the process cartridge from the upper case. For this reason, the work is not only very troublesome but also the operator must use considerable force if the process cartridge is heavy or large. Further, when a paper jam occurs, he must put his hand into the narrow section to remove the transfer material. Even if the upper case is open, a sufficient working space cannot be secured, so that jam clearance work is very hard. Additionally, the operator may sometimes touch a section stained with toner or the image carrying member directly. Even if the process cartridge is moved or removed to secure a sufficient working space, the operator also must pull out the process cartridge from the upper case and this work is troublesome for him so that jam clearance is still difficult to do.

In addition, the present invention relates to an image forming apparatus which forms images on a transfer material of copiers and printers by electrophotography, and more particularly, to an image forming apparatus to which each process material including the image carrying member for image forming is loaded or unloaded in one unit. Various methods and devices have been proposed to obtain color images by electrophotography. For example, the method disclosed in Japanese Patent laid open No. 61-100770 obtains color copies by forming latent images on the photoreceptor, which is an image carrying member, depending upon the number of separated colors, developing, transferring each developed image onto a transfer drum to form a multi-color image and then transferring the image onto a transfer material.

The device based on this method needs a transfer drum large enough to allowing an image to be transferred onto the surface, in addition to a photoreceptor drum, so that the device cannot help but become larger and complicated.

There is another method according to which a latent image is formed on the photoreceptor drum depending on the number of separated colors, each image is developed and transferred onto a transfer material to obtain a multi-color color copy, as disclosed in Japanese Patent laid open No.61-149972. This method cannot provide a good quality color copy because it is difficult to registrate one image upon another image for a multiple color image. Additionally, there is another method according to which a latent image is formed on the photoreceptor drum depending on the number of separated colors, and each color is registrated on the photoreceptor drum for a multiple color toner image, and then transferred. The basic process of this multi-color image forming is disclosed in Japanese Patent laid open Nos. 60-75850, 60-76766, 60-95456, 60-95458 and 60-158475.

These multi-color image forming apparatus which obtain a color image by registrating one image over another are equipped with multiple developing devices containing different color toners around the photoreceptor drum and generally the photoreceptor drum is rotated multiple times to develop a latent image on the photoreceptor drum and obtain a color image.

In case of a color image forming apparatus, in particular, the image forming apparatus provided with multiple developing devices and corresponding toner supply units, the structure of the image forming section is complicated thereby making it very difficult to conduct the inspection, maintenance and replacement or replenishment of each process material.

For this reason, a structure is applied in which the photoreceptor and cleaning device or photoreceptor, developing device and cleaning device are integrated into a cartridge, mounted to the main body as a unit, and the cartridge can be removed from the main body easily when required.

However, when loading the cartridge on the main body, it is necessary to place each process material at its specified position and ensure a complete connection between the main body and drive system.

The device having a toner supply unit in the main body needs to be structured so that the supply pipe can be automatically connected and disconnected depending on the attachment and detachment of the cartridge and also a procedure to prevent toner from scattering into the main body is required.

SUMMARY OF THE INVENTION

An object of the present invention is to provide an image forming apparatus which allows movement and replacement of a process cartridge and paper cassette by simple operation, is free of malfunction despite operational mistakes, and has an excellent maintainability. Another object of the present invention is to provide an image forming apparatus which allows a relatively heavy process cartridge for a color image forming apparatus to be replaced easily. Still another object of the present invention is to provide an image forming apparatus which allows treatment of a paper jam occuring on the paper feed path, together with inspection and repair of the system, to be conducted easily and with safety.

A further object is to provide an image forming apparatus capable of reducing power consumption by minimizing the load on the drive system for carrying the process cartridge or paper feed cassette.

A still further object is to provide an image forming apparatus which enables each process material to be set at a correct position for image forming by the mounting of a cartridge when clearing jam or maintenance, replacement or operation for the process material or the cartridge itself so as to operate securely, and to prevent scattering of toner from the toner supply unit effectively during attachment and detachment of the cartridge.

The composition of the image forming apparatus of the present invention comprises an image carrying member forming latent images, integrated into a process cartridge with at least one of a developing means and cleaning means, which can be loaded or unloaded, process cartridge moving means which moves the process cartridge from a first position in which image forming can be conducted to a second position away from a transfer member and outputs a signal indicating that the process cartridge is being moved, and control means which outputs a signal to the process cartridge moving means when the on-move signal is input while the instruction signal is input.

In another composition of the image forming apparatus of the present invention, a process cartridge containing an image forming means including an image carrying member to form an electrostatic latent image in a unit, and a paper feed cassette storing a transfer material are detachably mounted to the main body, an upper lid member which is a part of the main body above the process cartridge is provided, a switching means of the drive power transmission is connected to a drive power source for forming images with the process cartridge and paper cassette loaded on the image forming apparatus, and when no image is being formed, the drive power transmission of the drive power source is switched to drive at least one of the process cartridge from the image forming position, the paper feed cassette, and the upper lid member.

In another embodiment, an independent drive power source to drive at least one of the process cartridge, the paper feed cassette and the upper lid member is provided independently of the image forming drive power source so that the image forming drive power source and independent drive power source can be selected by means of a circuit selecting means.

Still another composition of the image forming apparatus of the present invention comprises: an image exposure means to write a latent image to a belt-like image carrying member stretched between two rollers, is fixed to the main body of the apparatus; and the process cartridge containing at least an image carrying member can be attached or detached, wherein the mounting direction of the process cartridge maintains an inclination angle of more than 2 degrees to less than 45 degrees downward to the main body, even when the process cartridge is loaded.

BRIEF DESCRIPTION OF THE DRAWINGS

FIGS. 15*a–b* compose a view of the release mechanism of the upper cover.

DESCRIPTION OF THE PREFERRED EMBODIMENTS

The present invention is explained below according to embodiments represented on the attached drawings.

Figure 1:
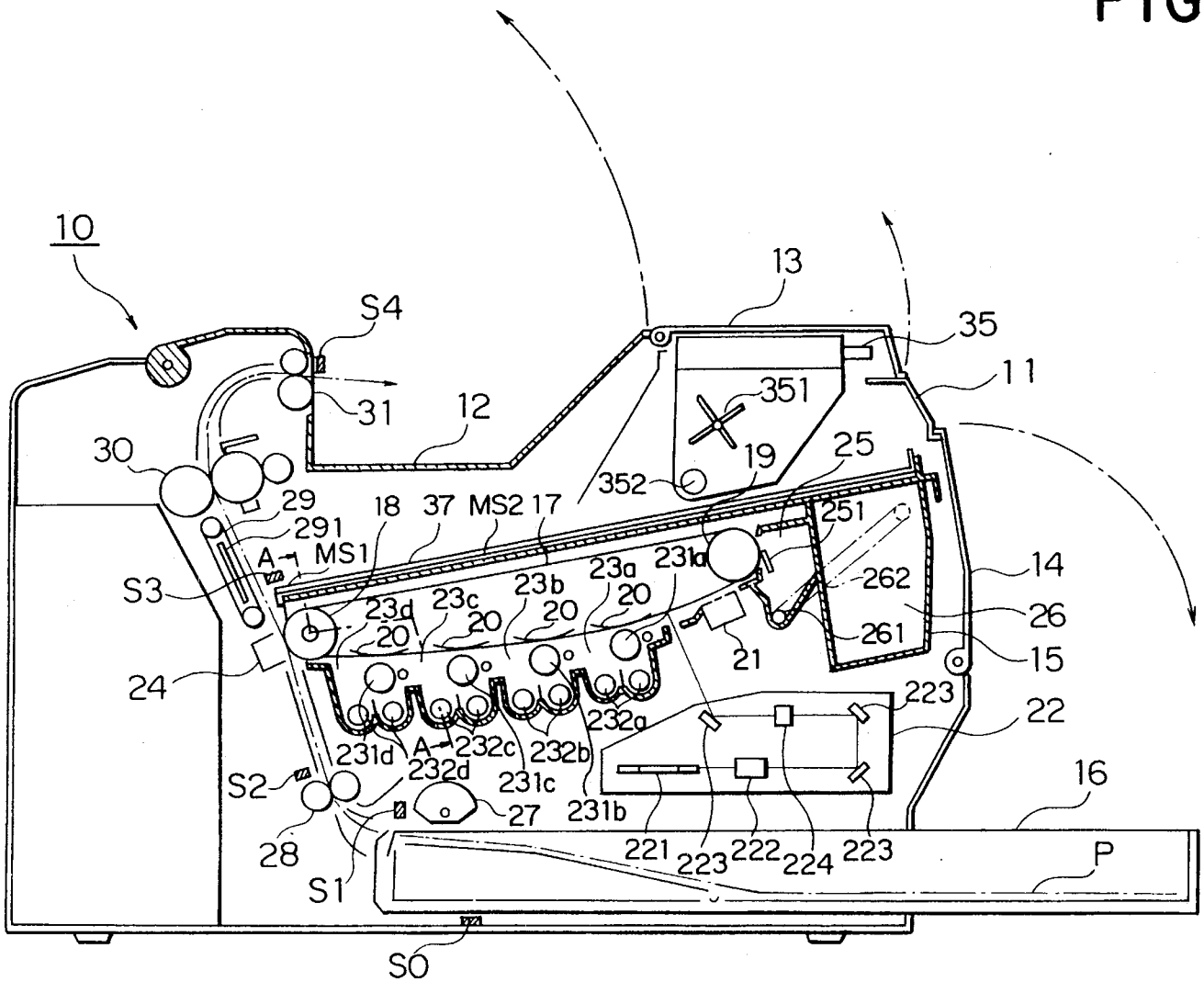
FIG. 1 is a sectional view from the left side, of the major cross section of the color printer to which the present invention is applied.
Figure 2:
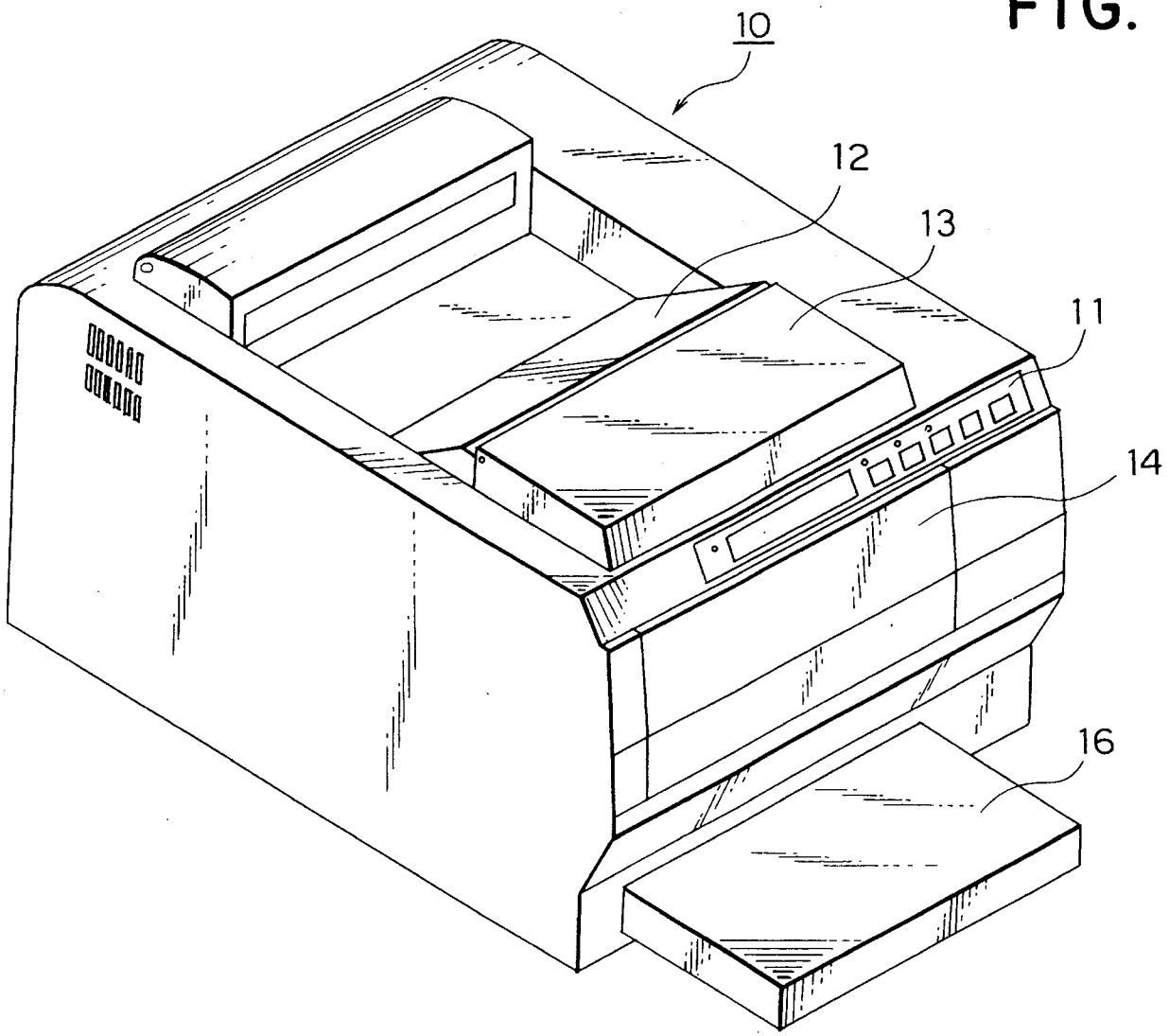
FIG. 2 is a diagonal view of the image forming apparatus.

FIG. 1 represents the major cross section of the left side of the color printer of the present invention. FIG. 2 is a perspective view of the color printer. In the main body of the device 10, the control panel 11, upper lid 12 (upper case member) free to open and close, toner supply cover 13 and front side cover 14, and the process cartridge 15 and paper feed cassette 16 are provided.

Referring to FIG. 1, the photoreceptor belt serving as an image carrying member is coated with a photosensitive layer such as an organic photoconductive layer on the surface of a flexible belt and stretched around drive roller 18 and driven roller 19. The drive roller 18 rotates through the drive gear which meshes with the gear provided on the main body 10 (described in detail later) to convey the photoreceptor belt 17 in the counterclockwise direction. The distance maintaining member 20 maintains the distances between the multiple developing devices 23*a*, 23*b*, 23*c*, 23*d* and photoreceptor belt 17 so as to enable stabilized forming of good quality images.

Although the present embodiment uses the photoreceptor belt 17 as an image carrying member, the present invention is not confined to this and applicable to other image carrying members having a photoconductive layer such as a photoreceptor drum.

The charging means 21, exposure means 22, developing means 23*a*–23*d*, transfer means 24 and cleaning means 25 are arranged around the photoreceptor belt 17. The charging means is provided to charge the photosensitive layer on the surface of the photoreceptor belt 17 equally with a specified polarity, and the existing charger such as a corona charger and or a scorotron charger can be applied. The scorotron charger is desired for an organic photoconductive layer (OPC) photoreceptor.

The exposure means is the semiconductor laser writing system unit 22 and exposes the surface of a charged photoreceptor belt 17 to form an electrostatic latent image.

The developing means are multiple developing devices 23*a*, 23*b*, 23*c* and 23*d* containing different color developers, for example, yellow, magenta, cyan and black toners. These developing devices 23*a* to 23*d* are equipped with the developing sleeves 231*a* to 231*d* to maintain a specified distance and the agitation screw 232*a* to 232*d* to agitate each color toner, and have the function to develop an electrostatic latent image on the photoreceptor belt 17 to a toner image by non-contact developing method. This non-contact developing method is different from contact developing method, and does not damage the preceding toner images formed on the photoreceptor belt 17 or impede movement of the photoreceptor belt, thereby providing an excellent quality color picture. For developing means, besides color developing with four different colors like the present embodiment, two or three color toners can be used, and in this case, the same number of developing devices as that of toner colors are set around the photoreceptor belt 17.

The transfer means transfers a toner image formed on the photoreceptor belt 17 to the transfer material P by means of the transfer device 24 such as the transfer corona discharger. Existing transfer means such as a transfer drum may be used instead of the transfer device 24.

The cleaning means 25 is equipped with a cleaning blade 251 and maintained at a position apart from the surface of the belt 17 in the image forming process, and only at the time of cleaning after a toner image is transferred to a transfer material, it makes a firm contact with the surface of the photoreceptor belt 17 to clean the photoreceptor belt 17.

The toner collection box 26 collects toner left on the photoreceptor belt 17 after being cleaned by the cleaning means 25 through the toner collection pipe using the waste toner screw 261 and stores it.

In the present embodiment, the photoreceptor belt 17, charger 21, developing device 23*a*–23*d* incorporating each color toner, cleaning means 25 and toner collection box 26, which constitute the above mentioned printer image forming section, are incorporated in a single process cartridge 15 as a unit, and can be attached to or detached from the main body together.

However, the process sections to be incorporated in the process cartridge as a unit are not limited to this structure, and the photoreceptor 17 and developing device 23*a*–23*d* or photoreceptor belt 17 and cleaning means 25 can be incorporated as a unit, and other process sections also may be combined.

The color image forming process on the color image forming apparatus having the configuration mentioned above is conducted as follows:

The process cartridge 15 is loaded at the position 1 in the main body of the image forming apparatus 10 and is able to form an image. When an image signal of the first color output from the image reader separated from the main body 10 is input into the laser write system unit 22, the semiconductor laser (not shown) in the laser write system unit 22 generates a laser beam. The laser beam is reflected by the polygon mirror 221 which is rotated by the drive motor (not shown) and then projected on the surface of the photoreceptor belt 17 charged equally with a specified electric charge by the charger 21 through the fθ lens 222, cylindrical lens 224 and three mirrors 223 so as to form luminescent lines.

As for the secondary scanning direction, a belt index (not shown) corresponding to a specific position of the photoreceptor belt 17 is detected or a print instruction signal is received, and then the primary scanning line to start modulation of semiconductor laser by an image signal is determined according to this detection or instruction signal. Concerning the primary scanning direction, when scanning starts, the laser beam is detected by the index sensor (not shown) and according to this detected signal, modulation of semiconductor laser by the image signal of the color 1 starts so that modulated laser beam is run on the surface of the photoreceptor belt 17. Consequently, a latent image corresponding to the color 1 is formed on the surface of the photoreceptor belt 17 uniformly charged by the primary scanning by laser beam and secondary scanning by the conveyance of the photoreceptor belt. This latent image is developed by the developing device 23*a* incorporating yellow toner corresponding to the color 1 in the developing means and a yellow toner picture is formed on the surface of the photoreceptor belt 17. After that, the photoreceptor belt 17 passes under the cleaning blade 251 separated from the surface of the photoreceptor belt 17 while holding the yellow toner picture, followed by the start of the image forming of the color 2.

That is, the photoreceptor belt 17 where a yellow toner picture was formed is charged uniformly by the charger 21 again and then the image signal of the color 2 is input into the laser write unit mentioned above, to form a latent image. This latent image is developed as the color 2 by means of the developing device 23*b* containing magenta toner. This magenta toner picture is formed on the already formed yellow toner picture.

Likewise, a latent image of the color 3 is formed by the image signal and then a cyan toner picture is formed by means of the developing device 23*c* containing cyan toner. Further, a latent image of the color 4 is formed by the image signal and then a black toner image is put over the already formed images on the surface of the photoreceptor belt 17 by the developing device 23*d* containing black toner, so that a color toner image is formed on the photoreceptor belt 17.

The developing sleeves 231*a* to 231*d* of these developing devices 23*a* to 23*d* are charged with DC or AC bias so as to produce a reversal (jumping development) on the photoreceptor belt 17 whose base is grounded without a contact. Meanwhile, either one-component developer or two-component developer can be utilized for this non-contact development. Although it is not necessary to set a toner hopper independently of the developing device when one-component developer is used, the method using two-component developer produces better the stability of developing, therefore the latter is more favorable for reproduction of color.

A color toner image formed on the surface of the photoreceptor belt 17 as mentioned above is supplied from the paper feed cassette 16 to the paper feed roller 27 and transferred onto a transfer material by the timing roller 28 by aligning the timing with the color toner picture. Then, the transfer device 24 is charged with a high voltage output with an opposite polarity to toner to transfer an image.

After a color toner image is transferred, the transfer material P is separated from the photoreceptor belt 17 which changes its direction suddenly (small curvature) around the drive roller 18 and carried up by the transfer belt 29. Meanwhile, this carrying belt 29 is equipped with the suction means 291 and carries up the material by sucking it. After fused toner is fixed to the transfer material P by the fixing roller 30, it is discharged to the top surface of the upper cover 12 serving as a paper discharge tray.

On the other hand, after the transfer of a color toner picture to the transfer material P is completed, the photoreceptor belt 17 is further conveyed in the clockwise direction and then the left over toner is removed and wiped off by the cleaning means 25 with the cleaning blade 251 fit firmly. After the cleaning, the cleaning blade 251 leaves the photoreceptor belt 17 again and enters a new image forming process.

The jamming detection sensor is explained below.

Referring to FIG. 1, the jamming detection sensors S1, S2, S3 and S4 are photosensors which detects whether the transfer material P has passed or not, and are provided on the transfer material P transportation path. By the presence or absence of the transfer material P detected by the jamming detection sensors S1 to S4, the jamming determination unit detects a jam. This jamming determination unit detects a jam by the conventional method to judge a jam if no transfer material P can be detected within a specified interval of time or the transfer material P has been detected for more than a specified interval of time. The jamming detection sensors S1 to S4 detect whether or not a transfer material is supplied from the paper feed cassette 16, a transfer material is fed by the timing roller 28, a toner picture is separated after a transfer of images, and a finished paper is discharged by the paper discharge roller 31.

The allocation of the jamming detection sensor is not confined to this embodiment, but additionally, a jamming detection sensor to detect whether a transfer material is wound around the fixing roller may be attached.

The paper shortage sensor S0 is a sensor to detect whether or not there is a transfer material in the paper feed cassette when the paper feed cassette 16 is loaded on the main body 10. For these jamming detection sensors S1–S4 and paper shortage sensor S0, as shown in this embodiment, not only the reflection type photocoupler but also the transmission type photocoupler can be used, and further an existing sensor such as a non-contact lead switch or contact type micro switch can be used.

Figure 3:
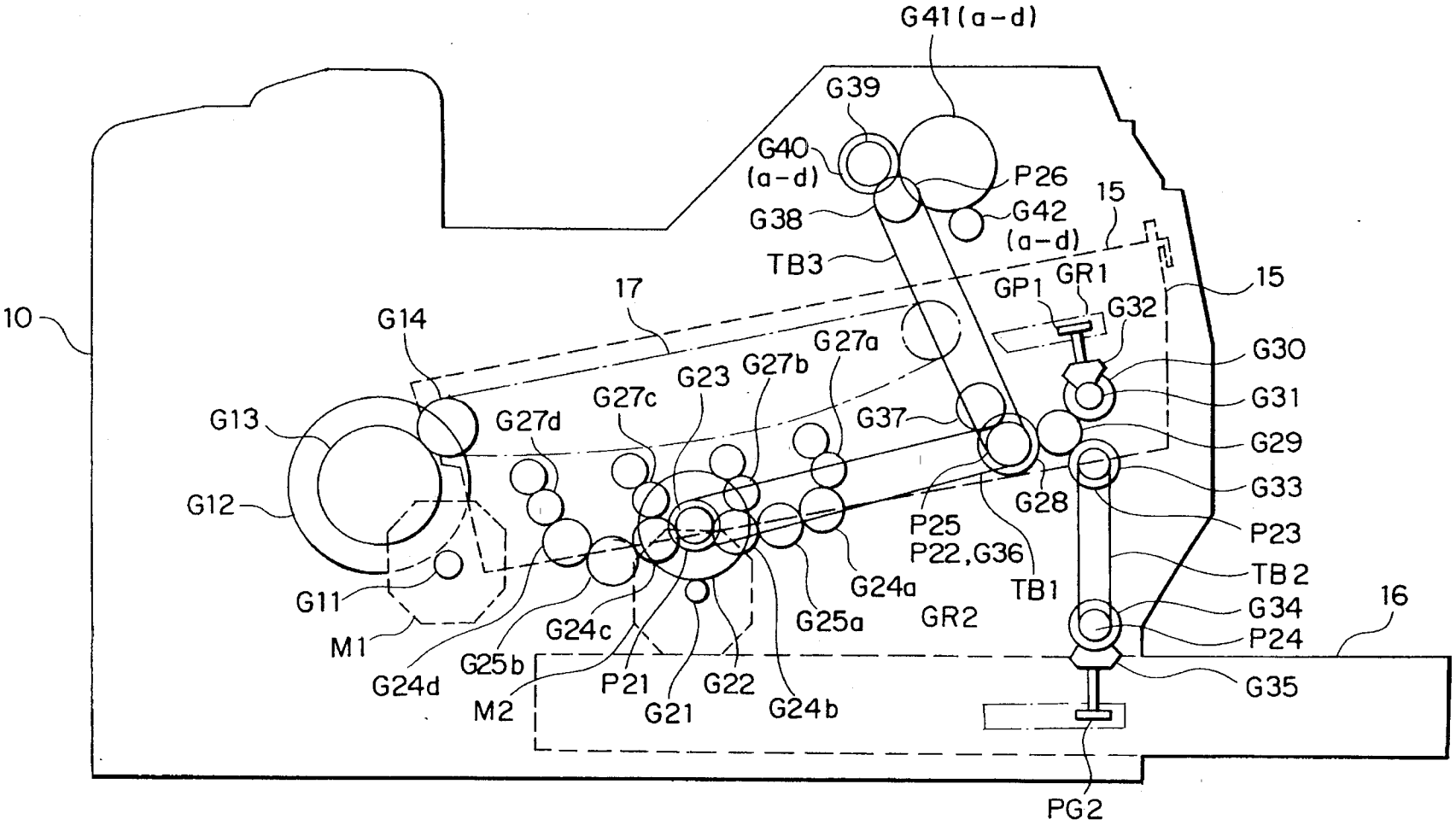
FIG. 3 a view showing the drive system of the image forming apparatus of the present invention.
Figure 4:
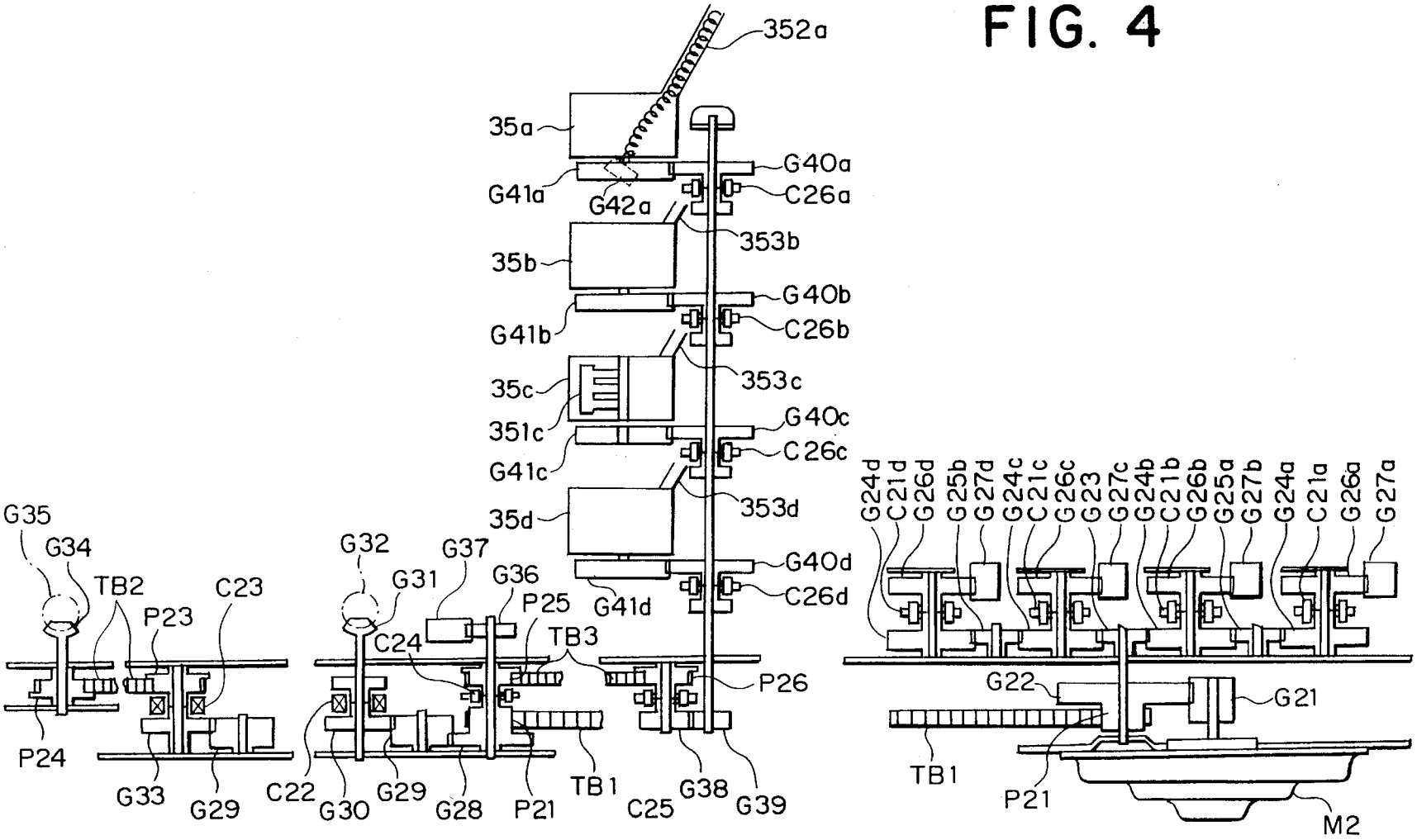
FIG. 4 is a top view of the drive system to move the process cartridge and the cassette.
Figure 5:
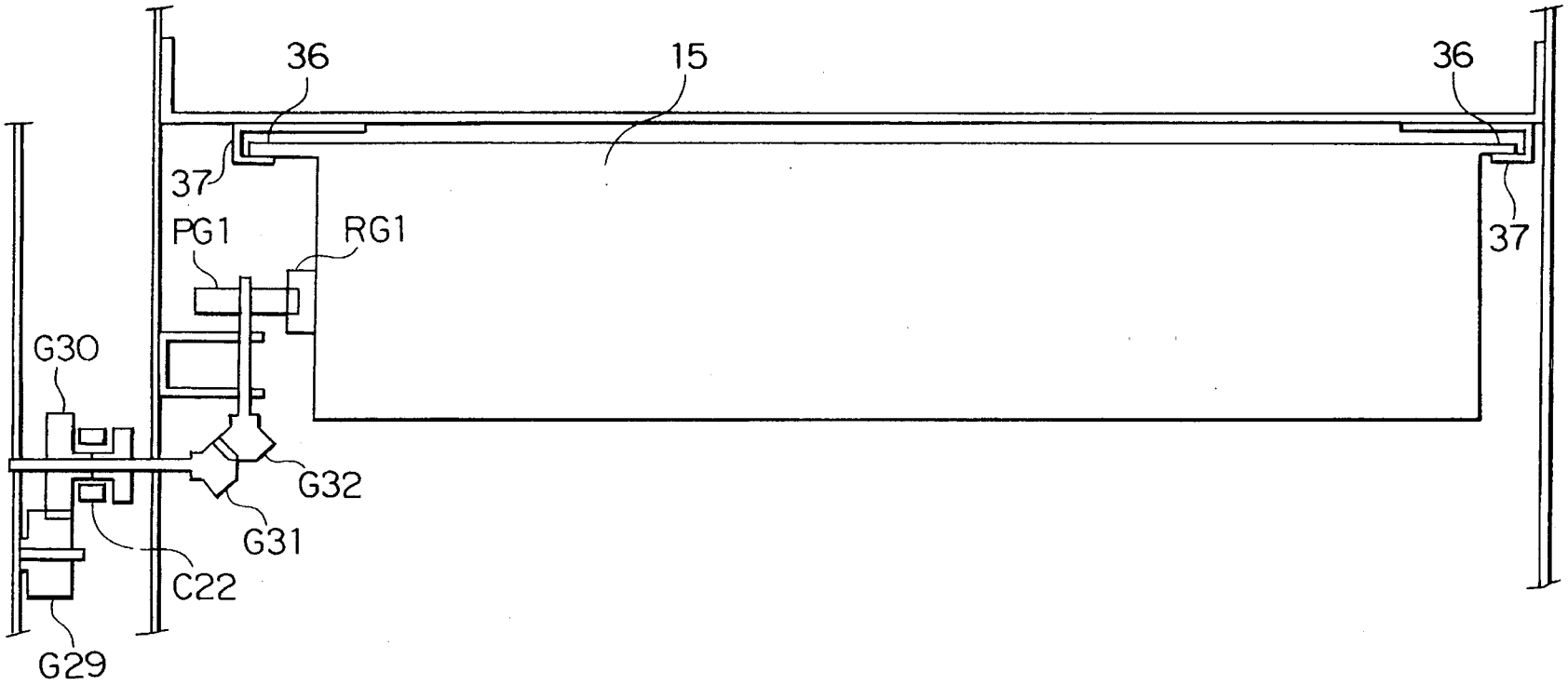
FIG. 5 is a view indicating the major part of the drive system of the process cartridge.

Referring to FIGS. 3 to 5, the drive system of the process cartridge is explained below.

FIG. 3 is a view illustrating the drive system for image forming in the process cartridge 15, drive system for moving the process cartridge and drive system for moving a cassette from the left side. Meanwhile, the drive system of the process cartridge 15 shown in this embodiment, drive system for moving the process cartridge and drive system for moving a cassette are driven by two motors M1 and M2.

The drive system of the photoreceptor belt 17 is driven by motor M1. The gear G12 is engaged with the gear G11 on the shaft of the motor M1. When the process cartridge 15 is located at a position where image forming is enabled, the drive gear G14 provided on the same axis as the drive roller 18 to convey the photoreceptor belt 17 is in mesh with the gear G13 which rotates together with the gear G12. That is, the rotary force of the motor M1 is transmitted to the drive gear G14 through the gears G11, G12 and G13 and adjusted to an appropriate rotation speed and further it rotates the drive roller 18 together with the drive gear G14 in the counterclockwise direction in the same figure to convey the photoreceptor belt 17.

Then the developing devices 23*a* to 23*d*, waste toner screw 261 and toner hopper 35 are explained below.

This drive system utilizes the motor M2. The rotary force of the motor M2 is transmitted to the gear G22 through the gear G21 of the motor M2, and further to the gear G23 set coaxially integrated with the gear G22 so as to drive the developing devices 23*a*–23*d*, process cartridge, toner supply unit, and waste toner collection unit.

First of all, the drive system of the developing devices 23*a* 23*d* is explained below.

The rotary force of the motor M2 is transmitted to the gears G24*b* and G24*c* through the gears G21, G22 and G23, and then to the gears G24*a* and G24*d* through the gears G25*a* and G25*b*. To transmit only the rotation of a single direction, the gears G26*a*–G26*d* are allocated coaxially with the gears G24*a*–G24*d* through the open type spring clutches C21*a*–C21*d* and when the process cartridge 15 is located at a position where image forming is enabled, it is allocated so as to mesh with the developing device drive gears G27*a*–G27*d* mounted on the process cartridge 15. Then after being transmitted to the developing device drive gears G27*a*–G27*d*, the rotary force is transmitted to the developing sleeves 231*a*–231*d* and agitation screws 232*a*–232*d* through the gear set on the process cartridge 15 so as to rotate the developing device. That is, the rotary force of the motor M2 is transmitted to the gears G24*b* and G24*c* through the gears G21, G22 and G23 and further to the gears G24*a* and G24*b* through the gears G25*a* and G15*b*, and when required, to the developing device drive gears G27*a*–G27*d* by letting in the clutch, to drive the developing devices 23*a*–23*d*. As for the driving of the developing devices 23*a*–23*d* during image forming, it is desired to drive only a developing device corresponding to each color under forming an image and not to drive the developing devices 23*a*–23*d* when the process cartridge 15 mentioned later moves. For this reason, it is preferred to control the system by a stepping motor (not shown) by providing cams having a pawl in contact with the ratchet of the spring clutches C21–C21*d* and further setting five selection positions including a position where no clutch is connected. For example, by setting the pawls of the four cams corresponding to each clutch on the same axis with a phase difference of 72 degrees and rotating the stepping motor by 72 degrees, it is possible to control the developing devices 23*a*–23*d* so that only one operates or none operates.

Then, the process cartridge carrying means is explained.

After being transmitted to the gear G22, the rotary force of the gear G22 is transmitted to the pulley P22 through the pulley P21 and timing belt TB1 rotating together with the gear G22, and to the gear G29 in mesh with the gear G28 rotating together with the pulley P22. Further, the rotary force of the motor M2 transmitted to the gear G29 is transmitted to the gear G30 in mesh with the same gear G29. Then the rotary force is transmitted to the gear G31 through the electromagnetic clutch as required. The gears G31 and G32 are intersecting mushroom head gears and transmit the rotary force transmitted to the gear G31 to the pinion gear. (See FIG. 5) This pinion gear PG1 is able to be engaged with the rack gear RG1 provided on the side of the process cartridge 15, so that the rotation of the pinion gear PG1 and the rack gear RG2 move the process cartridge 15 to the right and left as shown in FIG. 1.

Now, the cassette moving means is explained.

Figure 6:
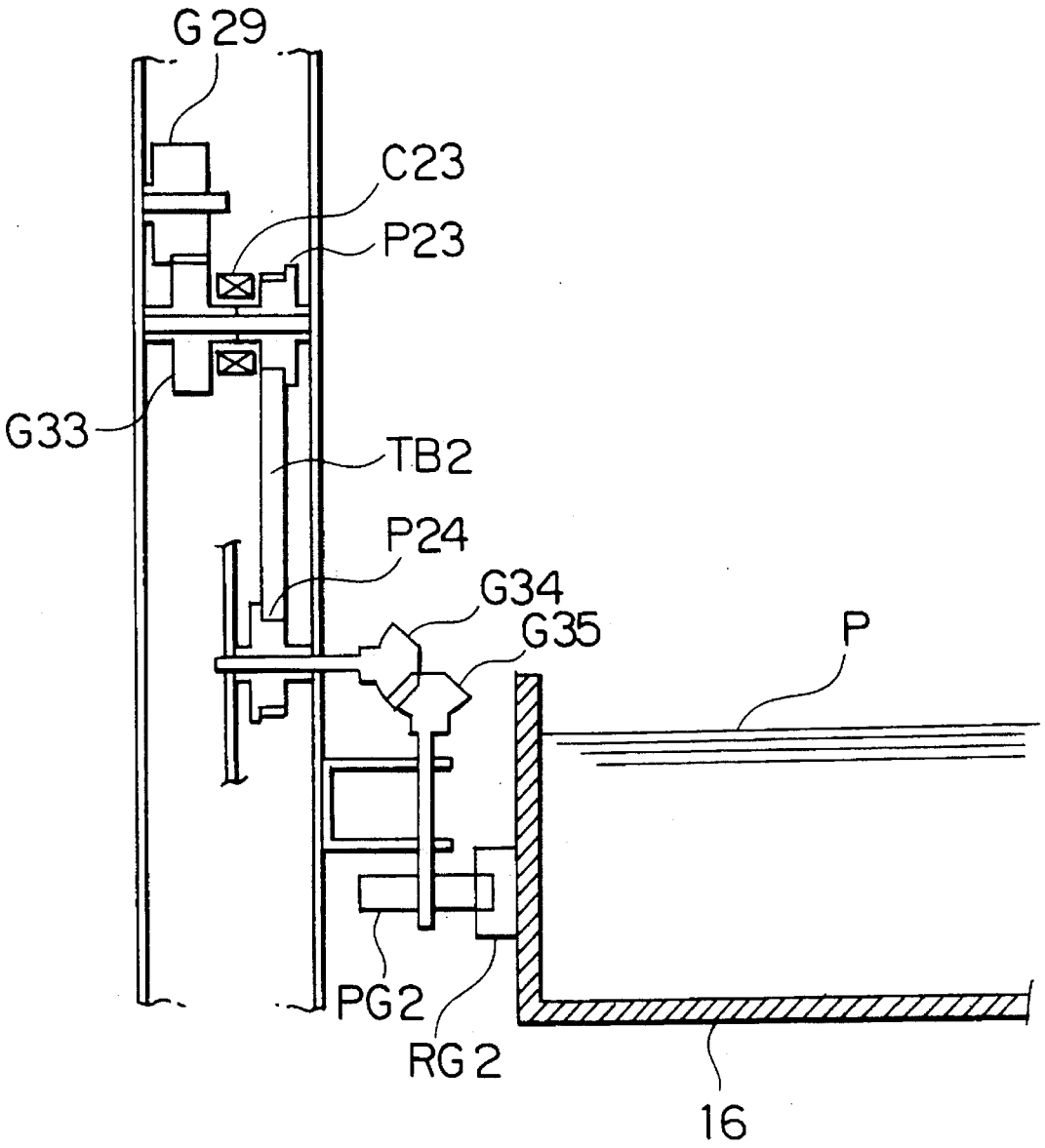
FIG. 6 is a view indicating the major part of the drive system to move the paper feed cassette.

After being transmitted to the gear G29, the rotary force of the motor M2 is transmitted to the gear G33 in mesh with the gear G29. That rotary force is transmitted to the pulley P22 through the electromagnetic clutch C23 as required, to the pulley P22 through the timing belt TB2 and further to the gear G34 rotating together with the pulley P24. The gears G34 and G35 are intersecting gears and transmit the rotary force transmitted to the gear 34 to the pinion gear G2. (See FIG. 6) This pinion gear PG2 is able to mesh with the rack gear RG provided on the side of the paper feed cassette 16, so that the paper feed cassette 16 is moved to the right and left by means of the rotation of the pinion gear PG2 and the rack gear RG2. Details of the travel of this paper feed cassette 16 is explained later.

Now the drive system for waste toner collection is explained.

After being transmitted to the pulley P22, the rotary force of the motor M2 is transmitted to the pulley P25 through the open type spring clutch C so as to drive the drive system of the waste toner screw 261.

Concerning the drive system of the waste toner screw 261, the rotary force transmitted by an engagement between the gear G36 rotating together with the same pulley P25 and the waste toner screw drive gear G37 provided on the side of the process cartridge 15 drives the waste toner screw 261. The waste toner screw 261 carries waste toner to the toner collection box 26 through the toner collection pipe 262 incorporating a coil spring to collect toner left on the photoreceptor belt 17 after cleaning by the cleaning means 25.

Now the drive system of the toner hoppers 35*a*–35*d* is explained.

After being transmitted to the pulley P25, the rotary force of the motor M2 is transmitted to the pulley P26 through the timing belt TB3, to the gear G38 through the spring clutch C25 as required and further to the gear G39 in mesh with the same gear G38. The toner hopper agitating members 351*a*–351*d* rotate with the gears G41*a*–G41*d* to agitate toner for supply in the toner hopper 35*a*–35*d* and at the same time, the supply toner screws 352*a*–352*d* provided coaxially with the gears G42*a*–G42*d* in mesh with the gears G41*a*–G41*d* rotate to carry toner for supply to the developing devices 23*a*–23*d* in the process cartridge 15. Meanwhile, the toner hoppers 35*a*–35*d* are driven to match the drive of the above mentioned developing devices 23*a*–23*d*. That is, if a developing device corresponding to a color being used for image forming is operating, only the toner hopper incorporating the same color toner for supply is driven. For this drive control, the spring clutches C26–C26*d* are used and the control can be implemented using a stepping motor and cam (not shown) like control of the developing device drive.

Meanwhile, the drive system of the photoreceptor 17 and drive system of the developing devices 23*a*–23*d*, waste toner screw 261, toner hopper 35, process cartridge moving means and cassette moving means are driven by two motors M1 and M2 in this embodiment, but these drives may be implemented with one drive motor and it is possible to change over selectively by clutch selection.

Or it is possible to drive the process cartridge and cassette independently of the image forming drive source by providing them with individual motors.

Figure 14:
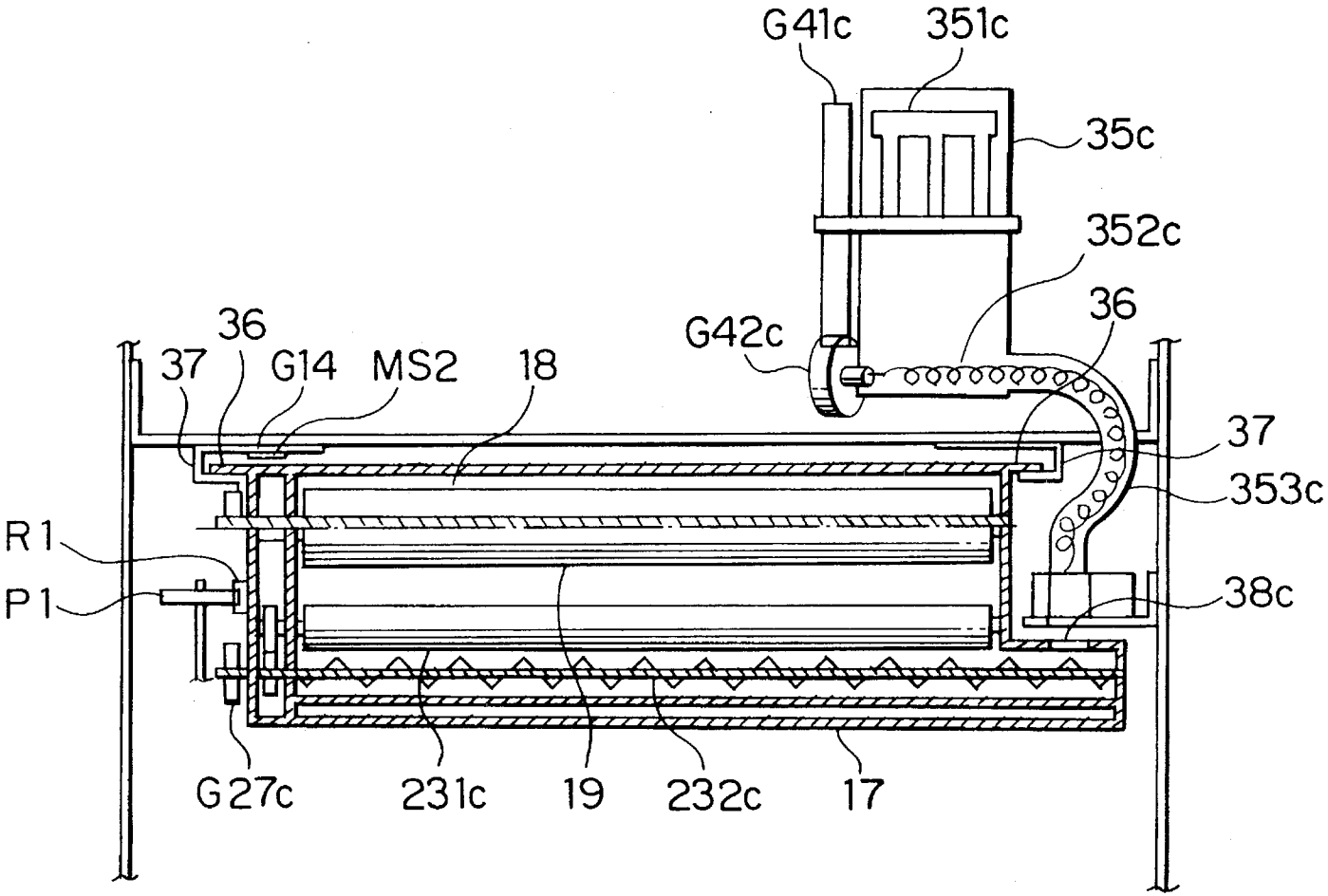
FIG. 14 is a view in the section AA shown in FIG. 1.

Next, the travel of the process cartridge is explained using FIG. 14 which is a view of the cross section A—A of FIG. 1 and FIG. 7 illustrating the travel of the process cartridge.

A protruded member 36 and rack R1 used for moving are provided on the side of the process cartridge 15. The process cartridge 15 is also provided with a drive gear G14 for image formation, drive gears G27*a*–G27*d* for a developing unit, and a drive gear G37 for a used toner screw. A roller may be provided to the protruded member 36 so that the process cartridge 15 can be moved easily.

The following units are provided inside the storage chamber for the process cartridge 15 in the apparatus body 10: a guide member 37 which guides the process cartridge 15 when it is attached to or detached from the apparatus (In this embodiment, when the protoruded member 36 is inserted into the guide member 37, the process cartridge 15 is guided being suspended by the guide member 37.); a drive gear G14 for the process cartridge 15; gears G27*a*–G27*d* to drive the developing unit; and a gear G13, gears G26*a*–G26*d*, and a gear G36 corresponding to a gear G34 to drive the used toner screw. A pinion P1 is provided in such a manner that the pinion P1 can be meshed with the rack R1 provided to the process cartridge 15. Further, the first and second microswitch MS1, MS2 are mounted on the guide member 37. These first and second microswitch MS1, MS2 are detecting means to detect the position of the process cartridge 15.

The first and second micro switches MS1 and MS2 detect the first position where the drive gear G14, developing device driving gears G27*a*–G27*d* and waste toner screw drive gear G37 provided on the process cartridge 15 mesh with the gear G13, gears G26*a*–G26*d* and gear G36 respectively to enable forming of an image and the second position, further from the transfer device 24 as compared with the first position, namely, a position retracted from the first position in an opposite direction to the process cartridge insertion direction. The second position must be set so that the gravity center of the process cartridge 15 is not in the unit 10. The reason is that if the gravity center of the process cartridge 15 is out of the unit, the mesh between the rack gear RG1 and pinion gear PG1 worsens thereby making it difficult to take out and insert the process cartridge 15.

The position detection sensor to detect the first and second positions is not limited to the micro switch but the conventional sensor using a photoelectric switch or magnetic switch can be applied. In addition, the first and second micro switches MS1 and MS2 don't need to be set on the guide member 37 and can be set on the main body because they can satisfy their purpose if the first and second positions can be detected.

Now, the travel of the process cartridge 15 is explained according to FIG. 7.

As shown in FIG. 7 (A), the process cartridge 15 is located at the first position to enable image forming, the drive roller 18 and the transfer device 24 maintain a desirable distance between each other (when a transfer means is the transfer drum, an appropriate fitting pressure is maintained), and the drive gear G14, developing device drive gears G27*a*–G27*b*, waste toner screw drive gear G37 provided on the process cartridge are in mesh with the gear G13, gears G26*a*–G26*d* and gear G36, respectively, provided on the main body 10, so that image forming can be done in an optimum condition. Additionally, the rack gear RG1 is in mesh with the pinion gear PG1.

The jamming determination unit judges a signal about the presence/absence of a transfer material transmitted from the above mentioned jamming detection sensors S1–S4, and if it judges a jam, the jamming determination unit transmits a jamming signal to the control unit. Then, the control unit stops the drive units related to image forming such as the photoreceptor belt drive unit, developing device drive unit and fixing drive unit, and at the same time, control the process cartridge moving means. Namely, the control unit sends a signal to the motor M2 which serves as the drive source for the process cartridge moving means and electromagnetic clutch C22, and rotates the pinion gear PG1 to move the process cartridge 15 from the first position to the second position so as to move the process cartridge 15 toward the second position along the guide member 37. (See FIG. 7(B))

Figures 7A, 7B, 7C:
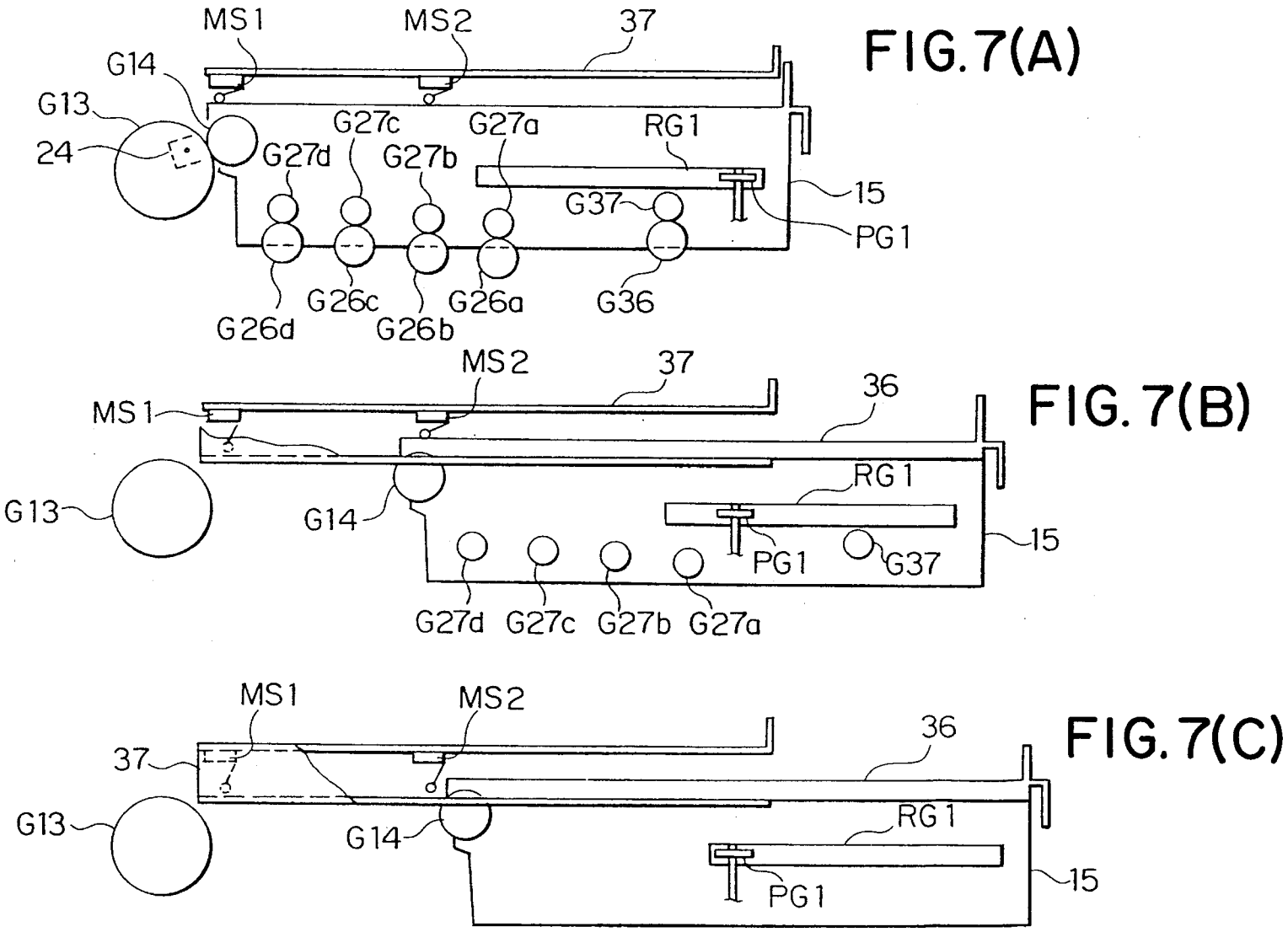
FIGS. 7*a–c* compose a diagram indicating the movement process of the process cartridge.

When the process cartridge 15 travels as shown in FIG. 7(C), the second micro switch MS2 detects that the process cartridge 15 has traveled up to the second position and transmits the signal to the control unit. The control unit receives that signal, releases the electromagnetic clutch C22 and stops the motor M2. Namely, the process cartridge 15 stops at the second position with the rack gear RG1 in mesh with the pinion gear PG1 and retracts from the first position to the second position. Meanwhile, the front cover 14 is structured so as not to obstruct the travel of the process cartridge. For jamming treatment, there is no problem in this condition or with the process cartridge 15 located at the second position. Because the process cartridge is attachable or detachable at the second position, it can be removed from the main body 10 by pulling it slightly, from the second position and replaced. Meanwhile, the front cover 14 is structured so as not to obstruct the travel of the process cartridge 15.

On the contrary, when inserting the process cartridge 15 into the main body 10, it must be inserted with the protrusion 36 of the process cartridge 15 along the guide member 37 in the process cartridge storage chamber, until the rack R1 meshes with the pinion gear PG1 and the process cartridge 15 comes to the second position. (FIG. 7(C))

To move the process cartridge 15 from this condition to the first position which enables image forming, the process cartridge 15 located at the second position must be inserted further or a set signal must be entered into the control unit by pressing the setting button of the control panel 11. When this setting signal is entered, the control unit transmits a signal to the motor M2 and electromagnetic clutch C22 and rotates the pinion gear PG1 to move the process cartridge 15 from the second position to the first position (reverse to the rotation direction for take out), moving the process cartridge 15 toward the first position along the guide member 37. (FIG. 7(B))

Still more, when the process cartridge 15 travels, the first micro switch MS1 detects that the process cartridge 15 has traveled up to the first position and transmits a related signal to the control unit. When the control unit receives that signal, it releases the electromagnetic clutch C22 and stops the motor M2. Namely, the process cartridge 15 stops at the first position, so that the drive gear G14, developing device drive gears G27*a*–G27*d*, waste toner screw drive gear G37 provided on the process cartridge 15 mesh with the gear G13, gears G26*a* G26*d* and gear G36, respectively, provided on the main body 10 so that image forming is enabled. At this time, the toner feed pipes 353*a*–353*d* of the toner hoppers 35*a*–35*d* are automatically connected to the corresponding toner supply ports 38*a*–38*d* of the developing devices 23*a*–23*d* in the process cartridge 15 so as to enable the supply of toner.

When this process cartridge 15 travels, the front cover 14 is energized by a spring in the closing direction, therefore it does not obstruct the travel of the process cartridge 15. Namely, when the process cartridge 15 travels, the front cover 14 is pushed and released. Another method is to latch the front cover 14 energized by a spring by means of a solenoid and release it by spring's recovery force after releasing the latch by a signal transmitted to the solenoid at the same time as the control unit transmits a signal to move the process cartridge 15. If the front cover is constructed to be released by the motor and gear, the front cover 14 is not only released when the process cartridge 15 travels from the second position to the first position, but also the first micro switch MS1 detects that the process cartridge 15 has traveled up to the first position when it travels from the second position to the first position, thereby automatically closing the front cover 14. Now, the travel of the paper feed cassette is explained according to FIG. 8.

The paper feed cassette 16 is provided with a rack gear RG2 on its side face and a protrusion 161 in its insertion direction, the bottom plate 162 on which transfer materials P are loaded, capable of shifting freely and the separation pawl 163.

The cassette storage chamber of the main body 10 includes a paper feed roller 27, a pinion gear PG2 for moving the paper feed cassette 16, push-up lever 32 for raising the bottom plate 162, photoelectric switch MS3 comprising a photocoupler and micro switch MS4.

The push-up lever 32 is supported by the push up mechanism 321 provided on the main body 10 and equipped with a roller 322 at the end. This push up mechanism may employ the principle of the lever and fulcrum or motor.

The photoelectric switch MS3 and micro switch MS4 are detection means for detecting the position of the paper feed cassette 16. Here, the photoelectric switch MS3 and micro switch MS4 detect the first position where the push up lever 32 has pushed up the topmost face of a transfer material in the paper feed cassette 16 to the separation pawl 163 so as to enable paper feeding and the second position where the paper feed cassette has retracted from the first position in an opposite direction to the insertion direction of paper feed cassette 16, respectively and output the position signals to the control unit. In this case, the second position should be set so that the gravity center of the paper feed cassette 16 is not out of the main body 10 like the case for the process cartridge 15. The position detection sensors for detecting the first and second positions are not limited to this embodiment, but existing various sensors employing a micro switch, photoelectric switch or magnetic switch may be utilized.

Figures 8A, 8B, 8C:
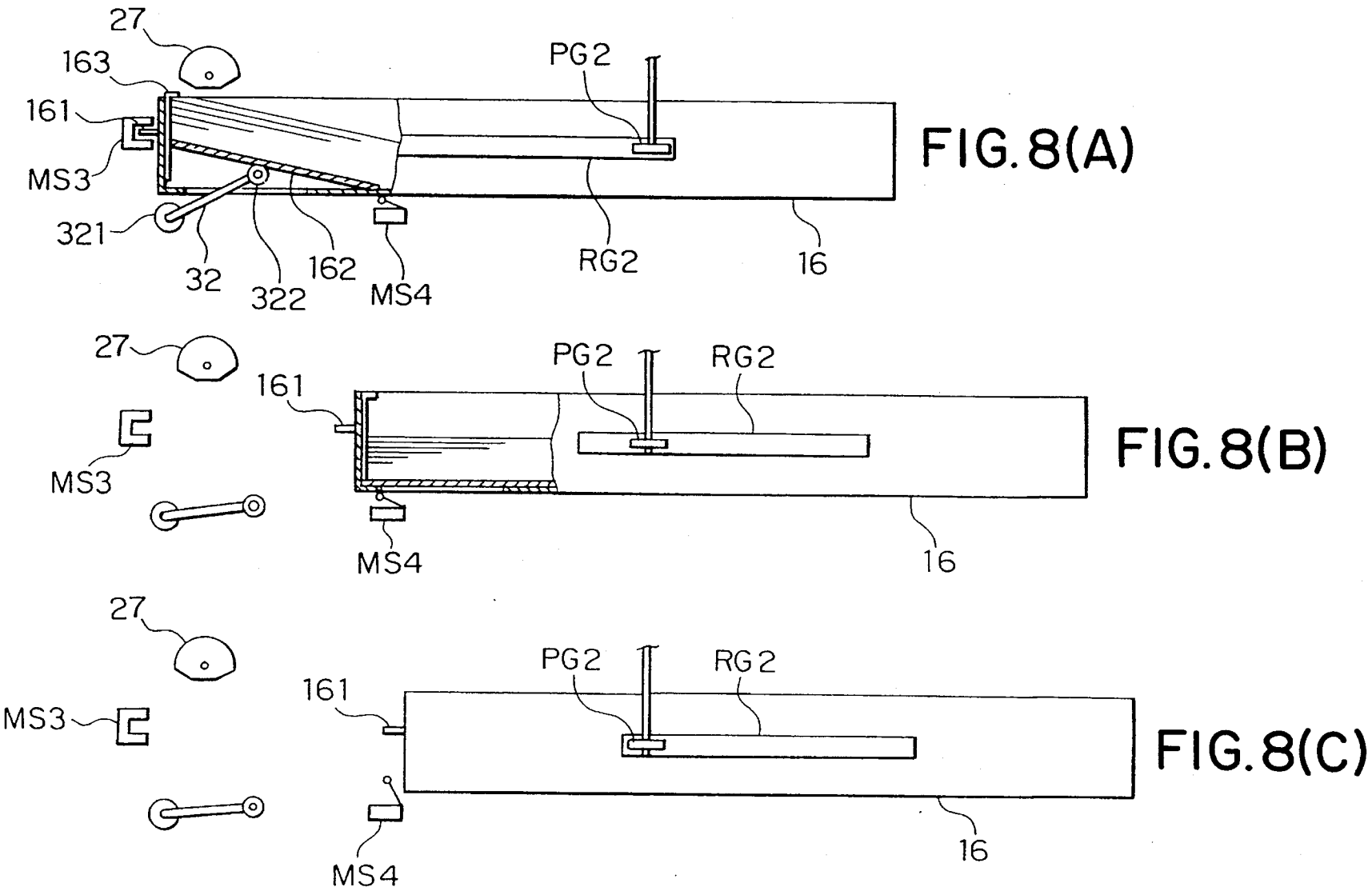
FIGS. 8*a–c* compose a diagram indicating the movement process of the paper feed cassette.

When taking out the paper feed cassette 16, the paper feed cassette 16 is located at the first position as shown in FIG. 8 (A), the paper feed roller 27 can feed transfer materials in an optimum condition. The rack gear RG2 is in mesh with the pinion gear PG2.

When a jam is detected, the control unit transmits a signal to the motor M2 which is the drive unit for the cassette moving means and electromagnetic clutch 23, and rotates the pinion gear to move the paper feed cassette 16 from the first position to the second position. At this time, the push up lever 32 retracts down the paper feed cassette 16 travel path so as not to obstruct the travel of the paper feed cassette 16. (See FIG. 8 (B))

When the paper feed cassette 16 travels as shown in FIG. 8 (C), the micro switch MS4 detects that the paper feed cassette 16 has traveled up to the second position and transmits a signal to the control unit. As soon as it receives this signal, the control unit releases the electromagnetic clutch C23 and stops the motor M2. Namely, with the rack gear GR2 in mesh with the pinion gear PG2, the paper feed cassette stops at the second position and retracts from the first position to the second position.

On the contrary, when inserting the paper feed cassette 16 into the main body 10, the paper feed cassette 16 is inserted along the cassette storage chamber or guide member (not shown) to engage the rack gear RG2 with the pinion gear PG2 until it reaches the second position. (FIG. 8 (C))

To move the paper feed cassette 16 from this condition to the first position which enables paper feeding, the paper feed cassette located at the second position is inserted further or a set signal is input into the control unit by pressing the set button of the control panel 11. When this set signal is input, the control unit transmits a signal to the motor M2 and electromagnetic clutch C23 so as to rotate the pinion gear PG2 to move the paper feed cassette 16 from the second position to the first position (reverse to the rotation for taking out). Consequently, the paper feed cassette 16 is moved to the first position along the guide member 37. (FIG. 8 (B))

When the paper feed cassette 16 travels further, as shown in FIG. 8, the photoelectric switch MS3 detects that the paper feed cassette has traveled up to the first position by means of a protrusion 161 and transmits a signal to the control unit. When it receives the signal, the control unit releases the electromagnetic clutch C23 and stops the motor M2. Namely, the paper feed cassette 16 stops at the first position, shifts the push up lever 32 by the push up mechanism 321 in the clockwise direction so as to push up the bottom plate 162 in the paper feed cassette 16 by means of the roller 322, and pushes the topmost surface of transfer materials loaded on the bottom plate 162 against the separation pawl 163, so that paper feeding by the paper feed roller 27 which is a semi-circle is enabled.

Figure 9A:
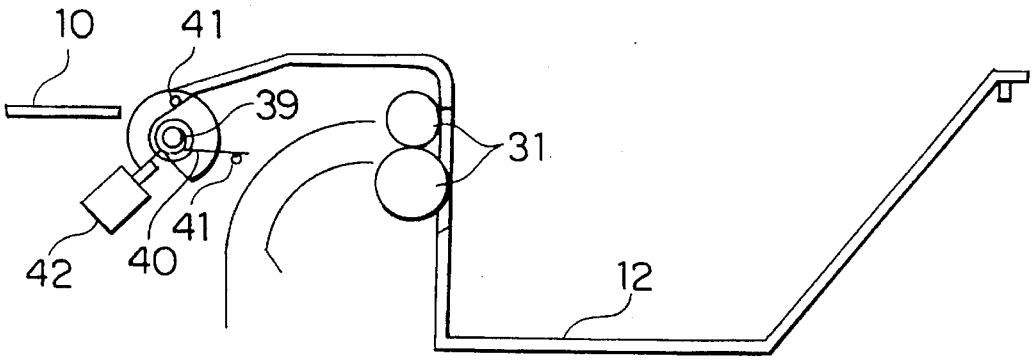
FIGS. 9*a–b* compose a side sectional view indicating the upper cover releasing mechanism and releasing condition.
Figure 9B:
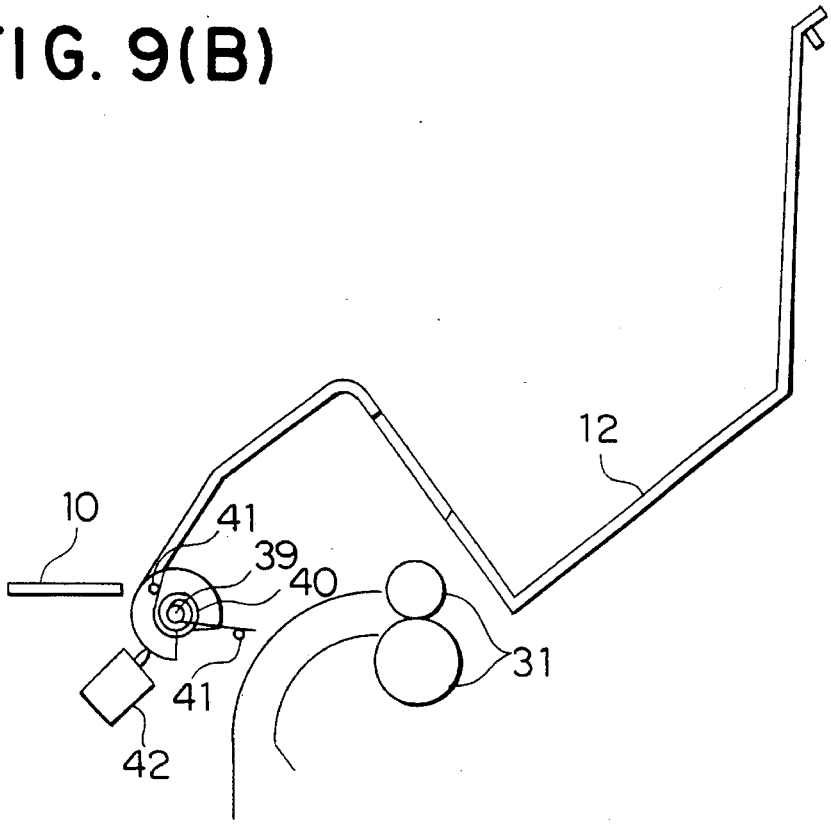

The top cover opening means is explained using FIGS. 9 (A) and 9 (B). The top cover 12 is supported by the top cover shaft 39. The top cover 12 is pushed through the winding spring wound around the circumference of the top cover shaft 39 and a pin attached to the main body 10 at one end and to the top cover at the other end in the clockwise direction in this Figure so as to open.

In the image forming process, the top cover 12 remains closed by the top cover opening means having the configuration mentioned above and serves as the discharge tray for transfer materials discharged by the discharge roller 31. (FIG. 9 (A)) If the takeout button of the control panel provided on the front side of the main body 10 is pressed while no image forming process signal is output, the control unit transmits a moving signal to the process cartridge moving means so as to move the process cartridge 15 and then transmits a release signal to the solenoid 42 serving as a top cover opening means. When the solenoid 42 receives the release signal, it retracts the plunger shaft and releases the lock of the top cover 12. Then the top cover 12 energized by a spring is opened a little by that force. Subsequently, the top cover 12 must be shifted further upward to open fully. (FIG. 9 (B)) A transfer material causing jamming can be found and removed easily through top cover 12 which has been opened like this.

The top cover opening means is not confined to this embodiment but a member for latching on the opposite side of the top cover 39 may be provided.

Additionally, another method to provide the top cover shaft 39 with a gear and a motor engaging the same gear, which when an opening signal is output from the control unit, is rotated to open the top cover 12. In this case, it can be designed so that when a setting signal is input into the control unit, the same motor rotates reversely to close the top cover 12.

Figure 10A:
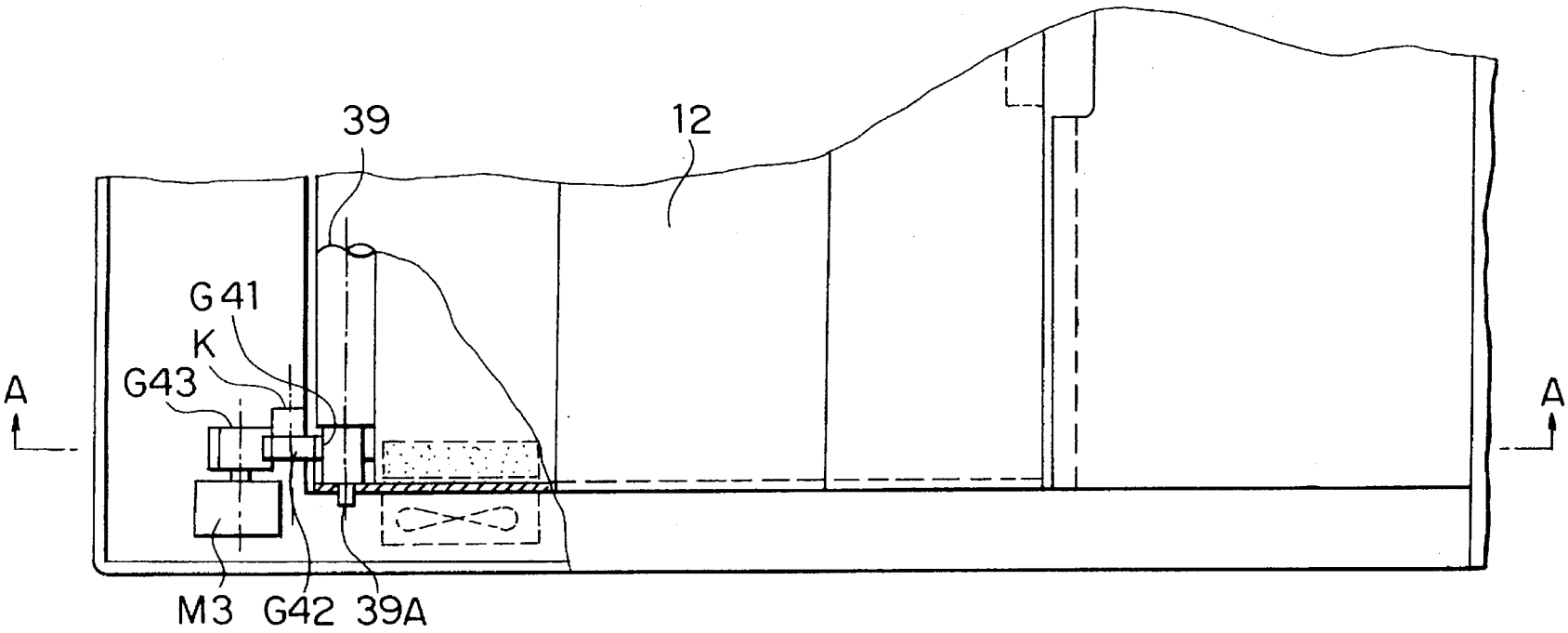
FIGS. 10*a* and 10*b* are the plane and a side sectional view indicating another releasing mechanism of the upper cover.
Figure 10B:
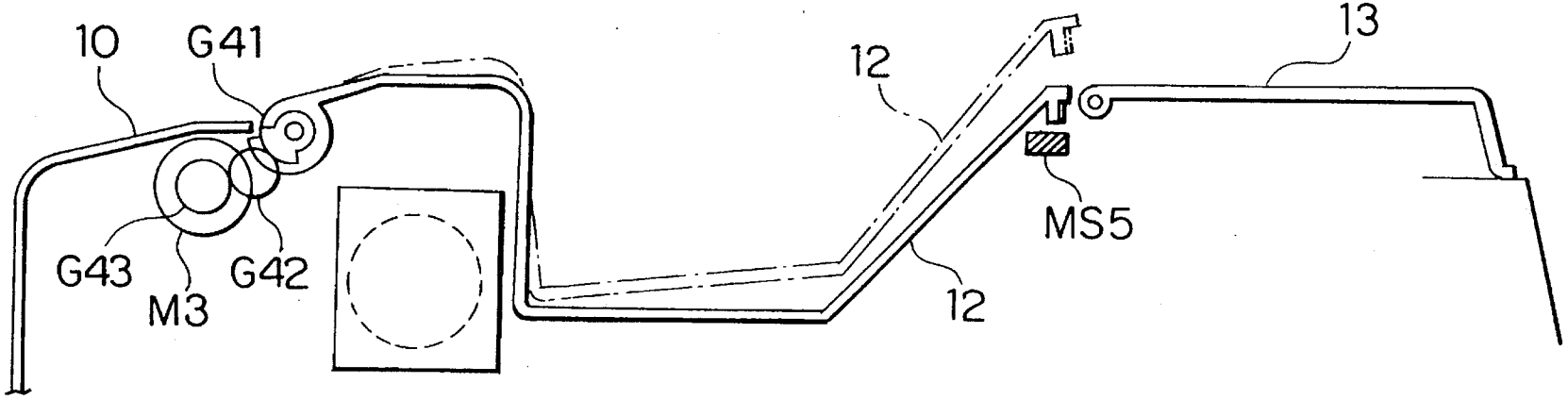

FIG. 10 shows another embodiment of the opening/closing mechanism for the top cover 12 of this invention. FIG. 10 (A) is a partial plane and FIG. 10 (B) is a view of the cross section AA.

The top cover shaft 39 supporting the end of the above mentioned top cover 12 has the gear G41 at one end. 39A is the hinge shaft protruded to both sides of the same top cover shaft 39 and engaged with the bearing on the main body 10 to enable the top cover 12 to be opened or closed freely. The same gear is in mesh with the gear 43 fixed on the drive shaft of the DC motor M3 for opening the top cover through the intermediate gear G42. The above mentioned G41 is a sector gear whose teeth are partially cut out. The intermediate gear G42 incorporates a one-way clutch K.

When the motor M3 is powered, power is transmitted to the gears G43, G42 and G41 so as to rotate the top cover shaft 39 thereby shifting the top cover 12 combined with this in the counterclockwise direction. When the intermediate gear G42 rotates by a specified angle, it comes into contact with the cutout section of the sector gear G41, so that the sector gear G41 stops despite the rotation of the motor M3 and the end of the top cover 12 stops slightly apart from the opening on the top of the main body 10. After that, by holding the front end of the top cover 12, it is opened manually. Because the motor M3 is stopped and the intermediate gear G42 in mesh with the drive gear G43 of the same motor M3 is in contact with the cutout section of the sector gear G41, the top cover 12 can be opened easily.

A lock sensor such as the micro switch MS5 is mounted on the opening of the main body 10 below the end of the cover 12 and detects the closing of the cover by sensing the protrusion on the bottom of the top cover 12.

The motor M3 is a drive source specifically for opening and closing the top cover, controlled by means of a circuit switching means at the time of non-image forming, and it is allowed for the top cover 12 to be opened and closed by transmitting a power through clutch selection from the motor M1 or M2 at the time of non-image forming.

Although the motor M3 may be driven with the process cartridge 15, front cover 14 or paper feed cassette 16 at the time of non-image forming, it is allowed to shift the timing to reduce the temporary electric load. Because particularly the electric load for moving the process cartridge 15 and paper feed cassette 16 is large, it is effective to shift the timing between both.

Summarizing what has been explained above, FIG. 10 shows the travel control of the process cartridge 15 and cassette 16, and opening control of the top cover 12. That is to say, the jamming determination unit judges jamming according to a signal on the presence/absence of a transfer material from the jamming detection sensors S1–S4, and if it determines jamming, it transmits a jamming signal to the control unit. Then, the control unit stops the drive units related to image forming including the photoreceptor belt drive unit, developing device drive unit, and fixing means drive unit, and transmits an opening signal to the process cartridge moving means, cassette moving means and the top cover opening means. The process cartridge moving means controls the process cartridge moving/drive system to move the process cartridge 15 from the first position to the second position and stops the process cartridge moving/drive system when obtaining a position detection signal sensing that the process cartridge 15 has traveled up to the second position.

Figure 11:
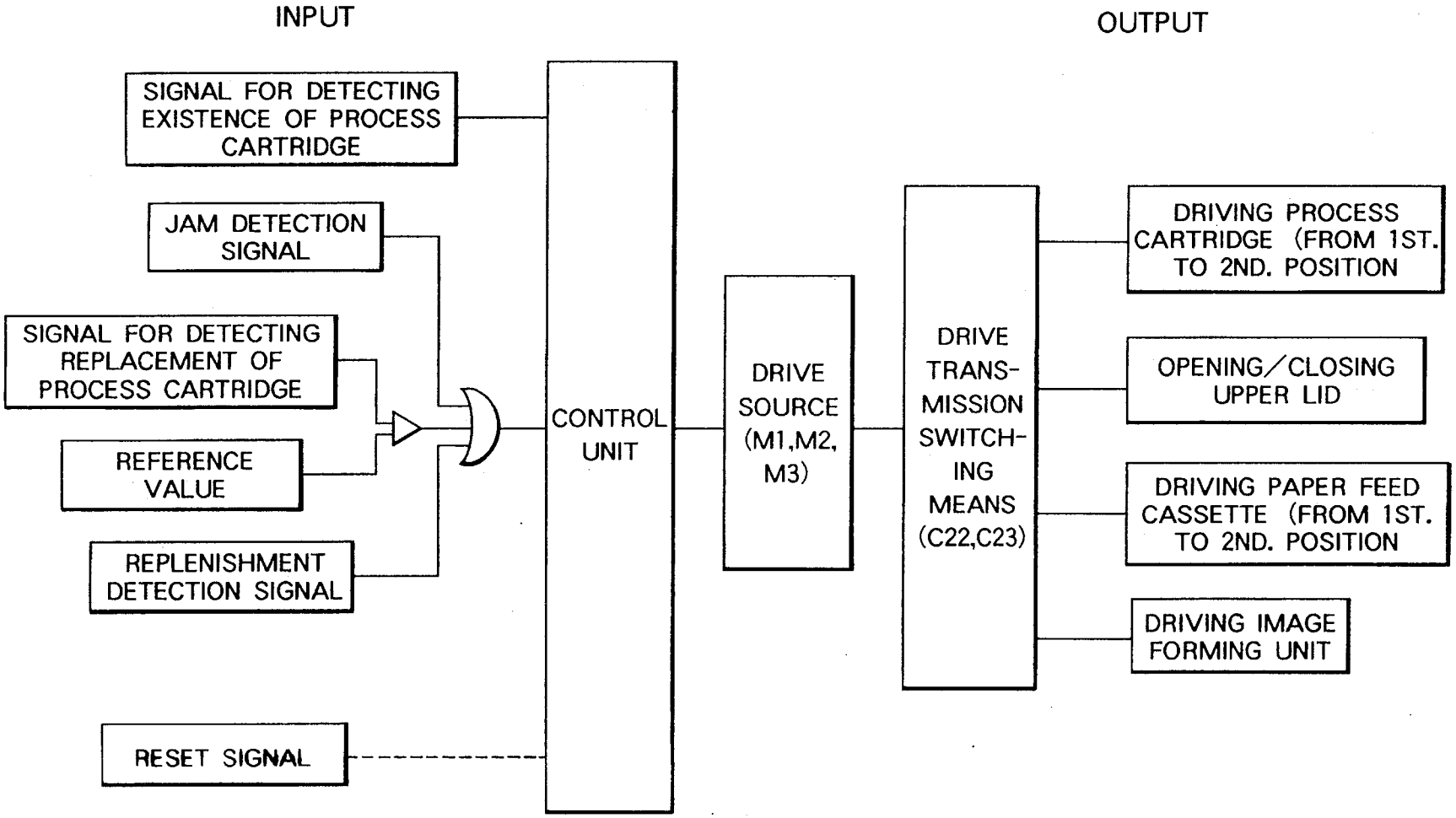
FIG. 11 is a block diagram indicating the control system.
Figure 12:
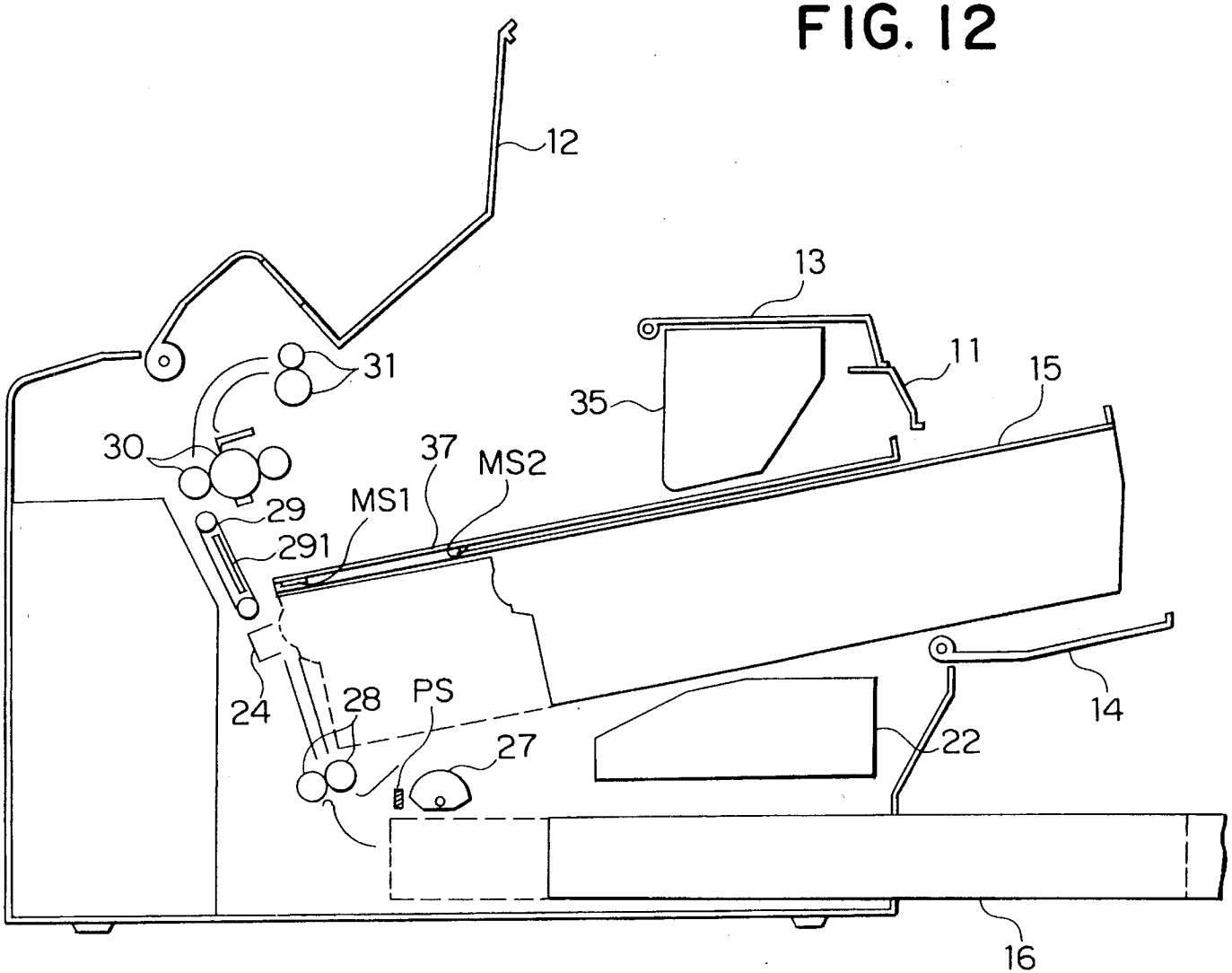
FIG. 12 is a side sectional view of the image forming apparatus with its upper cover and side cover open.

Additionally, the cassette moving means also moves the paper feed cassette 16 from the first position to the second position. On the other hand, the top cover opening means opens the top cover 12. When a jamming occurs, the process cartridge 15 and paper feed cassette 16 retracts to the second position and the paper feed cassette 16 retracts to the second position as shown in FIG. 11 without an operator's control and then the top cover 12 opens. Therefore, it is possible to confirm the transfer material P causing jamming from the top of the main body 10 and remove it easily. Additionally, after jamming treatment, the process cartridge 15 and paper feed cassette 16 are automatically inserted with only a simple operation, thus the operator's effort is not only reduced largely but also the process cartridge 15 and paper feed cassette 16 are set at an optimum position.

The control unit can move the paper feed cassette 16 alone when the paper shortage sensor S0 detects shortage of the transfer material P in the cassette, other than when a jam occurs. Upon the replacement of the process cartridge 15 or supply of the transfer material P, a draw-out signal is entered into the control unit when the draw-out button on the control panel is pressed. At this time, unless a print signal photoreceptor belt drive signal, fixing/discharge drive signal, and paper feed drive signal indicating that they are working are output from the print button of the control unit, the photoreceptor belt drive unit, fixing/discharge unit and paper feed unit respectively, it is possible to move the process cartridge 15 and/or cassette 16 from the first position to the second position.

In this embodiment, as an image forming process, the image forming method to transfer a color toner picture formed on the photoreceptor belt has been stated. However, it is allowed to transfer toner image put one upon another on a transfer material on the transfer drum. This method is applicable to ordinary monochrome printers using monochrome process. Although the case for the non-contact developing method has been described, this invention is not limited to the non-contact developing method but is also applicable to the contact developing method. In addition, the drive system represented for this embodiment is only an example and this invention is not confined to this combination of the gear, clutch and belt.

Figure 13:
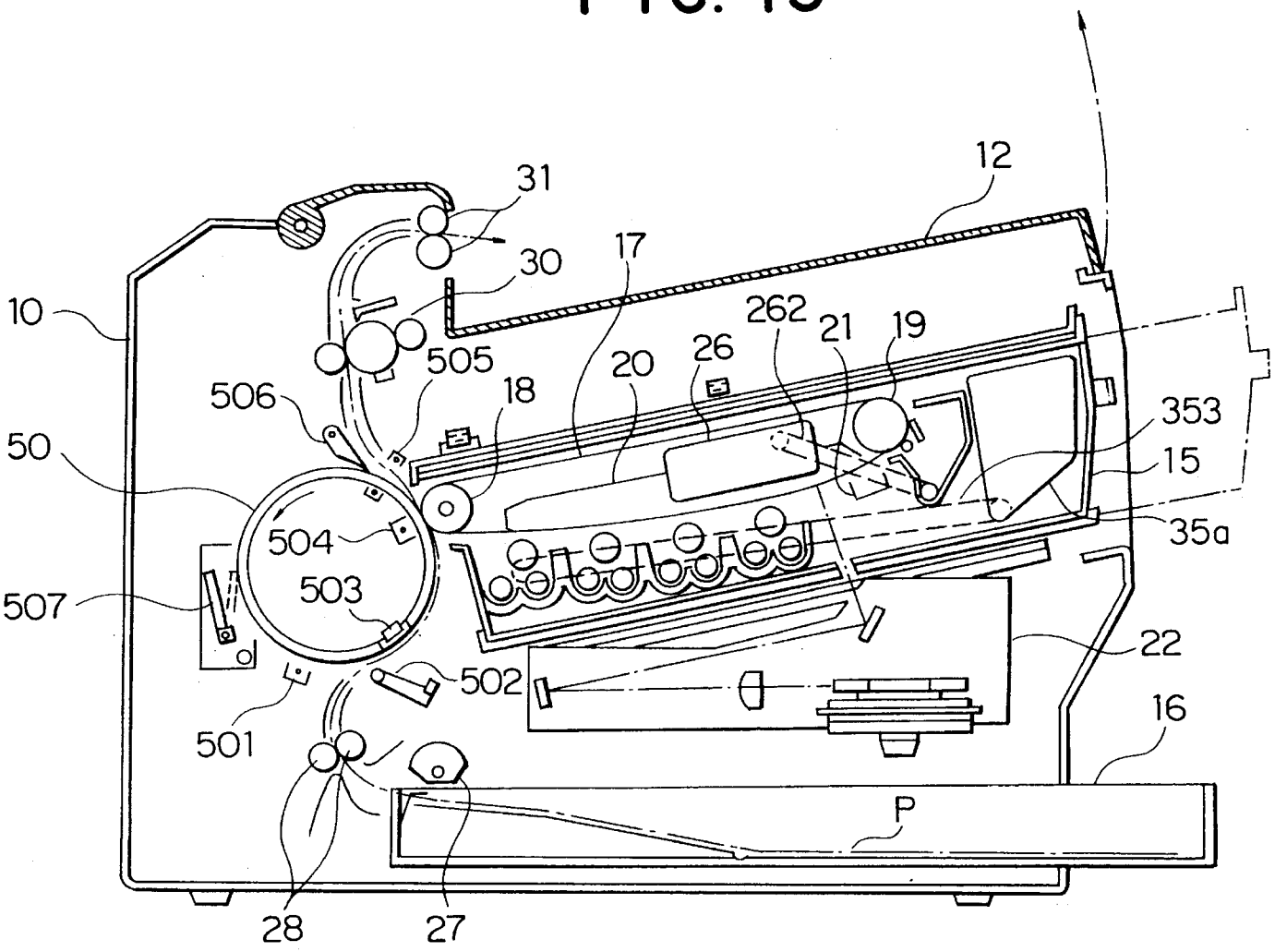
FIG. 13 is a side sectional view of the transfer drum type image forming apparatus of the present invention.

FIG. 13 shows a transfer drum type image forming apparatus as another embodiment of this invention. Although the process cartridge 15 is almost the same as the above mentioned embodiment, the toner hopper 35*a* is contained in the process cartridge 15. In the transfer drum type image forming apparatus, the transfer drum 50 is in contact with the transfer section of the photoreceptor belt 17 and the transfer drum 50 rotates counterclockwise in synchronization with the photoreceptor belt 17. Each toner picture formed on the photoreceptor belt 17 is transferred onto a transfer material wound on the circumference of the transfer drum 50, individual toner pictures are put one upon another on the transfer material and then the completed transfer material is separated from the transfer drum 50 and after fixing, discharged onto the main body 10.

The charger 501 to attract a transfer material electrostatically and the winding member to mechanically wind a transfer material around the transfer drum are provided on the edge of the transfer drum, and the winding member 502 is provided with a roller on its end, which makes contact only when a transfer material is wound on the transfer drum 50. The gripper 503 is provided on the surface of the transfer drum 50, which holds the end of a transfer material carried in synchronization. The transfer unit 504 transfers a toner picture on the photoreceptor belt onto a transfer material electrostatically. The separation/neutralizing electrode 505 and separation pawl 506 separate a transfer material from the transfer drum after transfer. The detachable cleaner 507 wipes off toner adhering to the transfer drum 50 after a transfer material is separated.

The transfer material P after being supplied from the paper feed cassette 16 advances in synchronization to the transfer drum 50 charged with static electricity by the charger 501, is wound by the winding member 502, rotated with the transfer unit with the end of a transfer material held by the gripper 503 and then a yellow toner picture formed on the photoreceptor belt 17 is transferred onto a transfer material by the transfer unit 504. After the first transfer is completed, the transfer drum 50 continues to rotate while being cleaned by the cleaner 507, and transfers another toner picture. Namely, a magenta toner picture is transferred at the second rotation, followed by a cyan toner picture at the third and then a black toner at the fourth, so that they are put one upon another. When four color toner pictures have been transferred, the transfer material is deprived of static electricity by the the separation/neutralizing eliminator 505, separated by releasing the holding of the end by means of the separation pawl 506, is carried to the fixing roller 30.

In the image forming apparatus of this embodiment, the transfer drum 50 is provided on the main body side 10 and not incorporated in the movable process cartridge 15. Therefore, the moving of the process cartridge 15 is carried out in the same manner as the above mentioned embodiment.

It is allowed to mount an image reading unit (scanner) on top of the image forming apparatus 10 so that it covers the opening on the top of the image forming apparatus instead of the top cover 12 and the image reading unit can be shifted freely around the shaft of the main body 10.

It is also allowed to structure a process cartridge applying a photoreceptor drum as an image carrying member so that it can be moved.

These various process cartridges are not restricted to the inclined position as shown in the figure and can be structured horizontally.

The image forming apparatus of this invention is not confined to a color printer equipped with a multi-color process cartridge, but applicable to monochrome printers, of course.

The top cover opening means is explained using FIG. 15.

The top cover 12 is supported rotatably by the top cover shaft 39. The top cover shaft 39 is provided with the gear G51 for opening and closing the top cover, which rotates together with the top cover 12 and the motor M3 mounted on the main body 10 is equipped with the gear G52 which meshes with the same gear 51. In addition, the micro switches MS5 and MS6 which are position detection sensors for detecting whether the top cover 12 is closed or released are provided.

During the image forming process, the top cover opening means having the above configuration keeps the top cover 12 closed, and the top cover 13 serves also as a discharge tray for transfer materials discharged from the discharge roller 31. (FIG. 15 (*a*)) When a top cover release signal is entered from the control unit, mentioned later, to the top cover release means, that is, a signal is entered into the motor M3, the motor rotates in the clockwise direction in the same figure and rotates the gear G51 in the counterclockwise direction through the gear G52. Therefore, the motor rotates around the top cover shaft 39 in the counterclockwise direction so as to release the top cover 12. Then, the micro switch MS6 detects that the top cover 12 is released and outputs a release signal to the control unit. When the control unit receives the release signal it stops the motor M3. That is, the top cover 12 is released as shown in FIG. 15 (*b*). Through an opening of the top cover 12 released like this, a transfer material causing a jam can be found and removed easily.

On the contrary, when closing the top cover 12, the released top cover 12 must be shifted so as to be closed, or if a closing signal is entered from the control unit mentioned later, the motor M3 rotates (in the counterclockwise direction in the same figure) to turn the top cover in the clockwise direction. Then, when the micro switch MS5 detects that the top cover 12 is closed, the control unit stops the motor M3. Namely, the top cover 12 is closed. (FIG. 15 (*a*)) The top cover release means is not limited to this embodiment, but it is allowed to release the top cover 12 by unlocking the latch member which latches the top cover 12 while energized by a spring toward the release direction by a release signal from the control unit. Although the image forming apparatus explained in this embodiment is equipped with the top cover 12, it is not limited to this type, but the so-called clamshell type image forming apparatus makes it possible to provide the top case with a release means instead of the top cover release means of this embodiment.

Then, the fixing roller pressing release means is explained according to FIG. 15.

In this embodiment, the opening/closing of the top cover 12 mentioned previously is used for pressing/releasing the fixing roller 30. Namely, a protrusion 43 which rotates together with the top cover 12 near the top cover shaft 39 is provided. On the other hand, the fixing roller 30 comprises the pressing roller 301 and heating roller 302, and a separation member and cleaning member not illustrated in the figure are mounted on the circumference of the heating roller 302 and rotated by the drive system (not illustrated) in the clockwise direction. The pressing roller 301 can rotate in the counterclockwise direction driven by the heating roller and the pressing roller shaft 303 is supported through a shaft by the pressing/release member 304. The pressing/release member 304 is supported rotatably on the main body 10 through the pressing/release shaft 305 and energized in the clockwise direction by the spring 306. For this reason, as for the fixing roller 30, the pressing roller 301 presses the heating roller 302 and the heating roller 302 rotates while heated by a heating means not illustrated in the figure, fuses a toner picture on a transfer material and carries the transfer material to the paper discharge roller 31.

When the top cover 12 is released, the pressing release mechanism of the fixing roller 30 having the above mentioned configuration turns the protrusion 43 counterclockwise, so that the pressing/release member 304 rotates in the counterclockwise direction through the pressing/release shaft 305 as a fulcrum and then the pressing roller 301 supported by the pressing/release member 304 releases pressure to the heating roller 302. When the fixing roller 30 is released from pressing like this, there occurs a clearance between the pressing roller 301 and heating roller 302 so that a jammed paper can be removed easily from the fixing unit.

On the contrary, when pressing the fixing roller 30, closing the top cover 12 turns the protrusion 43 in clockwise direction so that the pressing roller 301 presses the heating roller 302 because the pressing/release member 304 is energized by a spring in clockwise direction through the pressing/release shaft 305 as a fulcrum. Therefore, the pressing and release of the fixing roller can be done by means of a simple mechanism.

Although the fixing roller 30 is released by activating the pressing roller 301 in this embodiment, it is also allowed to release the pressing of the fixing roller 30 by activating the heating roller 302. Further, although the pressing release mechanism of this embodiment is equipped with a cam on the top cover 12, it is allowed to release the fixing roller 30 from pressing by a signal from the control unit using a motor, gear or solenoid.

Figure 16:
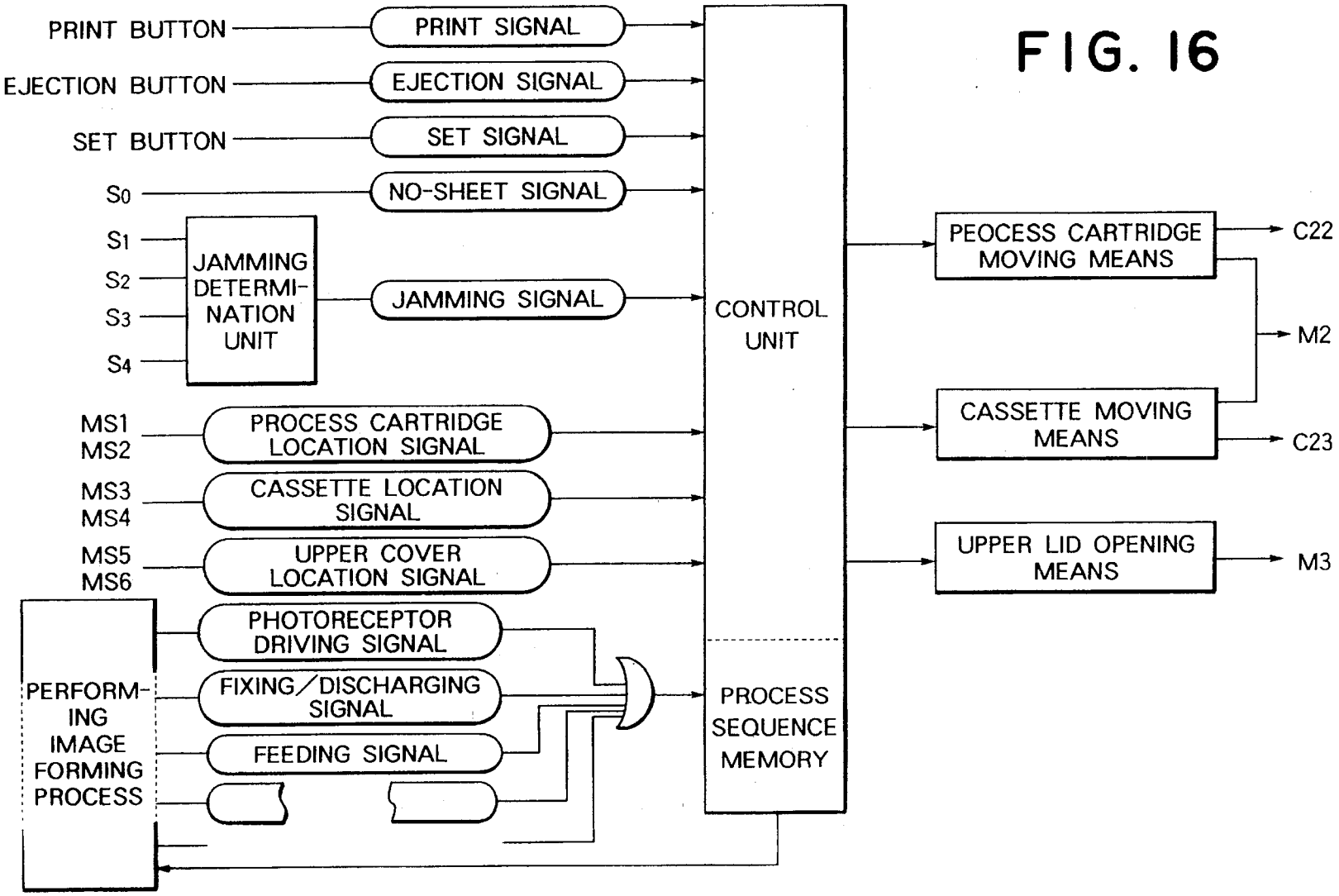
FIG. 16 is a diagram representing the control system to move the process cartridge and cassette.

FIG. 16 shows the process cartridge moving means, cassette moving means and top cover release means explained above. When replacing the process cartridge 15 or cassette 16 or jamming occurs, the process cartridge 15, cassette 16 and top cover 12 can be moved by pressing the draw-out button provided on the control panel 11 for an operator to move the process cartridge 15 and cassette 16, and release the top cover 12. Namely, when the draw-out button of the control panel 11 is pressed, a draw-out signal is entered into the control unit. At this time, if an image forming process signal such as a photoreceptor belt drive signal, fixing/paper discharge drive signal and paper feed drive signal indicating that the image forming process including the photoreceptor belt drive unit, fixing/paper discharge unit, and paper feed unit are operating is not output, even if no jamming signal is entered into the control unit, a process cartridge moving signal, cassette moving signal and top cover release signal are transmitted to the process cartridge moving means, cassette moving means and top cover release means, so that the process cartridge 15 and cassette 16 can be moved from the first position to the second position as mentioned previously and that the top cover 12 can be released.

Figure 17:
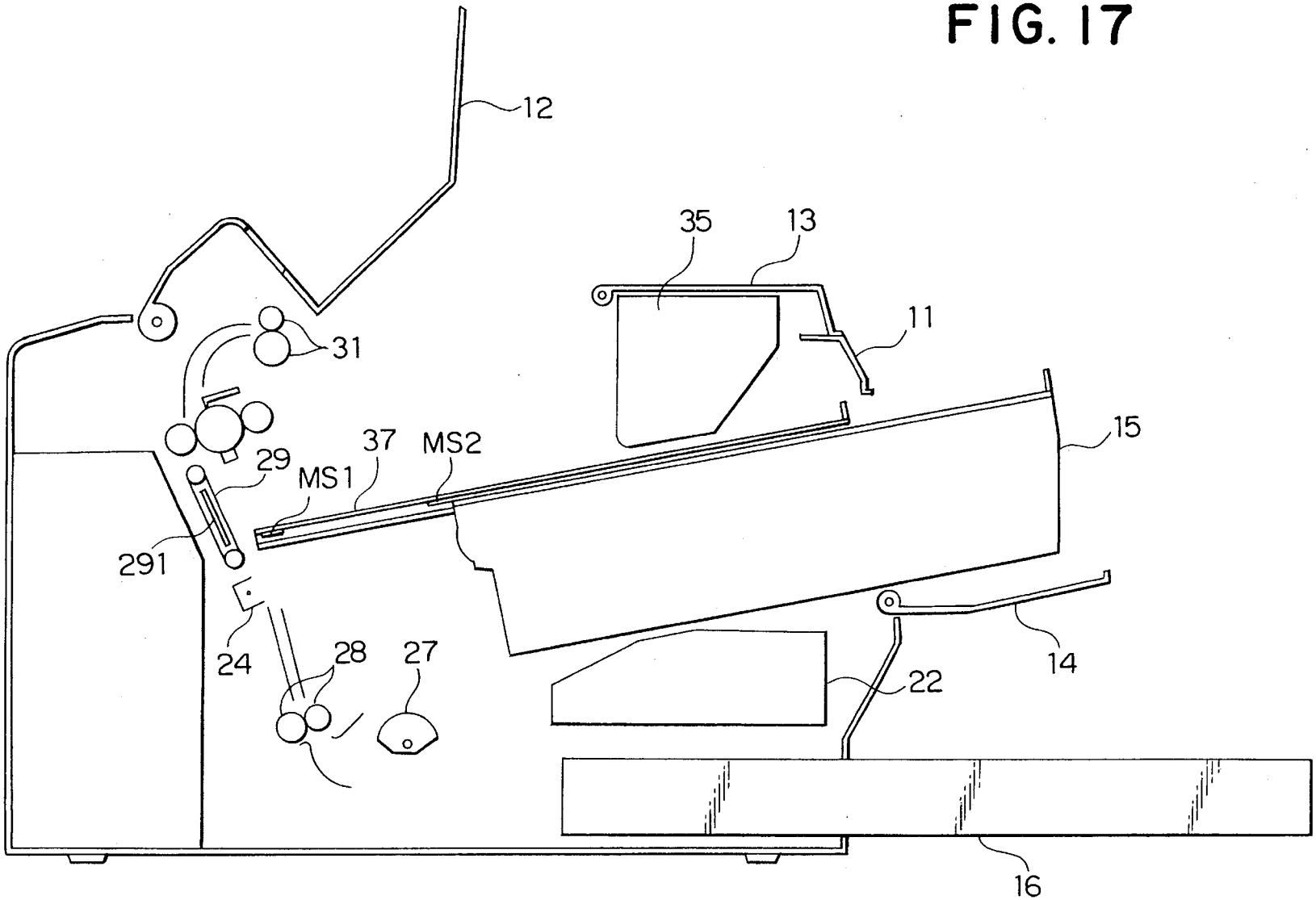
FIG. 17 is a major sectional view indicating the left side of the color printer when the cartridge and cassette are located at the second position with the upper cover open.

Namely, the process cartridge 15 and cassette 16 are automatically moved to the second position as shown in FIG. 17, by only pressing the draw-out button of the control panel 11 and simultaneously the top cover 12 is released, so that an operator is able to remove the process cartridge 15 or cassette 16 from the main body 10 by only pulling out them slightly and replace them. Additionally, in case of clearing treatment, an operator can not only recognize a jammed paper by only a glance through the opening of the top cover 12 but also secure a wide working space for clearing jammed paper.

On the contrary, upon moving the process cartridge 15 and cassette 16 from the second position to the first position to close the top corner also, when the setting button provided on the control panel 11 is pressed and the process cartridge 15 or cassette 16 is located on the second position or the top cover 12 is released, the control unit transmits a moving signal for moving the process cartridge 15 or cassette 16 from the second position to the first position to the process cartridge moving means or cassette moving means, and a closing signal to released top cover 12 so as to move the process cartridge 15 or cassette 16 up to the first position, and then close the top cover 12. Namely, after the setting button of the control panel 11 is pressed, the process cartridge 15 and cassette 16 are located at the first position and the top cover 12 is closed so that the image forming apparatus is set so as to be able to form images. Even if any action of inserting the process cartridge 15 located at the second position slightly toward the first position, inserting the cassette 16 located at the second position slightly or rotating the top cover 12 in release condition so as to close, is taken, the control unit controls the process cartridge moving means, cassette moving means and top cover release means. At this time, only when the process cartridge 15 or cassette 16 is located at the second position, it is moved to the first position (if it is located at the first position, it is kept there.) and only when the top cover 12 is released, the top cover 12 is closed (If it is closed, it is kept as it is.) For this reason, the condition to enable image forming, namely, setting of the process cartridge 15 and cassette 16 at the first position and closing of the top cover 12 is automatically conducted by a simple operation. Therefore an operator's work is not only reduced largely, but also the process cartridge 15 and cassette 16 can be set at an optimum position.

During travel of the process cartridge 15 or cassette 16 and opening/closing of the top cover 12, the process cartridge moving signal, cassette moving signal and top cover moving signal indicating that they are each working are entered into the control unit from the process cartridge moving means, cassette moving means and top cover release means. When each of these signals is entered, the control unit invalidates the print signal, process cartridge moving signal, cassette moving signal, top cover release signal and closing signal. Namely, during travel of the process cartridge 15 or cassette 16 and opening/closing of top cover 12, other action is inhibited until travel or opening/closing is completed. This prevents the process cartridge 15, cassette 16 and top cover 12 from taking random action when an operator presses another button by mistake.

Meanwhile, the draw-out button and setting button provided on the control panel 11 may activate the process cartridge 15, cassette 16 and top cover 12 all at once. In this embodiment, it is allowed to provide the draw-out button and setting button for moving the process cartridge and cassette, and opening/closing the top cover each so as to activate them independently.

The protrusion member, guide member, rack and pinion for moving the process cartridge shown in this embodiment are not limited to this, but it is allowed to, for example, mount the process cartridge on the tray and move the tray between the first and second positions.

Figure 18A:
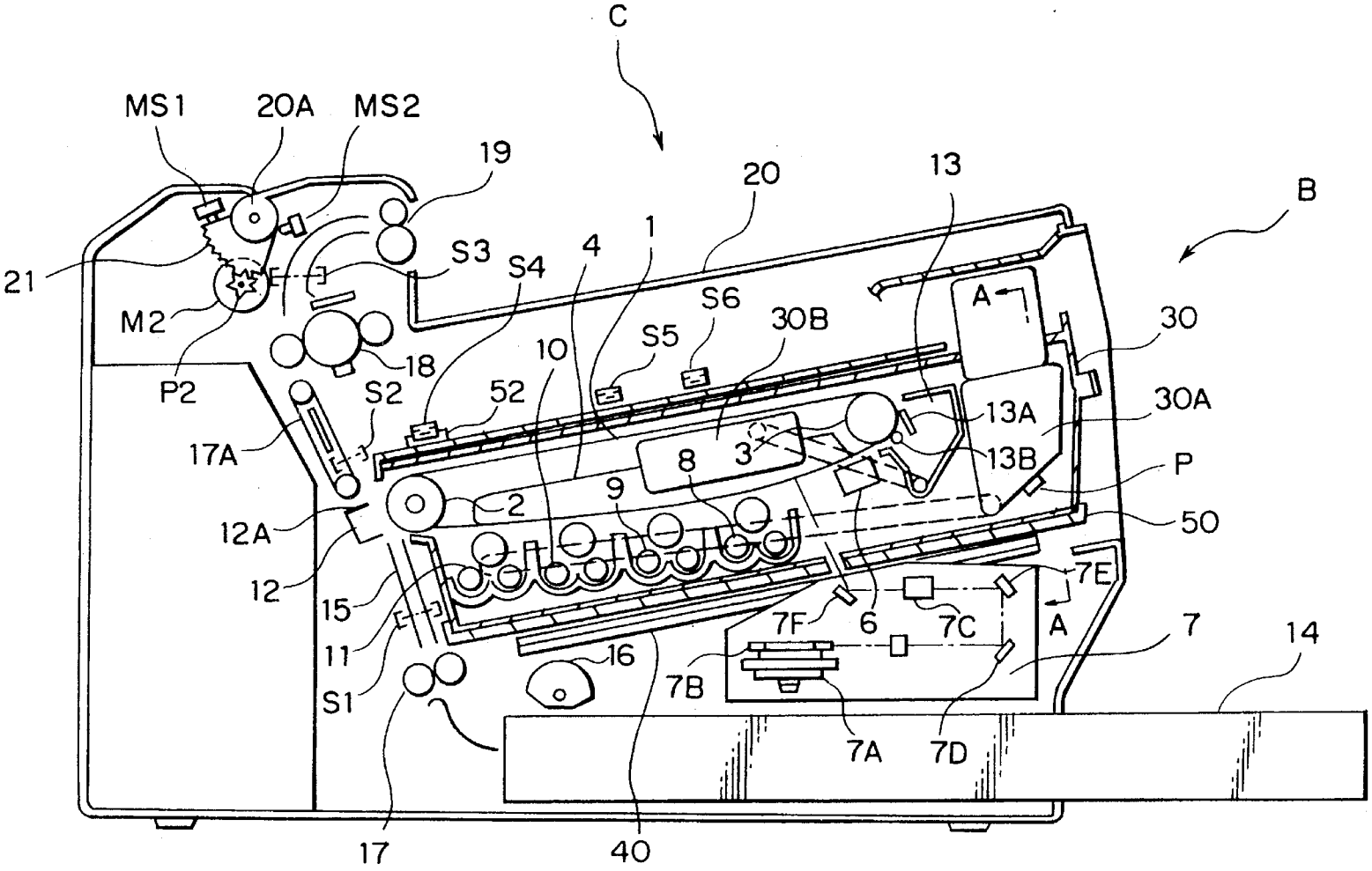
FIGS. 18*a–c:* Depict sectional configuration of an embodiment of the present invention and the sectional view of the major parts.
Figure 18B:
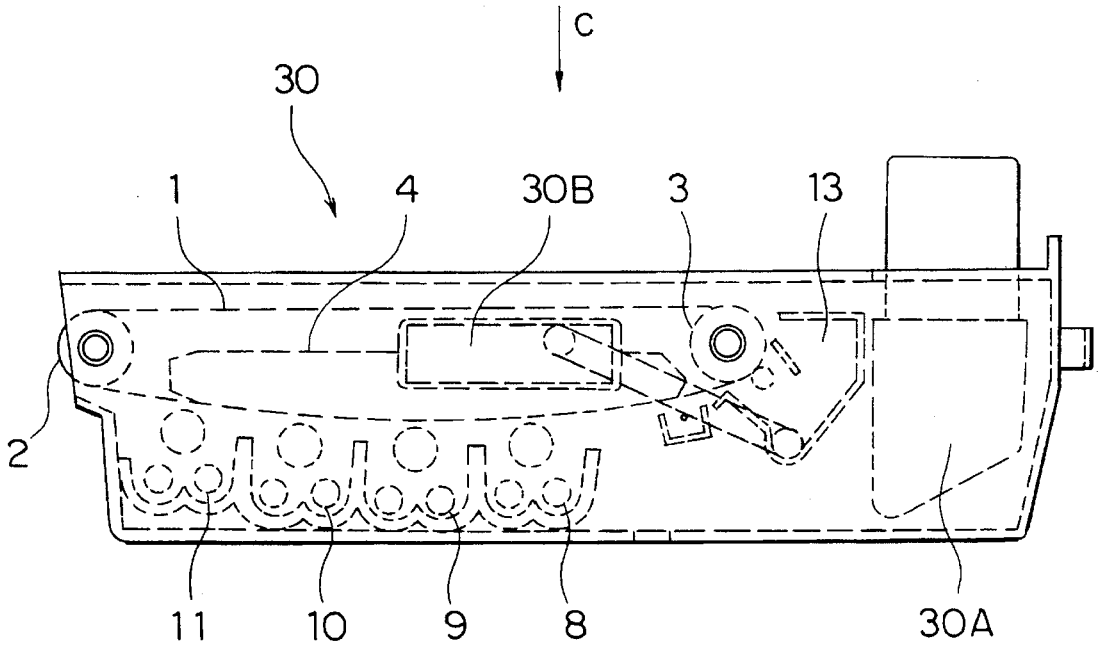
Figure 18C:
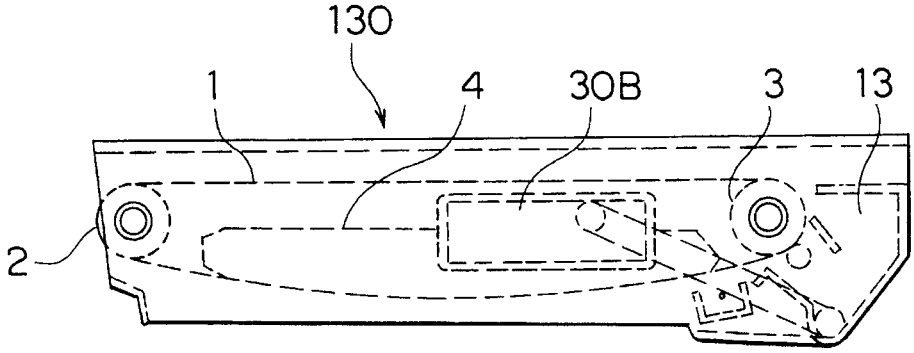
Figure 33:
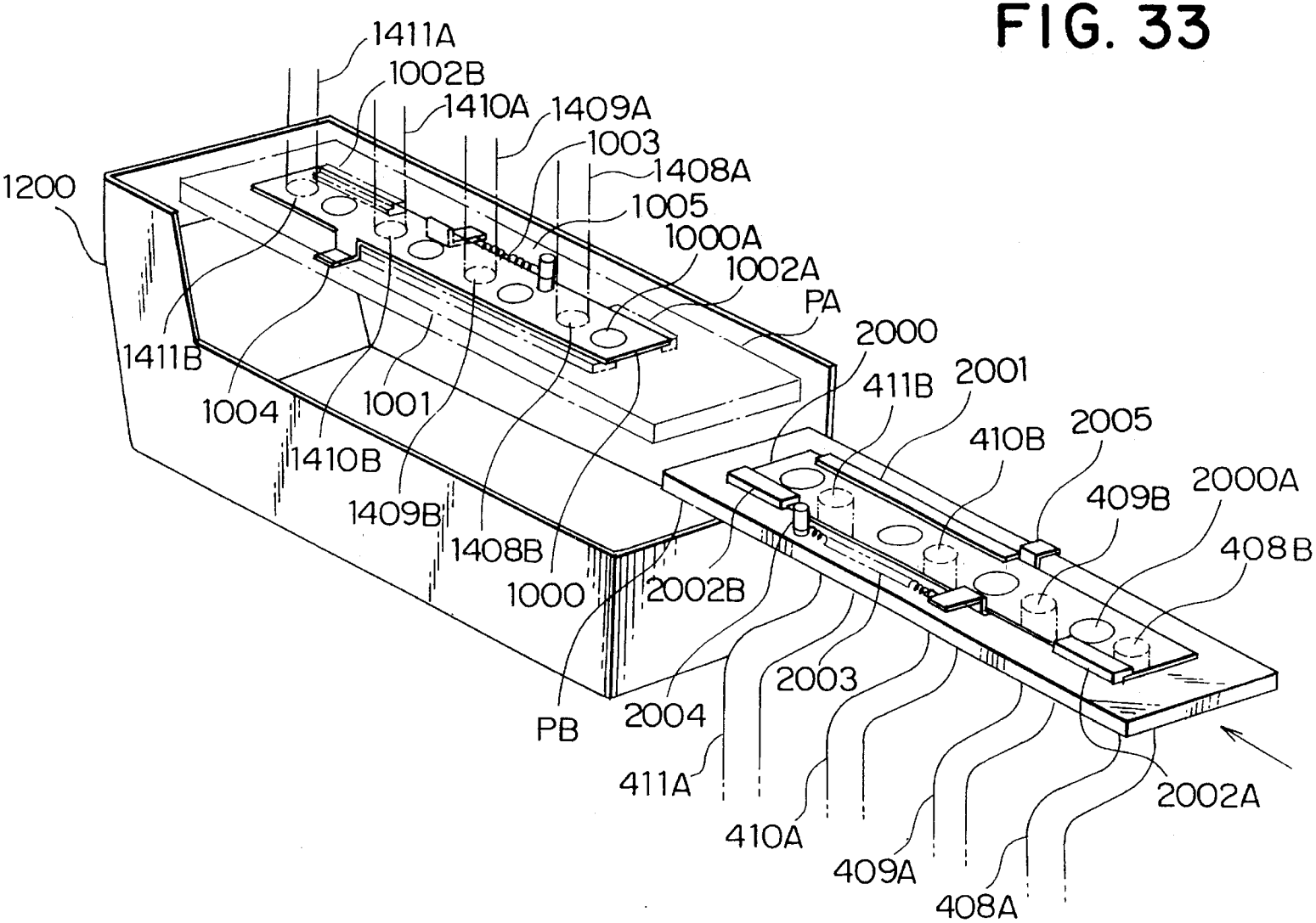
FIG. 33 is a diagonal view of the developer supply mechanism.

FIGS. 18 and 33 show still another embodiment of the image forming apparatus of this invention.

Referring to FIG. 18(*a*), numeral 1 is a flexible photoreceptor belt which is a belt like image carrying member and the photoreceptor belt 1 is provided between the rotation rollers 2 and 3 and driven in clockwise direction by the rotation roller 2.

Numeral 4 is a guide member in contact with the inside of the photoreceptor 1, the photoreceptor belt 1 is stretched by the outward energization of the rotation roller 3 so as to rub the internal surface against the guide member 4.

Thus, the photoreceptor belt 1 is always maintained at a constant position to constitute a stable image forming surface.

Numeral 6 is scorotron charger which is a charging means, 7 is a laser writing unit which is an image exposure means, and 8 and 11 are multiple developing means, each containing a specific color developer, and these image forming means are provided against the outside surface of the photoreceptor belt 1.

As the laser write unit 7, an optical system having a light emitter integrated with a convergent light transmitter can also be used in addition to the optical system illustrated in the figure.

The developing devices 8, 9, 10 and 11 containing developers of yellow, magenta, cyan, and black, are provided with developing sleeves to maintain a specified clearance against the photoreceptor belt 1 and have the function to make a latent image on the photoreceptor belt 1 a visible image by non-contact developing method. Different from the contact developing method, this non-contact developing has an advantage of not preventing the travel of a photoreceptor belt.

Numeral 12 is a transfer unit, 12A is a static eliminating bar, and 13 is a cleaning section or cleaning unit. The blade 13A of the same cleaning unit 13 and toner feed roller 13B are maintained apart from the surface of the photoreceptor belt 1 during image forming, and pressed against the surface of the photoreceptor belt 1 as shown in the figure only upon cleaning after image transfer.

Color image forming by means of the color image forming apparatus is carried out as follow:

Forming of multiple color images by this embodiment is executed by the following image forming system, Namely, the image data processing unit processes data obtained by the color image data input unit by image pick-up element's scanning an original image through arithmetic operation to produce image data and then store it in the image memory temporarily. Then the stored image data is taken out when recording and input into the color image forming apparatus illustrated as an embodiment in FIG. 18 (*a*).

Namely, when a color signal is output from the image reading unit 7 separated from the printer, in the laser write system unit 7, laser beam generated by a semiconductor laser beam (not shown) is transmitted for scanning while rotated by a polygon mirror 7B rotated by the drive motor 7A, passes through the fθ lens 7C, is bent by the mirrors 7D, 7E and 7F, and projected onto the surface of the photoreceptor belt 1 already charged by the charger 6 which is a charging means.

On the other hand, when scanning starts, a beam is detected by the index sensor so that beam modulation by the first color signal starts so that a modulated beam scans the surface of the photoreceptor belt 1. Thus a latent image corresponding to the first color is formed gradually on the surface of the photoreceptor belt 1 by the main scanning by the laser beam and auxiliary scanning by the travel of the photoreceptor belt 1. This latent image is developed by the developing device loaded with yellow toner in the developing means and a corresponding toner picture is formed on the belt surface. An obtained toner picture is maintained on the belt surface, passed under the cleaning unit 13 which is a cleaning means separated from the surface of the photoreceptor belt 1 and then entered into the next copy cycle.

Namely, the photoreceptor belt 1 is recharged by the charger 6 and then the second color signal output from the signal processing unit is input to the write system unit, so that image writing on the belt surface is done like the first color signal, thereby forming a latent image. As the second color, this latent image is developed by the developing device loaded with magenta toner.

This magenta toner is formed on the above mentioned yellow toner picture already formed.

Numeral 10 is a developing device containing cyan toner and forms a cyan toner image on the belt surface according to a control signal generated by the signal processing unit.

Further, 11 is a developing device containing black toner and forms a black toner picture on the belt surface by overlapping other pictures through the same processing. Each sleeve of these developing devices 8, 9, 10 and 11 is applied with DC or AC bias so that jumping development is conducted by 2-component developer, and a picture is developed on the photoreceptor whose base is grounded. Meanwhile, non-contact developing method using a one-component developer is applicable.

A color toner picture formed on the surface of the photoreceptor belt 1 is transferred to a transfer material carried from the paper feed cassette 14 through the paper feed guide 15.

Namely, from transfer materials stored in the paper feed cassette 14, the topmost piece is fed by the rotation of the paper feed roller 16 and supplied to the transfer unit 12 through the timing roller 17 at the same timing as image forming on the photoreceptor belt 1.

A transfer material after image transfer and neutralizing is separated securely by means of the photoreceptor belt 1, which changes its direction along the rotation roller 2 suddenly, carried upward through the suction type transfer belt 17A, and after the image is fixed by the fixing roller 18, it is discharged onto a tray formed on the upper lid 20 through the paper discharge roller 19.

On the other hand, after image transfer is completed, the photoreceptor belt 1 goes to the cleaning unit in which the blade 13A and toner carrying roller 13B are pressed against the photoreceptor, and the residual toner on the photoreceptor 1 is removed and as soon as it is completed, the blade 13A is separated again. A little after, the toner carrying roller 13B removes toner deposited on the end of the blade 13A, then leaves, and a new image forming process starts.

The photoreceptor belt 1 is incorporated in an independent color process cartridge 30 as shown in FIG. 18 (*b*) as image forming process member together with the charger 6 provided under that belt so as to face it, individual developing devices and cleaning unit 13 installed at the side end, and detachable from the main body. The color process cartridge is not limited to the type containing all the elements, but may be a type containing at least a photoreceptor belt 1, cleaning unit 13, and waste toner cartridge 30B. FIG. 18(*c*) shows an example of this type and the process cartridge 130 shown in FIG. 18(*c*) can be attached to or detached from the main body by means of a rack and pinion.

The color process cartridge 30 incorporates a developer supply unit 30A (comprising toner supply hoppers for yellow, magenta, cyan and black as mentioned later) on the side of the cleaning unit 13, and the waste toner cartridge 30B together with the guide member 4. The developer supply unit 30A supplies toner to each developing device and the waste toner cartridge 30B collects waste toner removed by cleaning.

The color process cartridge 30 is attached to or detached from the main body as mentioned below.

Figure 22:
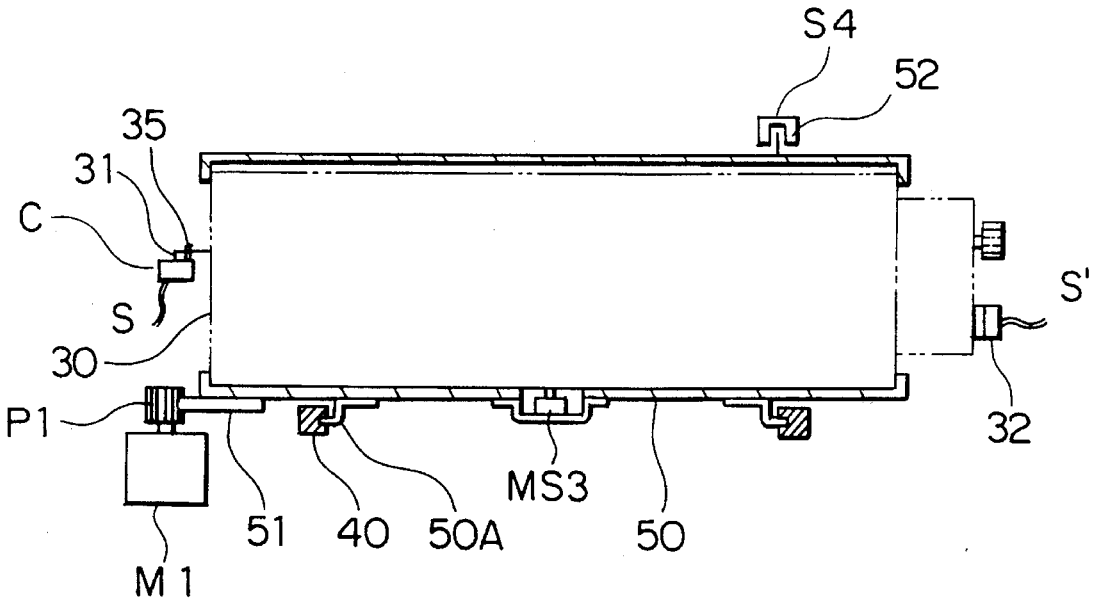
FIG. 22 is a sectional view of the process cartridge.

Namely, as shown in FIG. 22 indicating the cross section A—A, a carriage 50 is provided inside the main body so as to support the color process cartridge 30 by engaging the leg 50A with a pair of fixed guide rail 40, so that it can slide.

Figure 19:
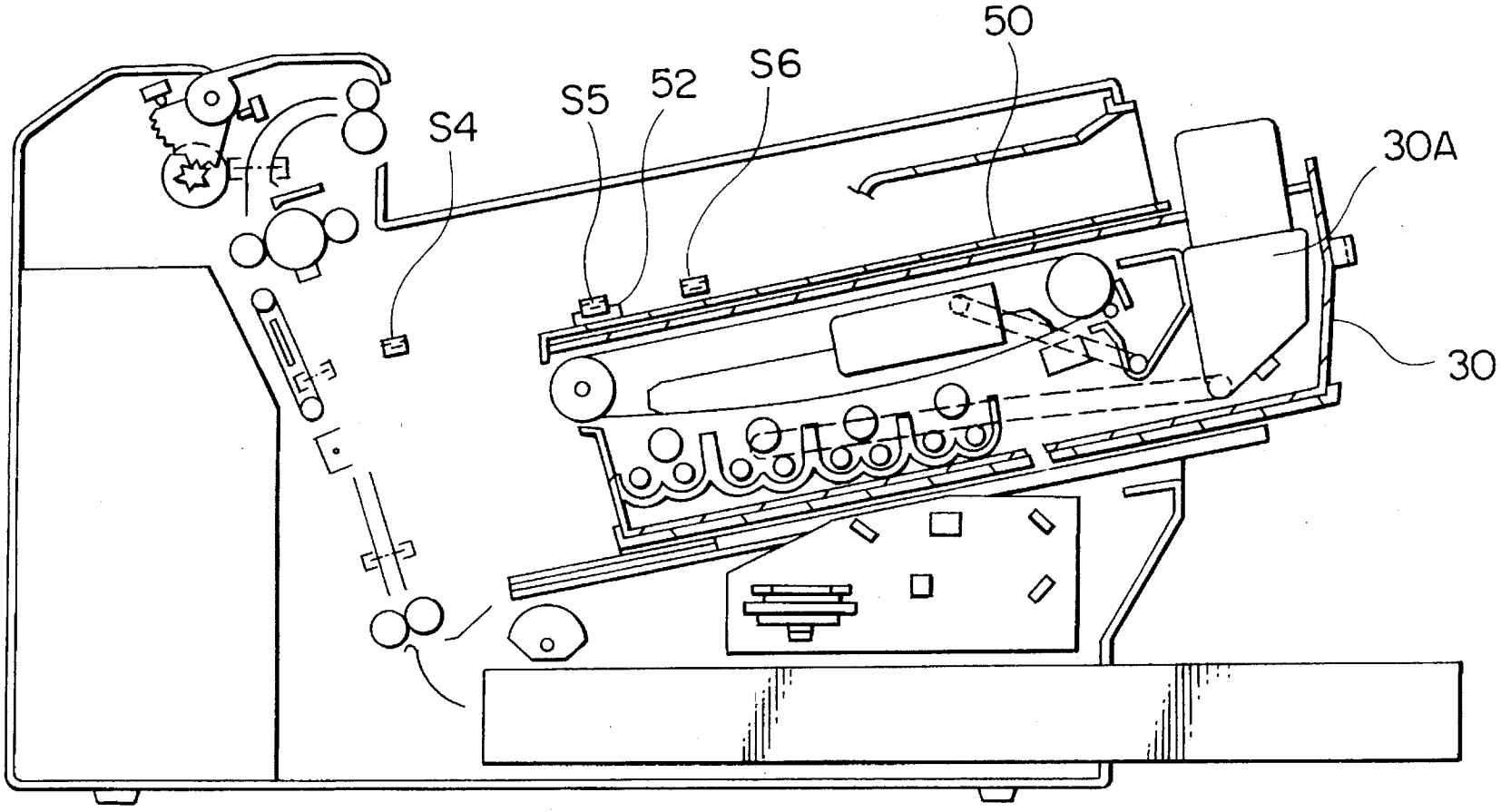
FIG. 19 is an explanatory view representing the moving position of the process cartridge in the device.
Figure 20:
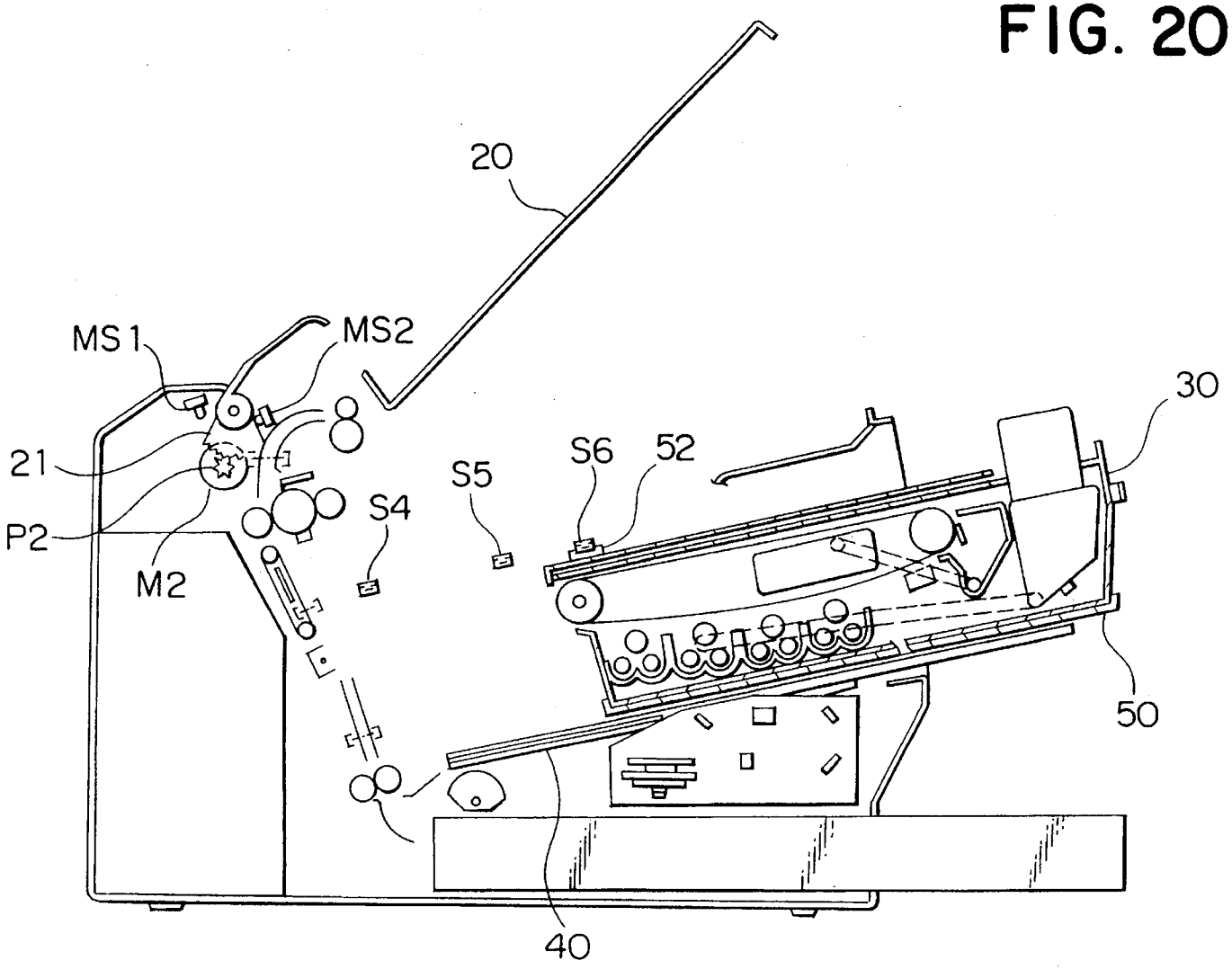
FIG. 20: Explanatory view representing the moving position of the process cartridge in the device.

The carriage 50 is integrated with a rack plate 51 which is engaged with the pinion P1 of the motor M1 of the main body, and it is slid and loaded with an inclined angle viewed from the directions shown in FIGS. 19 and 20 by the rotation of the motor M1.

As a result of actual use, from several degrees to 45 degrees is a practically usable range of the inclination angle of the process cartridge 30, and in a condition with little inclination, below several degrees, the merits obtained by having an inclination, mentioned later, are lost and if the inclination exceeds 45 degrees, not only the feeds of waste toner and supply of toner or developer to each developing device are accelerated but also the drive system is not coupled stably so that a collision may occur. The range which enables the toner feed and drive system coupling mentioned above to be stabilized smoothly is set to be 5 degrees to 25 degrees. For this reason, favorably, 5 degrees to 25 degrees is preferable and it is desired that this is determined by considering the weight of the cartridge 30 and motor M1's output.

Thus, the process cartridge 30 energizes each process material incorporated against the setting position forcibly by its own weight at the loading position and allows the gears coupled with each process material, mentioned later, to mesh with the drive gear on the main body securely so as to execute image forming by smooth power transmission without power loss.

Each gear coupled with process material incorporated in the process cartridge 30 is engaged with or disengaged from the drive gear of the main body.

Figure 29:
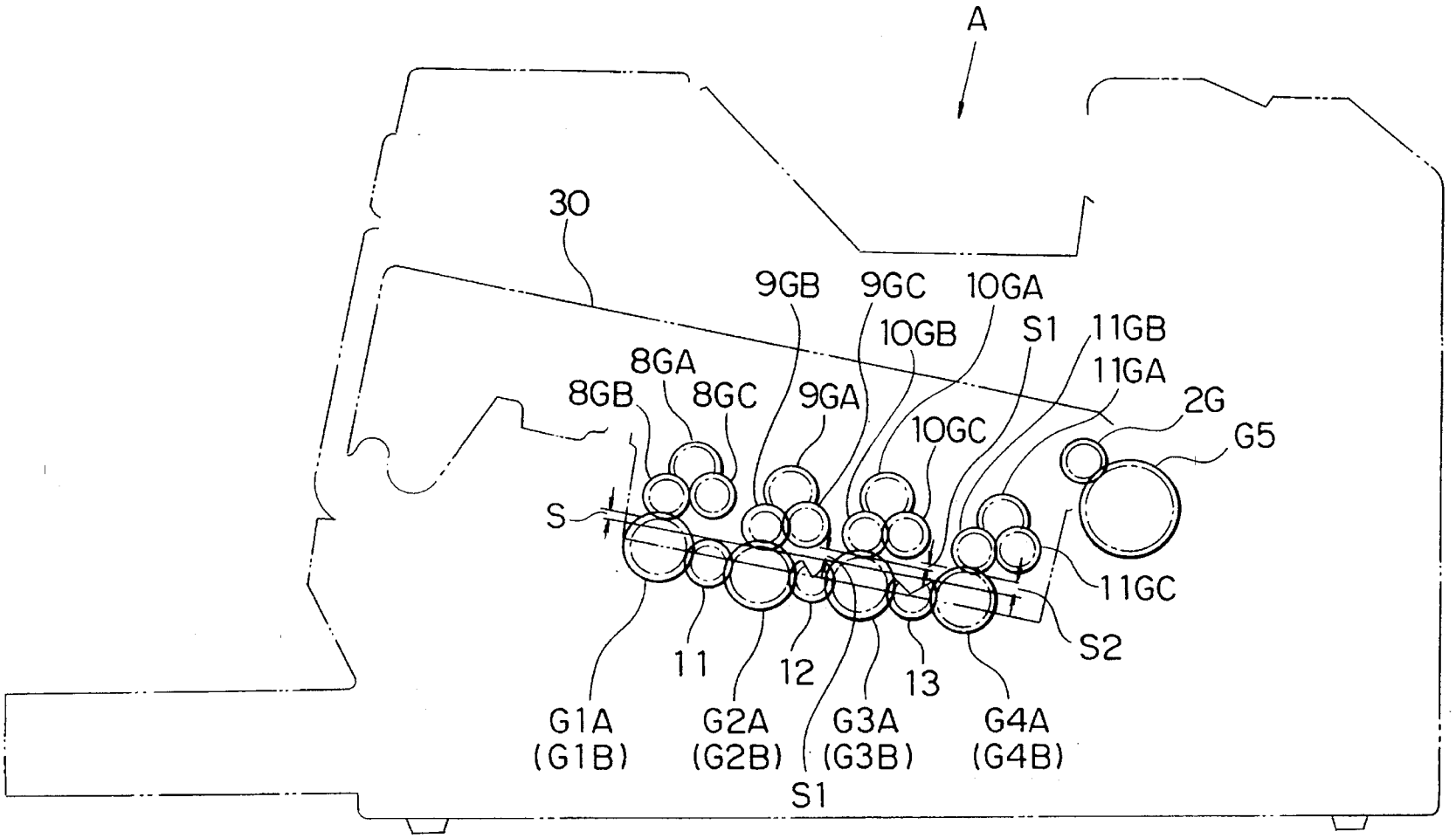
FIG. 29 is a side view of the drive system.
Figure 30:
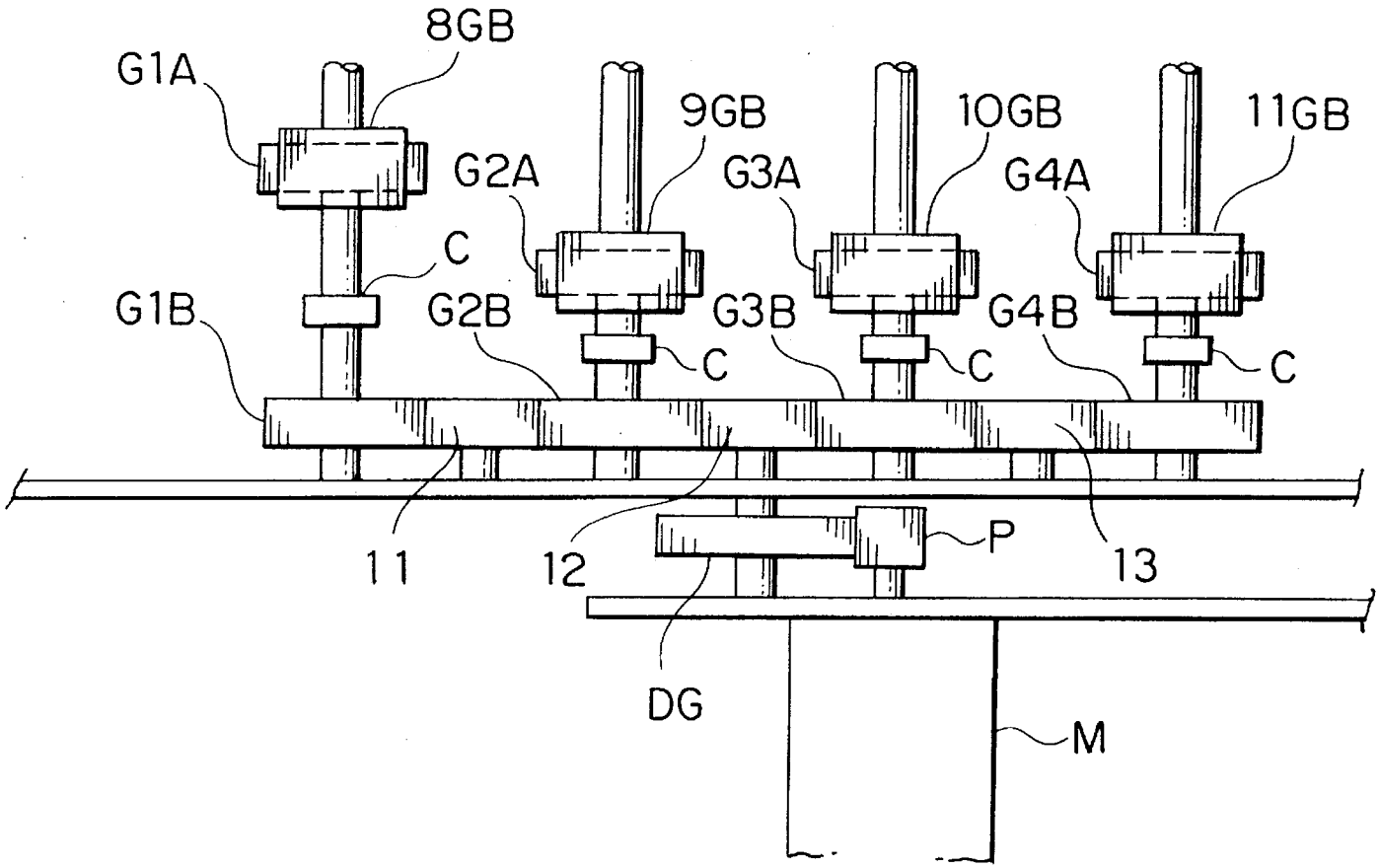
FIG. 30 is a view of the drive system.

FIG. 29 illustrates an arrangement of the gears when viewed from the back and FIG. 30 shows major parts viewed in A arrow direction.

In these figures, 8GA, 9GA, 10GA and 11GA are gears having the same diameter located on the same axis of the developing sleeves incorporated in the developing devices, and 8GB and 8GC, 9GB and 9GC, 10GB and 10GC, 11GB and 11GC are the gears of the same diameter, provided on the same axis of a pair of an agitation screw incorporated by each developing device.

The gears 8GA to 11GA and 8GC to 11GC are located at different positions in axial direction and not engaged with each other, but engaged with only the gears 8GA to 11GB.

On the other hand, G1A, G2A, G3A, G4A and G5 are output gears of the drive system, provided on the main body, and when the process cartridge 30 is loaded on the main body, the gear 2G integrated with the rotation roller 2 for rotating the gears 8GA to 11GA and the photoreceptor belt 1 is engaged so as to transmit power.

As shown in FIG. 30, the gears G1A to G4A are integrated with the gears G1B, G2B, G3B and G4B having the same diameter on the same axis each through an electromagnetic clutch C. The said gears G1B to G4B are coupled with a neighboring gear in series through the intermediate gears I1, I2, and I3 and driven simultaneously in the same direction by the rotation of the pinion P of the motor M coupled with an intermediate gear I2 and an integrated drive gear DG located on the same axis.

Thus, when the electromagnetic clutch C is switched from OFF to ON, any appropriate one of the gears G1A, G2A, G3A and G4A rotates and actuates a specific developing device engaged with it successively, thereby performing the above mentioned color image developing.

Here, each developing device is arranged along the surface of the photoreceptor belt, so that the gears 8GB to 11GB are arranged circularly. Therefore, when looking with the slide surface for inserting the process cartridge 30 as a reference, it is possible to arrange them so that the gear 11GB is located at the highest position while the gear 9GB is located at the lowest position, with appropriate difference step St1 to St3, for example.

In this case, when the gears 9GB to 11GB are arranged in line as shown in FIG. 30 while the gear 8GB is placed on the same vertical plane in parallel to them, upon loading the process cartridge 30, the gears G1A to G4A are not interfered with at all and the engagement and disengagement between the gears 8GB/G1A, G9B/G2A, 10GB/G3A, 11GB/G4A can be performed smoothly and accurately at the loading position.

Thus, of the gears 8GB to 11GB in the process cartridge 30, as shown in FIG. 30, only the gear 8GB is places at a different position in the same axial direction and the gear G1A to be engaged with the gear 8GB is set at a different position while the other gears 9GB, 10GB and 11GB are arranged on a line. Likewise, if the gears G2A, G3A and G4A on the main body are arranged on a line so as to make the gear line of the process cartridge 30 correspond to the gear line of the drive system, the gears 8GB to 11GB of the process cartridge 30 make no interference with the gears G1A to G4A on the main body, so as to make the engagement and disengagement smoothly and accurately.

Although the gears are arranged in two lines while the gear 9GB is set at the lowest position in the above embodiment, if the gear 10GB is set at the lowest position, engagements with the gears arranged in three parallel lines on the main body are obtained so as to secure a smooth engagement and disengagement.

Further, because the process cartridge 30 is loaded with an inclined angle, it can be located at a lower position than the toner supply hopper 30A as evident form the figure. Consequently, a supply of toner to the developing device 8, 9, 10 and 11 is facilitated, and in the waste toner cartridge 30B, on the other hand, waste toner is collected and accumulated effectively from the corners of the container due to not only the above mentioned but also a vibration on loading. The said process cartridge 30 is moved obliquely upward in parallel from the loading position by a reverse turn of the motor M1 as shown in FIGS. 19 and 20 and protruded from the side of the main body, so that it is held at a specific position.

On the other hand, the upper lid 20 is supported rotatably on the main body through the shaft 20A and opens by a turn in the counterclockwise direction to open the upper section of the main body.

Namely, the upper lid 20 is integrated with gear 21 in mesh with the pinion P2 of the motor M2 on its rotation base, turns in counterclockwise direction by the rotation of the motor M2 as shown in FIG. 20 and then is held at a specific angle.

The travel of the carriage 50 and the opening of the upper lid 20, that is, the rotation of the motors M1 and M2 are automatically started when a trouble occurs in replacement of the process materials, inspection, supply frequency and carrying of a transfer material. The process cartridge 30 is equipped with the counter function to accumulate the use frequency of incorporated process materials when it is newly loaded on the main body, the protrusion member 31 on the cartridge side as shown in FIG. 22 presses the counter C reset lever 35 provided on the main body so as to return the counter C indication to 0 and records the frequency of the following uses. When the durable use frequency of the blade 13A of the cleaning unit 13 or the service frequency of a belt reaches a specified level (standard), the signal S is output from the counter C.

(EXAMPLE)

Replacement cycle of the cleaning unit: 20,000 copies
Replacement cycle of the belt: 60,000 copies
Replacement signal of the cleaning blade: The signal S is output at 20.000, 40.000 and 60.000 copies.
Replacement signal of the belt: 60,000 copies When a new process unit is inserted at 60.000 copies, the counter C is reset. This signal detects the replacement and inspection frequencies of the photoreceptor belt 1, charger 6, each developing device, and cleaning unit 13.

A proposal represented in Japanese utility model No. 2-8295, related to this invention is applied to the protrusion member 31 and this prevents the same cartridge 30 from resetting the counter C again.

The process cartridge 30 incorporates the developer supply unit 30A comprising four toner supply hoppers for supplying toner to each developing device and the waste toner cartridge 30B for containing toner collected by the cleaning unit 13.

The developer supply unit 30A contains four toner cartridge filled with yellow magenta, cyan and black toner so as to be able to always drop each toner to the corresponding toner supply hoppers.

The developing agent supply unit 30A is provided with a sensor P as a detection means to detect consumption of developing agent or toner, which when the remaining amount of stored toner decreases below a specified level, outputs an electric signals' and transmits this signal to the main unit through the connector 32 shown in FIG. 22.

The waste toner cartridge 30B incorporates a sensor for detecting a toner collection amount, and when the toner collection amount exceeds a specific level, the signal S is output and transmitted to the main body.

On the other hand, the photosensors S1, S2 and S3 for detecting a transfer material pass are provided at important points on the transfer material transportation path. After a sensor upstream detects a transfer material pass, unless a sensor downstream can detect a transfer material after a specified time interval passes, the jamming detection signal S" (not shown) is output so as to detect a jam.

Each detection signal mentioned above is input into the control unit of the main body and output as the signal to control the rotation of the motors M1 and M2.

Figure 25:
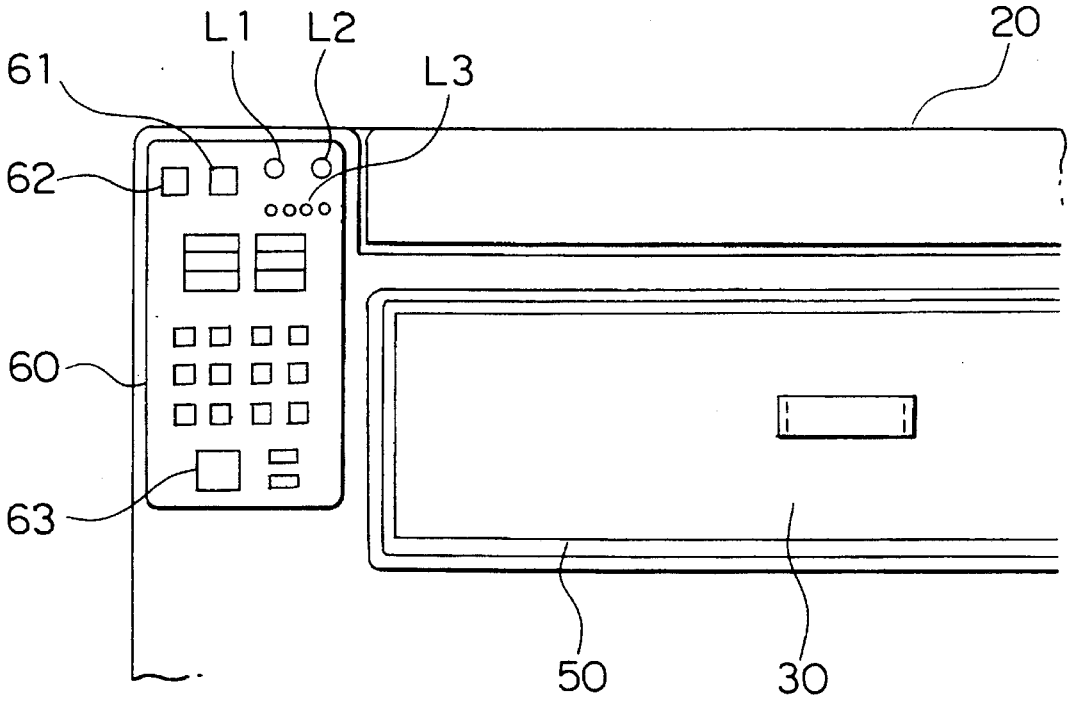
FIG. 25 is the plan of the control panel.

The unit is equipped with the lamp L1 for indicating jamming, lamp L2 for indicating a replacement of process material, lamp L3 for indicating the replenishment of developer, reset button 61 for starting the motors M1 and M2 in reverse direction and eject button for starting them in normal direction, as shown in FIG. 25 at its front side or the control/display section of the unit attached to the side indicated by the arrow B in FIG. 18(*a*).

When the jamming detection signal (S"), process material replacement and developer supply detection signal (S and S') are input into the control unit of the main body, the lamps L1, L2 and L3 light.

Figure 26:
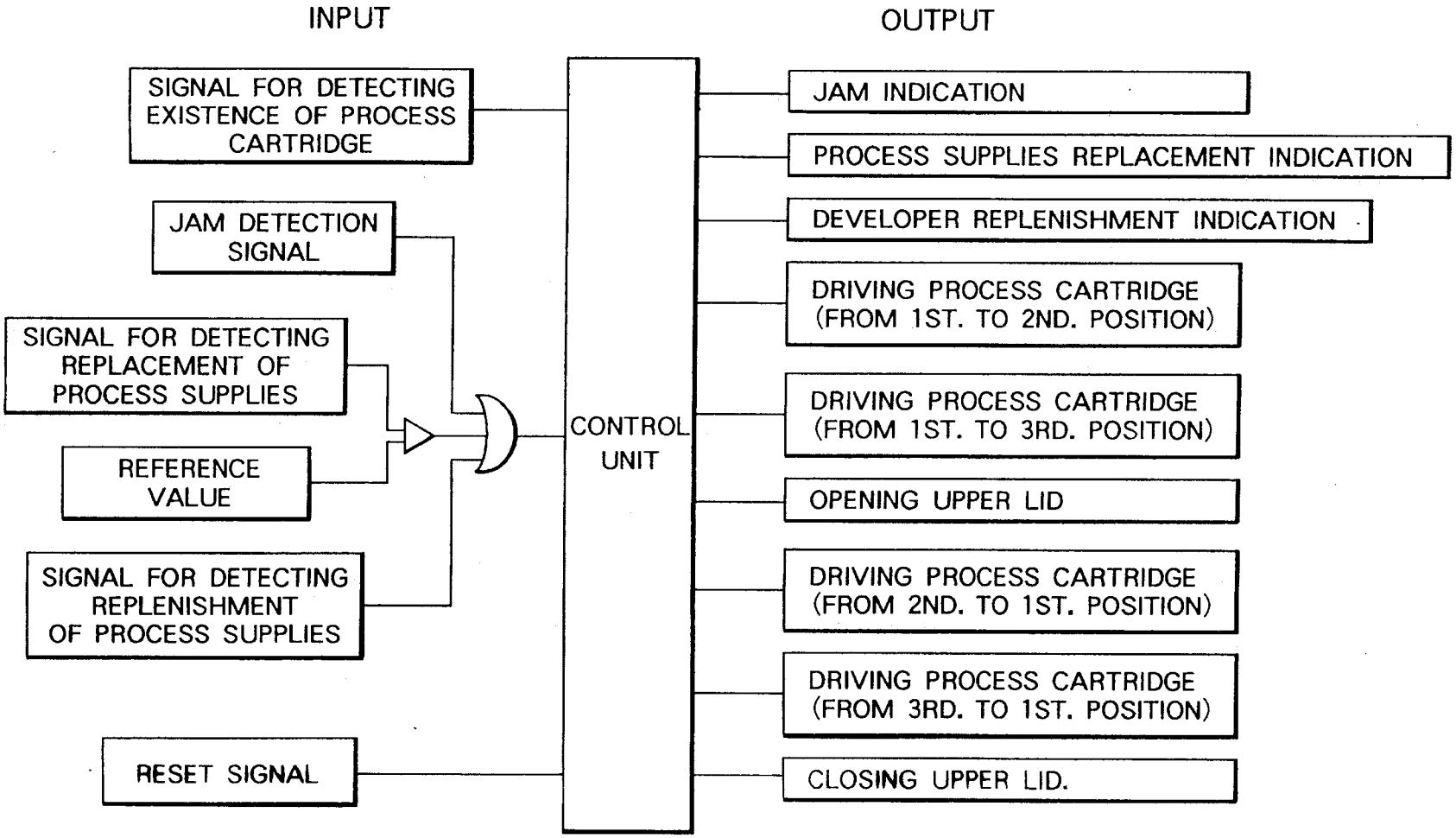
FIG. 26 is a block circuit diagram of the control system.
Figure 27:
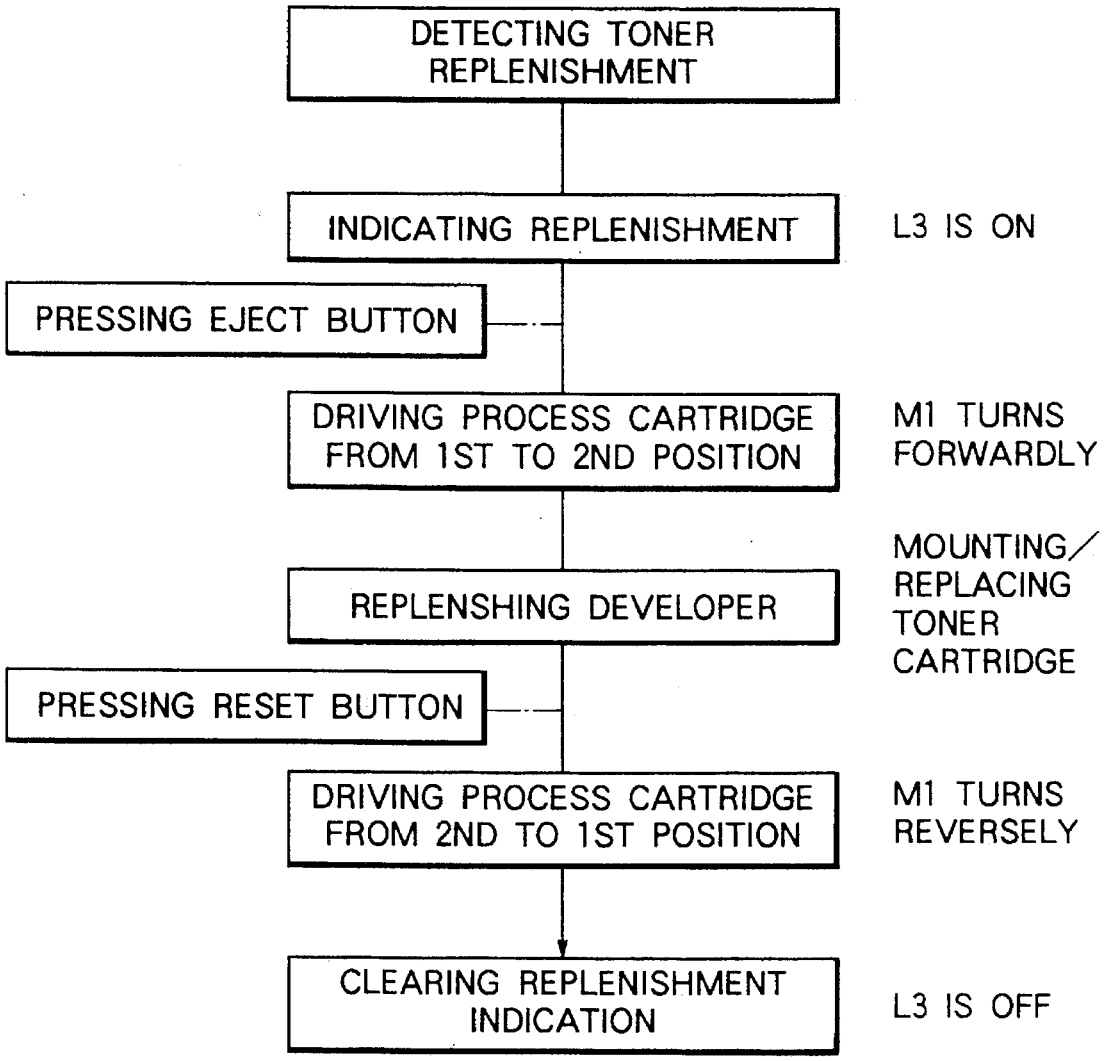
FIGS. 27*a–c* compose a flow chart of the control system.
Figure 27:
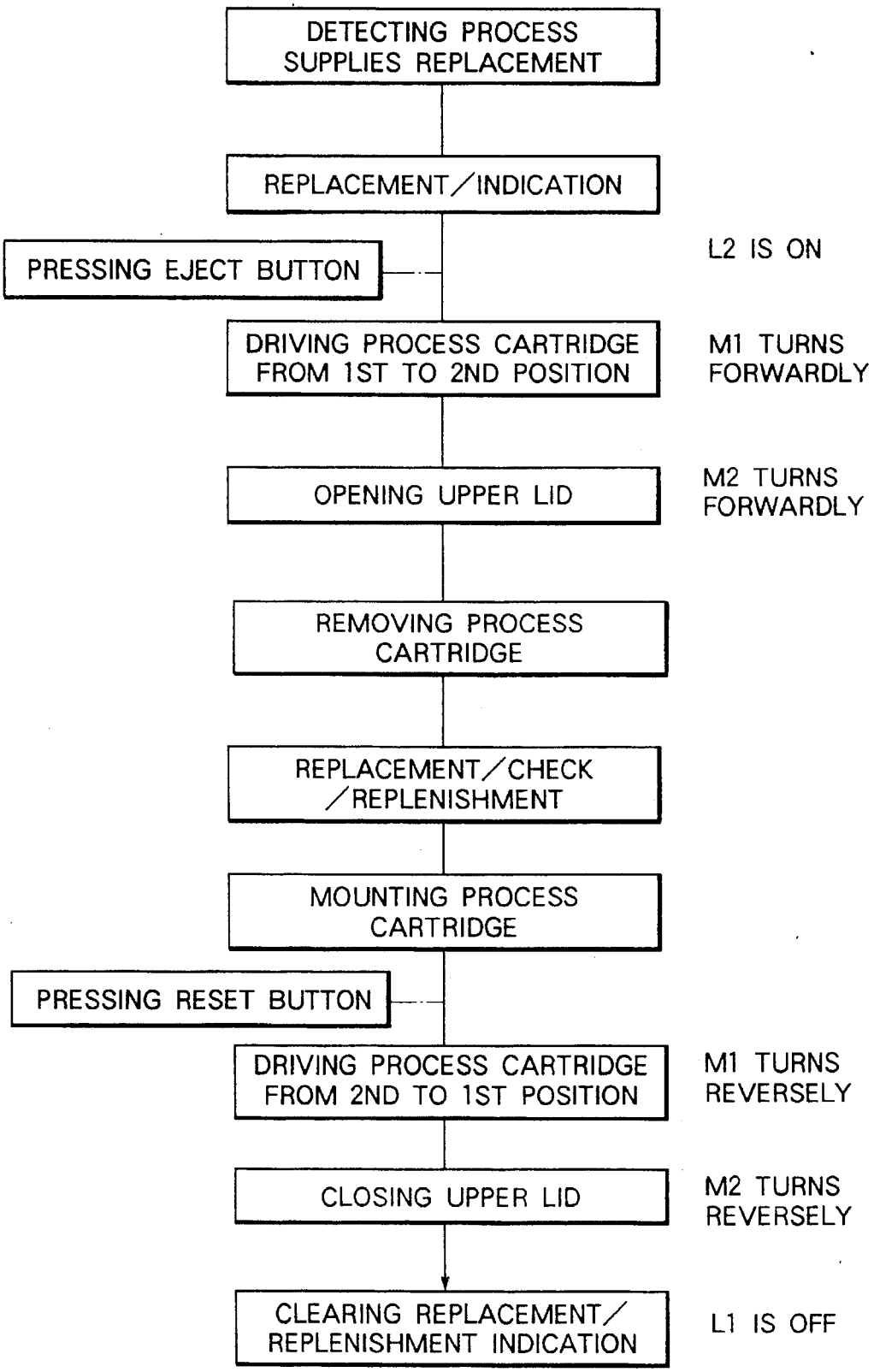
Figure 27:
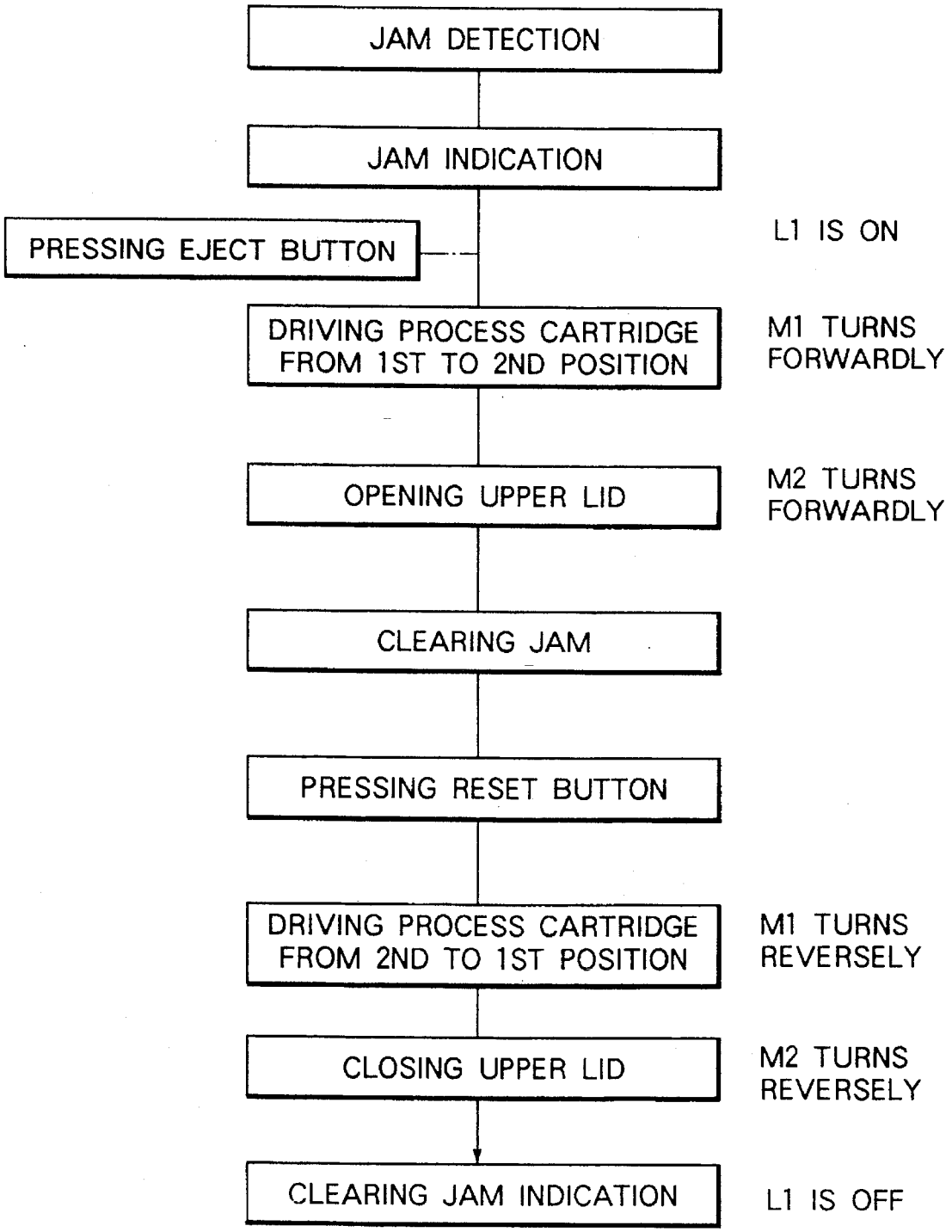

The process of motors M1/M2 rotation control by the input of the signal is explained according to a control unit circuit shown in FIG. 26 and a flow chart shown in FIG. 27.

The case that toner in the developer supply unit 30A is reduced and then the sensor P detects the timing for toner supply is explained.

Figure 23:
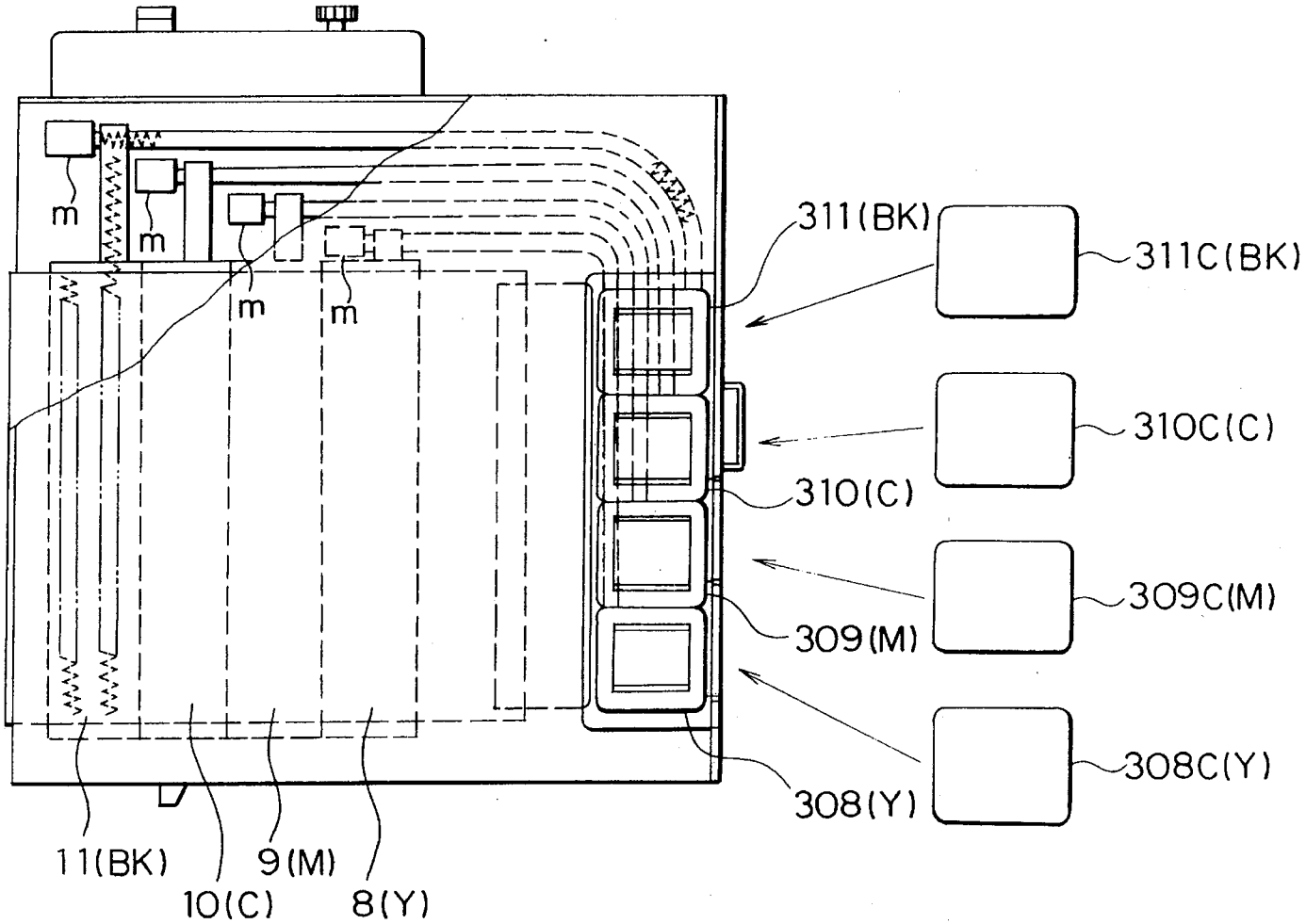
FIG. 23 is an explanatory view of the developer supply system.

FIG. 23 shows the plan of the process cartridge 30 viewed from the direction C in FIG. 18(*b*) and the developer supply unit 30A comprises the toner supply hoppers 308, 309, 310 and 311 containing yellow, magenta, cyan and black toners.

Each toner supply hopper mentioned above is connected to each corresponding developing device through a flexible supply pipe containing a transport screw so as to supply toner into the developing device by a rotation of the motor m corresponding to an image density detection signal.

When a toner supply signal S' is output to the toner supply hopper, the lamp L3 lights first as shown in FIG. 27(*a*) (preferable, a corresponding lamp to yellow, magenta, cyan and black toner) to modify replacement of a toner cartridge for the toner supply hopper and at the same time, a signal for supplying normal rotation to the motor M1 is output.

The carriage 50 is moved by the normal rotation of the motor M1 from a position indicated in FIG. 18(*a*) to a position indicated in FIG. 19 and the motor M1 stops at such a position where the light shield 52 switches the photosensor S5 of the main body from ON to OFF.

Consequently, the process cartridge 30 is moved from the first position enabling image forming in the unit to the second position enabling the replacement of a developer supply container or toner cartridge so as to protrude each toner supply hopper and toner cartridge out of the unit.

Figure 24:
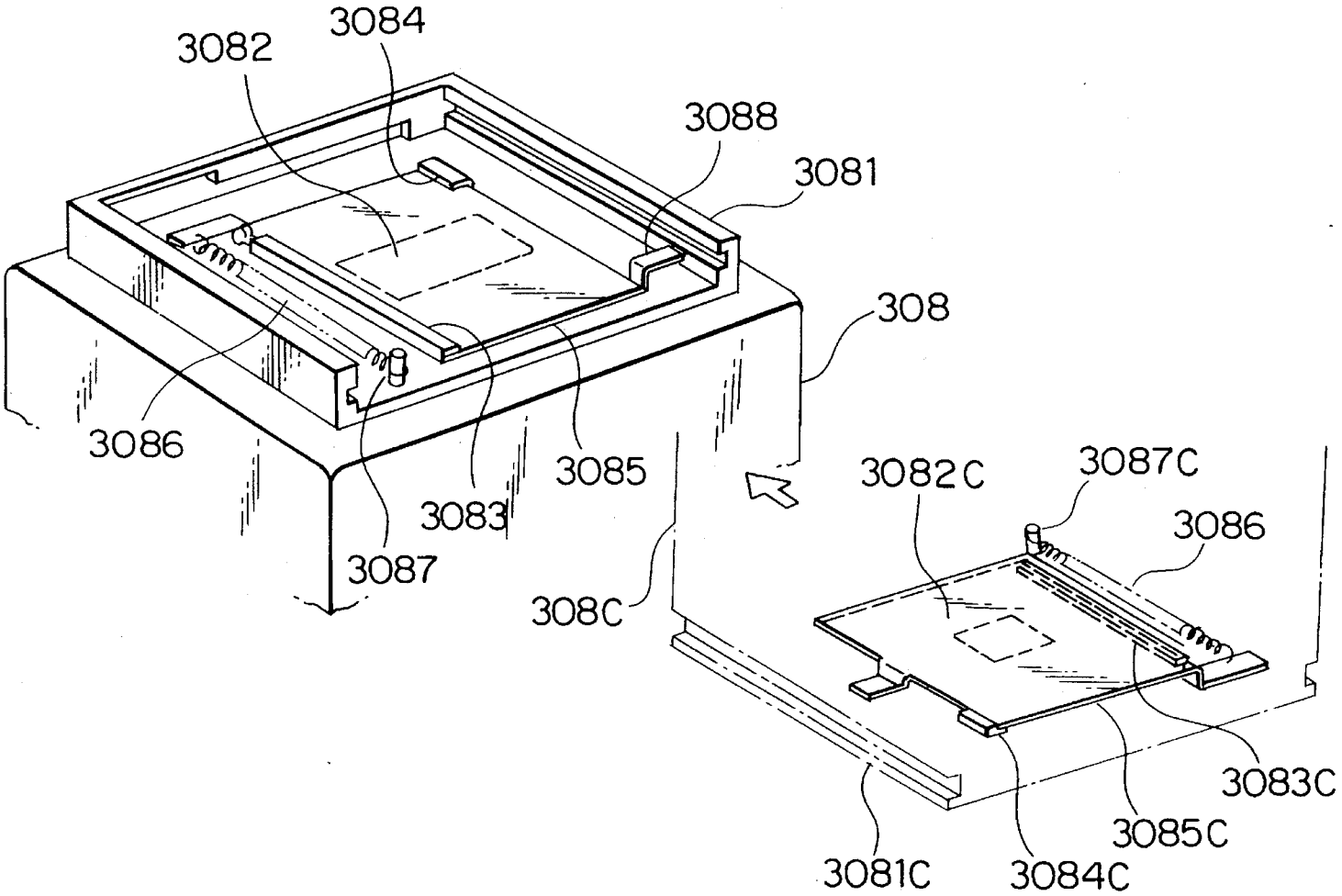
FIG. 24 is a perspective view of the developer supply mechanism.

The supply of toner to the toner supply hoppers 308, 309, 310 and 311 is automatically done by replacing the toner cartridges 308C, 309C, 310C and 311C filled with yellow, magenta, cyan and black toners. The replacement of a toner cartridge is explained by taking the toner cartridge 308C for the toner supply hopper 308 in FIG. 24 as an example.

The guide plate 3081 is fixed on top of the toner supply hopper 308, which is engaged with the toner cartridge 308C. And the toner receiving hole has an opening.

The toner receiving hole 3082 is covered by the shutter plate 3085 held by the guide rails 3082 and 3084 so as to be able to slide and always closed by energization in an opposite direction to the arrow by a tension spring 3082 provided on the same shutter plate 3085.

On the other hand, the toner cartridge 308C forms the step 3081C engaged with the guide plate 3081 of the toner supply hopper 308 on its bottom and has a toner drop hole 3082C in the center.

The toner drop hole 3082C is covered with the slidable shutter plate 3085C held by the guide rails 3083C and 3084C, and always closed by the energization of the tension spring 3086C provided on the same shutter plate 3085C in the arrow direction.

When inserting the toner cartridge 308C from the arrow direction so as to slidably engage the step 3081C with the guide plate 3081, the sprung pin 3087C of the cartridge presses the rise-up section 3088 of the shutter plate 3085 of the hopper, so that the same shutter plate 3085 is moved in the arrow direction, and slightly after, the rise-up section 3088C of the shutter plate 3085C of the cartridge comes into contact with the sprung pin 3087 of the hopper, thereby inserting the cartridge and simultaneously moving the shutter plate 3085C in an opposite direction to the arrow.

Consequently, when the cartridge is inserted until the step 3081C comes into contact with the deep side of the guide member 3081 and is engaged, the toner receiving hole 3082 and toner drop hole 3082C open at a position where they match each other, so that toner in the toner cartridge 308C automatically is poured into the toner supply hopper 308.

When the reset button is pressed after the toner cartridge 308C is replaced, power for reverse rotation is supplied to the motor M1, so that the process cartridge 30 starts to move from the second position to the first position and the light shield 52 switches the photosensor S4 from OFF to ON, where the motor 1 stops so as to set a condition for enabling image forming again, thereby turning out the lamp L3.

Additionally, the travel of the process cartridge 30 or the unit to the second position can be implemented by pressing the eject button by hand.

Figure 21:
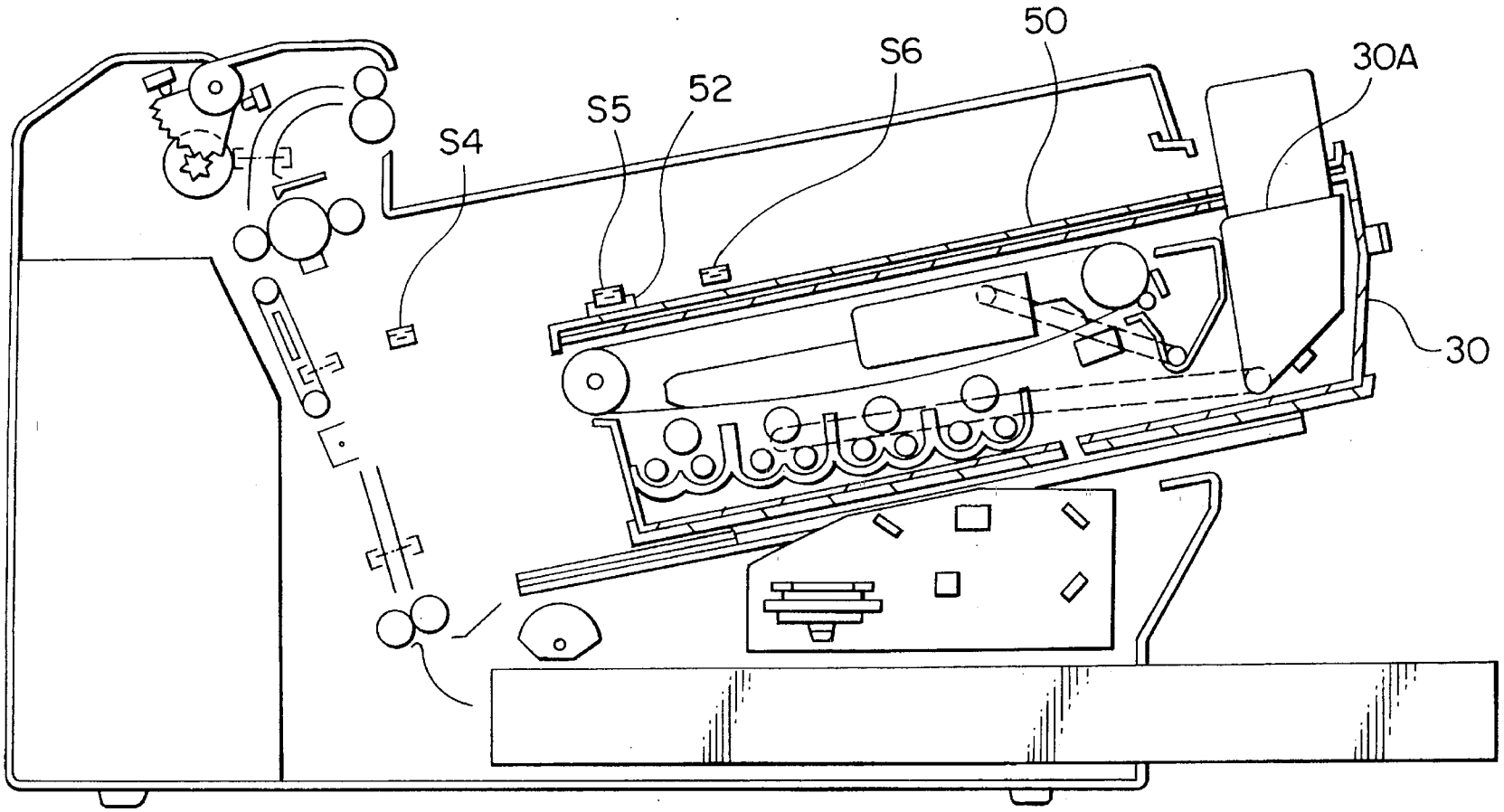
FIG. 21 is a view representing the moving position of the process cartridge in the device.

Further, it is allowed to, instead of incorporating each toner cartridge in the process cartridge 30, load a toner cartridge when the process cartridge 30 travels to the second position as shown in FIG. 21 and make it supply toner to each toner supply hopper for temporary use.

Next, the case that the process material replacement timing is detected by the counter C and a jam of a transfer material is detected by the photosensors S1 to S3 is explained.

When the electric signal S from the counter C or signal S" from the photosensors S1 to S3 is input into the control unit, the lamp L2 or L1 lights first as shown in FIGS. 27(*b*) and 27(*c*) to indicate the replacement of process material or a jam and simultaneously, a signal for supplying power for rotating the motors M1 and M2 in normal direction is output.

Consequently, the carriage 50 is moved by the normal rotation of the motor M1 from a position shown in FIG. 18(*a*) to a position shown in FIG. 20 and the light shield 52 on top switches the photosensor S6 from ON to OFF, where the motor stops.

As a result, the process cartridge 30 is moved from the first position enabling image forming in the unit to the third position enabling the treatment of a jammed transfer material and attachment/detachment, so that the process cartridge can be removed from the carriage 50 easily to replace and inspect a process material with high efficiency.

On the other hand, the motor M2 rotates in normal direction following or at the same time as this, the upper lid 20 rotates from an angle indicated in FIG. 18(*a*) to an angle indicated in FIG. 20 to release the opening, and when the gear 21 presses the switch MS2 of the main body and reaches an angle to switch from OFF to ON, the motor M2 stops.

Consequently, the treatment of a jammed transfer material can be done easily as well as moving of the process cartridge mentioned above.

When the process cartridge 30 is removed from the carriage 50 for replacement and replenishment of process material, if it is placed on the carriage 50 again as shown in FIG. 27(*b*), the bottom of the cartridge 30 presses the switch MS3, switching from OFF to ON, so that process cartridge 30's storage detection signal is input. Consequently, a signal to supply a power for reverse rotation to the motors M1 and M2 is output.

As a result, the process cartridge 30 travels from the third position to the first position again and the motor M1 stops where the light shield 52 switches the photosensor S4 of the main body from OFF to ON, so that each process material is maintained in the condition to enable image forming.

On the other hand, the upper lid 20 turns clockwise by the reverse rotation of the motor M2 and then stops at such an angle that the switch MS1 is switched from OFF to ON, and the opening on top of the main body is closed, so that copying may be conducted.

When only treating a jammed transfer material, if the process cartridge 30 remains set on the carriage 50, pressing the reset button provided on the control/display section 60 as shown in FIG. 27(*c*) outputs a signal for supplying an electric power to reverse the motors M1 and M2 instead of the action by the switch MS3.

The lamp L1 for indicating a jamming and L2 for indicating the replacement are automatically turned out when the process cartridge 30 returns to the first position and the upper lid 20 is completely closed.

Meanwhile, it is possible to provide the control/display section 60 with an eject button 62 upon replacement due to consumption and make the motors M1 and M2 start rotating in normal direction by the pressure. Further, considering the safety of an operator when automatic opening/closing, the reverse rotation of the motors M1 and M2 can be started at an arbitrary timing by pressing the reset button 61 before or after the process cartridge 30 is loaded.

As a result, after confirming that the lamps L1 and L2 light, moving of the process cartridge 30 and opening/closing of the upper lid 20 are performed by button operation, thus the mechanism is simplified and safety is secured.

Figure 28:
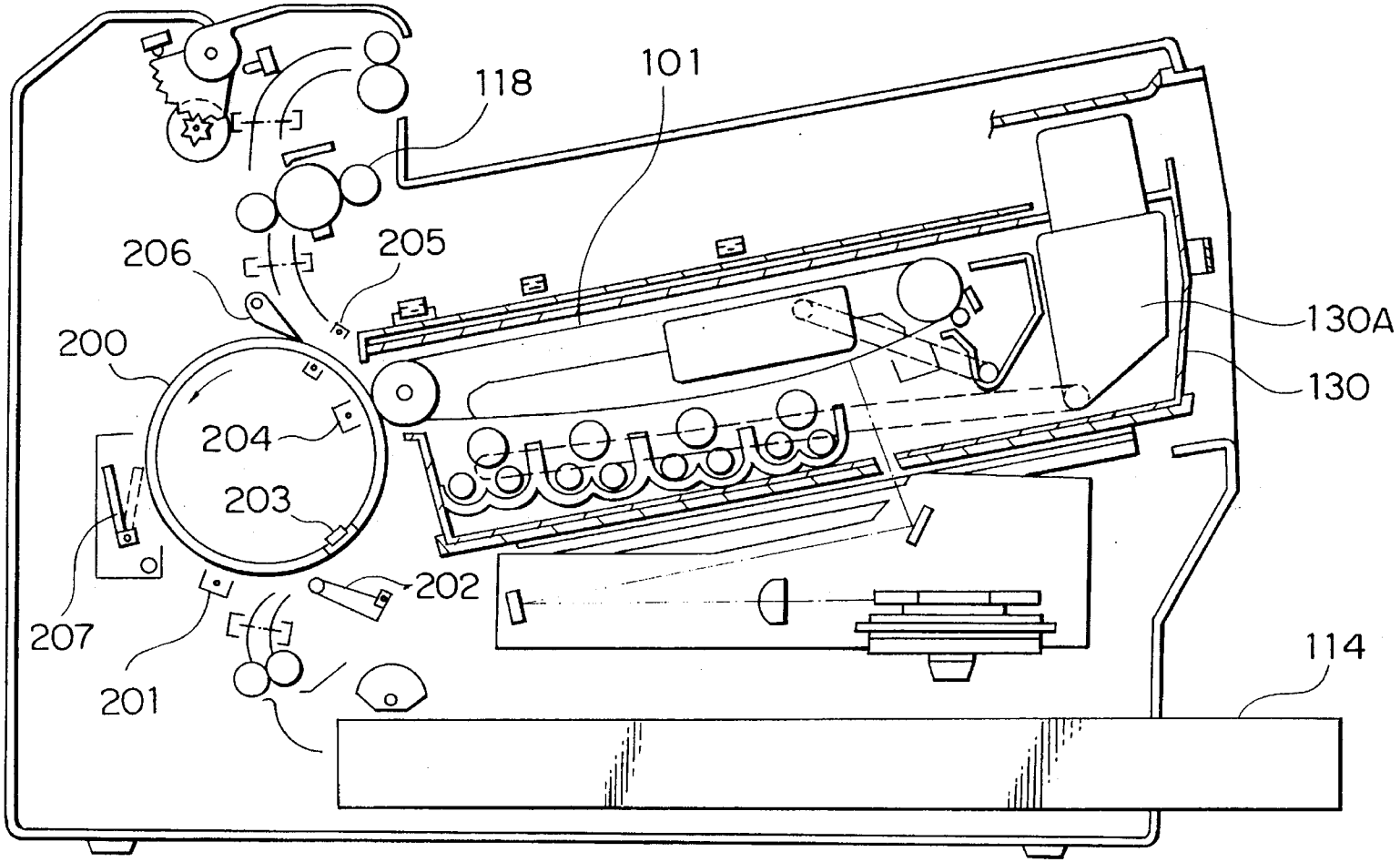
FIG. 28 is a sectional configuration diagram of the transfer drum device.

FIG. 28 shows an image forming apparatus of transfer drum type as another embodiment of the present invention. The photoreceptor belt 101 and the process cartridge are almost the same as the preceding embodiment, but the transfer drum 200 is made to come into contact with its transfer section. The transfer drum 200 rotates in the arrow direction (counterclockwise) in synchronization with the photoreceptor belt 101. A transfer material is wound on the outside surface of the transfer drum 200, and a toner picture is transferred on the wound transfer material. After toner pictures are put one over another, the transfer material is separated from the transfer drum, and after the picture is settled, it is discharged onto the unit.

A charger 201 for attracting a transfer material electrostatically and the winding member 202 for mechanically winding a transfer material on the transfer drum are provided on the circumference of the transfer drum 200. The winding member 202 has a roller at its end and makes a contact with the drum only when a transfer material is wound on the transfer drum first. The transfer drum 200 is provided with a gripper 203 on its circumference and holds the front end of a transfer material carried in synchronization. Numeral 205 is a static eliminating electrode for separation and 206 is a separation pawl. Numeral 207 is a detachable cleaner and wipes off toner adhering to the transfer drum after a transfer material is separated.

After being discharged from the paper feed cassette 114, the transfer material advances with synchronization toward the transfer drum charged by the charger 201, is wound around by the winding member 202, turned to the transfer section while the front end of the transfer material is held by the gripper, and then a yellow toner picture formed on the photoreceptor belt 101 is transferred to a transfer material by the transfer unit 204 on the transfer section. After the initial transfer is completed, the transfer drum 200 continues to rotate so that a magenta toner picture at the second turn, a cyan toner picture at the third turn and a black toner picture at the fourth turn are transferred so that they are put one over another. When the transfer of four color toner pictures is completed, the transfer material is deprived of static electricity by the separation static eliminator electrode 205, the holding of the front end of the transfer material is released by the separation pawl 206 and then it is separated and carried to the fixing roller 118.

In the image forming apparatus of this embodiment, the transfer drum 200 is located on the main body and is not contained in the process cartridge 130 which can be moved and taken out. Thus, the insertion of the process cartridge 130, jamming treatment and toner supply are carried out like the previous embodiment.

Meanwhile, it is possible to provide the main body with a developer supply unit so that it is automatically connected or disconnected to each developing device depending on the mounting/dismounting of the process cartridge.

Figure 31:
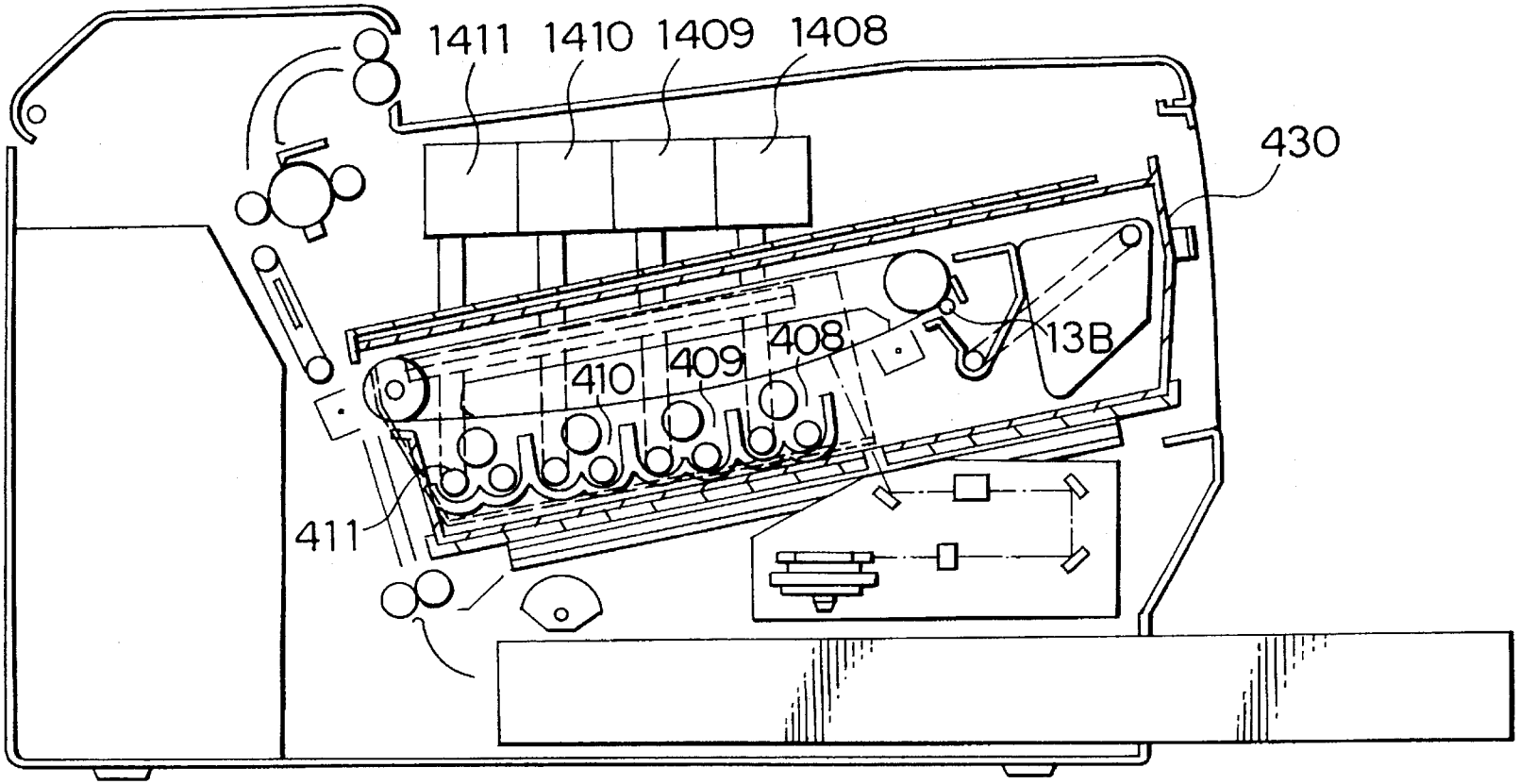
FIG. 31 is a sectional configuration diagram of the image forming apparatus of another embodiment.
Figure 32:
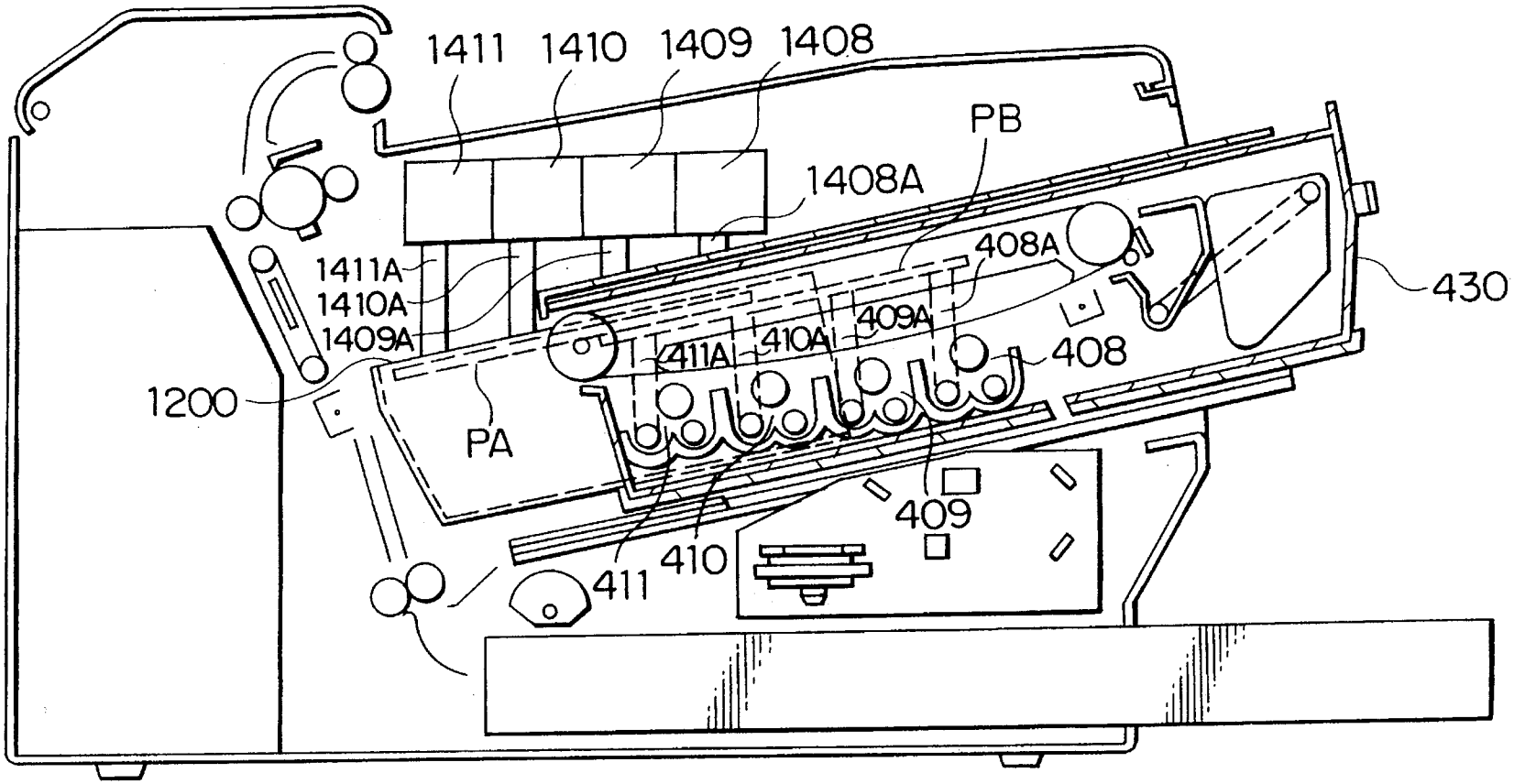
FIG. 32 is an explanatory view representing the moving position of the process cartridge in the device.

The configuration of such an apparatus is explained according to the further another embodiment shown in FIGS. 31 to 33. The toner supply hoppers 1408, 1409, 1410 and 1411 containing yellow, magenta, cyan, and black toners are arranged horizontally in parallel along the process cartridge 30 removal direction and connected to each corresponding developing device through the supply pipes 1408A, 1409A, 1410A and 1411A set vertically.

A joint section comprises the upper joint plate PA on which the supply pipes 1408A, 1409A, 1410A and 1411A are fixed and the lower joint plate PB on which the supply pipes 408A, 409A, 410A and 411A of the developing device side are fixed, and when the process cartridge 430 is mounted or dismounted, the lower joint plate PB is moved and then the toner receiving holes 408B, 410B and 411B of the lower joint plate PB are aligned with the toner drop holes 1408B, 1409B, 1410B and 1411B so as to supply toner or are retracted to stop the supply.

The toner drop holes are covered with the shutter plate 1000 supported slidably by the guide rails 1001, 1002A and 1002B.

The shutter plate 1000 has four shutter holes 1000A at an equal distance corresponding to each toner drop hole but they are not aligned with the toner drop holes by the energization of the tension spring 1003 in an opposite direction to the arrow, so that each drop hole is closed.

On the other hand, each toner receiving hole is covered with the shutter plate 2000 supported slidably by the guide rails 2001, 2002A and 2002B.

The shutter plate 2000 has four shutter holes 2000A at an equal distance corresponding to each toner receiving hole but they are not aligned with the toner receiving holes by the energization of the tension spring 2003 in the arrow direction, so that each toner receiving hole is closed.

When the process cartridge 30 is mounted at a specified position in the main body, the joint plate PB is slid in the arrow direction and comes just below the joint plate PA. Consequently, the sprung pin 2004 of the joint plate PB presses the rise-up section of the shutter plate 1000 of the joint plate PA to slide the shutter plate 1000, aligning the shutter hole 1000A with each toner drop hole to open the hole. On the other hand, the rise-up section 2005 of the shutter plate 2000 of the joint plate PB is pressed by the sprung pin 1005 of the joint plate PA so that the shutter plate 2000 is slid, aligning the shutter hole 2000 with each toner receiving hole to open the hole and then enable the supply of toner.

Further, a toner receiving container 1200 is provided below the joint plate PA to receive toner scattered or dropped when the toner drop hole and toner receiving hole open or close, protecting the main body from contamination and damage by toner.

Because the toner receiving container 1200 is mounted along the inclination angle of the process cartridge with the bottom inclined, it is able to store toner from corner to corner with a high efficiency, thus eliminating the necessity of throwing out waste toner frequently and extending the interval of toner collection.

As mentioned above in detail, the present invention presents an image forming apparatus characterized in that when a jamming occurs, the process cartridge automatically retracts from the position which enables image forming, the paper feed cassette retracts from the position which enables paper feed and the upper cover opens, and upon insertion, the process cartridge and cassette can be set at an optimum position.

Consequently, the image forming apparatus of the present invention moves the process cartridge and cassette automatically, and the upper cover opens when detecting a jam is detected, thus an operator can treat the jamming easily. In addition, upon treatment of a jam, an operator can recognize the position of a jammed paper by retracting the process cartridge and cassette up to the second position and taking a glance at the inside of the main body through an opening of the upper cover, so that a large working space can be secured and the image carrying member cannot be damaged when a jammed paper is removed, and further the image carrying member is not touched directly by an operator's hand.

Further, the drive system of the image forming apparatus of the present invention is structured so as to drive the photoreceptor belt, developing unit, cleaning unit, toner supply unit, waste toner collection unit and paper feed unit by a single drive source, and when a jamming occurs, stop the above image forming process, thereby switching the clutch or circuit to retract the process cartridge and paper feed cassette and open the upper cover, so that reductions of power consumption and power supply unit size can be implemented by minimizing the load on the drive source.

In addition, the present invention presents an image forming apparatus characterized in that when the button of the control unit is pressed, the process cartridge retracts from the position which enables image forming, the cassette retracts from the position which enables paper feed and the upper cover automatically opens, and upon insertion, the process cartridge and cassette can be set at an optimum position.

Consequently, the image forming apparatus of the present invention allows the process cartridge and cassette automatically to move by a simple operation, thus they can be replaced by pulling them slightly out of the second position. Namely, an operator is able to replace the process cartridge and cassette easily and does not have to replace his to grip on the process cartridge at the time of replacement. Additionally, because not only the process cartridge and cassette are retracted up to the second position but also the upper cover is opened for jamming treatment, an operator can recognize the position of a jammed paper by taking a glance at the inside of the main body through the opening of the upper cover, so that a large working space can be secured so as to improve the working efficiency of jamming treatment and the image carrying member cannot be damaged when a jammed paper is removed, and further the image carrying member is not touched directly by operator's hand. Even if a misoperation is done during the travel of the process cartridge and cassette, it is not accepted, therefore no malfunction or trouble occurs. Still further, because the process cartridge is mechanically moved, the process cartridge can be replaced and a jam can be treated without applying unnecessary vibration on the process cartridge and scattering developer, thereby improving maintainability.

When this image forming apparatus is applied as a color printer, it is structured so as to enable the operations for moving in/out the process cartridge and cassette, jam clearance and supply of toner through the front panel, thereby realizing the same operation efficiency and maintainability as the one-way operability of a monochrome printer.

Furthermore, the present invention has realized a process cartridge which is attachable to and detachable from the main body easily, and driven with incorporated process materials set appropriately on each specified position and consequently, a high performance, highly practical image forming apparatus which enables the process of image forming to be always implemented in an optimum condition and facilitates the replenishment and collection of toner has been realized.

What is claimed is:

1. An image forming apparatus for forming an image based on corresponding image signals, said apparatus comprising:

an image carrying member for carrying a latent image formed corresponding to said image signals;

a first driving device for rotating said image carrying member;

a first gear device mounted on said first driving device;

a developing device for developing said latent image to form a developed image on said image carrying member;

a transferrer for transferring said developed image to a transfer material;

a storage rack for storing said transfer material;

a carrier for carrying said transfer material to said transferrer from said storage rack;

a cleaner for cleaning residual toner from said image carrying member after said developed image is transferred to said transfer material;

a process cartridge enclosing said image carrying member, said first driving device, said first gear device, and at least one of said developing device and said cleaner;

a moving device for moving said process cartridge between a first position in which said process cartridge is within said apparatus, whereby said apparatus is operable to form said developed image on said image carrying member and to transfer said developed image to said transfer material, and a second position in which at least a part of said process cartridge is outside said apparatus, whereby said process cartridge can be detached from said apparatus;

a control for generating a command signal to instruct movement of said process cartridge between said first position and said second position; and a second gear device provided on said apparatus, for transferring a driving power to said first gear device when said process cartridge is in said first position; wherein said moving device moves said process cartridge to said second position from said first position in response to said command signal whereby said process cartridge is separated from said transferrer, without moving said transferrer, or any part of said carrier, said first gear device separating from said second gear device when said process cartridge is in said second position.

2. The image forming apparatus of claim 1 wherein said control is provided on a control panel of said apparatus, and said control generates said command signal in response to prompting by an operator.

3. The image forming apparatus of claim 2 wherein said moving device does not move said process cartridge when said apparatus is operable.

4. The image forming apparatus of claim 1 wherein a first moving direction of said process cartridge by said moving device, is the direction in which said process cartridge moves for removal from said apparatus.

5. The image forming apparatus of claim 1 wherein said process cartridge encloses said image carrying member, said developing device, and said cleaner.

6. The image forming apparatus of claim 1 comprising a plurality of developing devices, each of which forms a different color toner image on said image carrying member.

7. The image forming apparatus of claim 6 wherein said plurality of developing devices form a plurality of color toner images on said image carrying member, whereby said color toner images are superposed on said image carrying member.

8. The image forming apparatus of claim 1 further comprising a transfer body.

9. The image forming apparatus of claim 1 wherein an open space is formed over said transferrer, by movement of said process cartridge to said second position from said first position, allowing access to said transferrer by an operator of said apparatus.

10. The image forming apparatus of claim 9 wherein said operator can manually access said transferrer through a cover of said apparatus.

11. The image forming apparatus of claim 1 wherein at least part of said process cartridge is movable to outside said apparatus, through an access covered by an entrance cover.

12. The image forming apparatus of claim 1 wherein said moving device moves said storage rack between a feeding location, wherein said carrier is operable to carry said transfer material to said transferrer from said storage rack, and a dismount location at which said storage rack is removable from said apparatus.

13. The image forming apparatus of claim 12 wherein said moving device moves said storage rack to said dismount location from said feeding location in response to a command signal.

14. The image forming apparatus of claim 12 wherein said moving device moves said storage rack to said dismount location from said feeding location in response to a no-recording-sheet signal.

15. The image forming apparatus of claim 12 wherein a first moving direction of said process cartridge, from said first position to said second position, is the same as a second moving direction of said storage rack, from said feeding position to said dismount position.

16. The image forming apparatus of claim 1 wherein said moving device moves said process cartridge to said first position from said second position in response to a displace signal generated from a detector detecting the displacement of said process cartridge to said second position.

17. The image forming apparatus of claim 1 wherein said moving device moves said process cartridge to said first position from said second position in response to a setting signal generated by a setting signal generator in a control panel.

18. The image forming apparatus of claim 1 wherein said moving device moves said storage rack to a dismount location from a feeding location in response to a displace signal generated by a detector for detecting displacement of said process cartridge to said second position.

19. The image forming apparatus of claim 1 wherein said moving device operates to move an apparatus cover to an open position from a closed position in response to said command signal.

20. The image forming apparatus of claim 19 wherein said moving device moves said apparatus cover to said closed position from said open position in response to a displace signal generated by a detector for detecting displacement of said process cartridge to said second location.

21. The image forming apparatus of claim 1 wherein said process cartridge is mounted in said apparatus at an inclined angle of 5° to 25°.

22. The image forming apparatus of claim 1 wherein said moving device does not move said process cartridge when said apparatus is in said operating condition.

* * * * *